United States Patent [19]

Eaves et al.

[11] Patent Number: 4,574,566

[45] Date of Patent: Mar. 11, 1986

[54] WRAPPING MACHINE AND METHOD

[75] Inventors: Fred W. Eaves, Clayton, Wis.; Timothy S. Matt, Bay Village, Ohio; Wayne D. Sommer, Amery, Wis.; James B. Wensink, Westlake, Ohio

[73] Assignee: Doboy Packaging Machinery, Inc., New Richmond, Wis.

[21] Appl. No.: 691,501

[22] Filed: Jan. 14, 1985

[51] Int. Cl.[4] ..... B65B 9/20; B65B 57/08; B65B 57/16

[52] U.S. Cl. ..... 53/450; 53/55; 53/550

[58] Field of Search ..... 53/55, 75, 64, 51, 550, 53/389, 373, 450, 477, 451, 551, 552, 562

[56] References Cited

U.S. PATENT DOCUMENTS

| | | | |
|---|---|---|---|
| 3,445,981 | 5/1969 | Hori | 53/450 |
| 3,552,088 | 1/1971 | Niwa | 53/450 |
| 3,958,390 | 5/1976 | Pringle, Jr. et al. | 53/450 X |
| 4,106,262 | 8/1978 | Aterianus | 53/450 |
| 4,115,981 | 9/1978 | Hell et al. | 53/55 |
| 4,183,193 | 1/1980 | Klingelhofer et al. | 53/550 X |
| 4,299,075 | 11/1981 | Gram | 53/550 |
| 4,381,637 | 5/1983 | Ballestrazzi et al. | 53/550 X |

*Primary Examiner*—Horace M. Culver

*Attorney, Agent, or Firm*—Orrin M. Haugen; Thomas J. Nikolai

[57] ABSTRACT

A wrapping machine which includes a film former for shaping a continuous film of packaging material into a continuous tube, a film drive for drawing the continuous film of packaging material past the former and past a cutting and sealing station, a product infeed drive for feeding products to be packaged through the former into the continuous tube of packaging material so that the products are spaced apart from one another in the tube, and a motor-driven rotary cut/seal head at the cutting and sealing station for cutting and sealing the continuous tube of packaging material as each product moves through that station. The wrapping machine also includes independent closed-loop servo-control circuits for the film drive, the product infeed drive, and the cut/seal head drive, each of which is responsive to a desired velocity control signal. The wrapping machine also includes a first encoder on the shaft of a roller driven by the moving film a second encoder coupled to the product infeed drive, and a resolver coupled to the cut/seal head drive. A microprocessor-based controller (MBS) is coupled to the encoders, the resolver, and the servo loops for the infeed, film feed, discharge and cut/seal head drives. It derives a desired infeed velocity signal and a cut/seal head velocity profile signal based upon a film drive motor tachometer and outputs these desired velocity signals to the respective servo loops for the product infeed drive and the cut/seal drive. The controller is further responsive to the film travel encoder, film eyespot sensor, infeed travel encoder and pusher sensor outputs to adjust the product infeed velocity to maintain proper orientation of the products relative to the film. The controller is likewise responsive to the sensor inputs to adjust the cut/seal head velocity to maintain proper orientation of cutting and sealing relative to the film and product positions.

18 Claims, 76 Drawing Figures

Fig. 5a
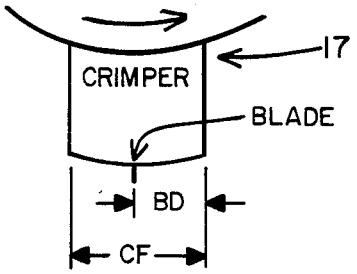
Fig. 5b
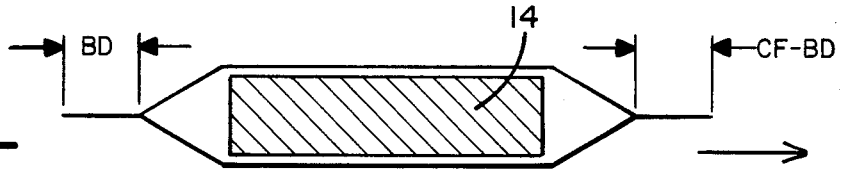
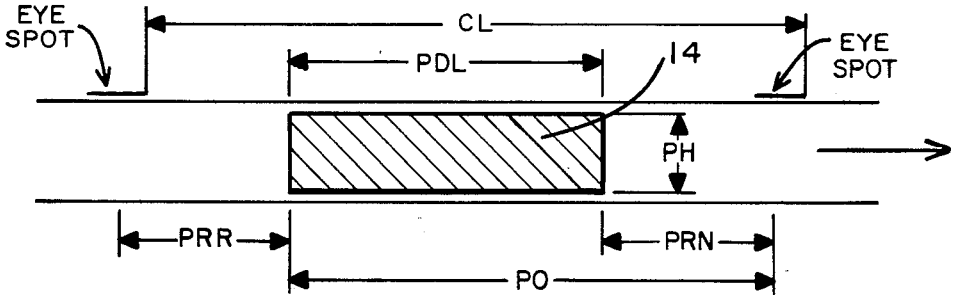
Fig. 5c
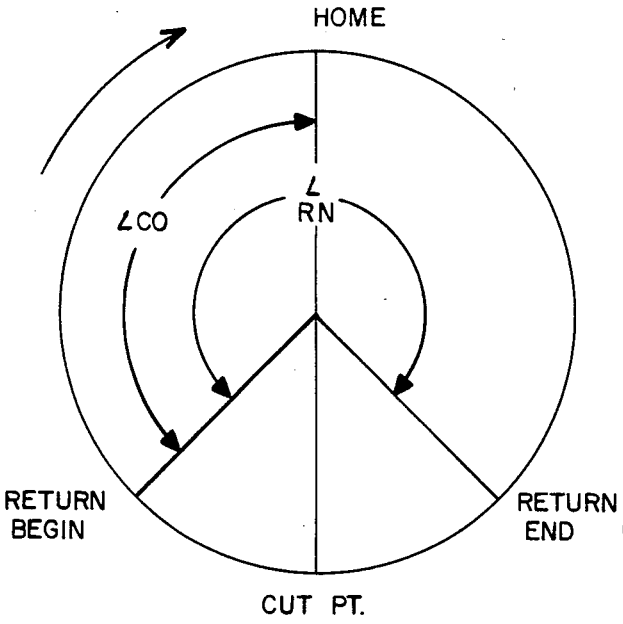
Fig. 6
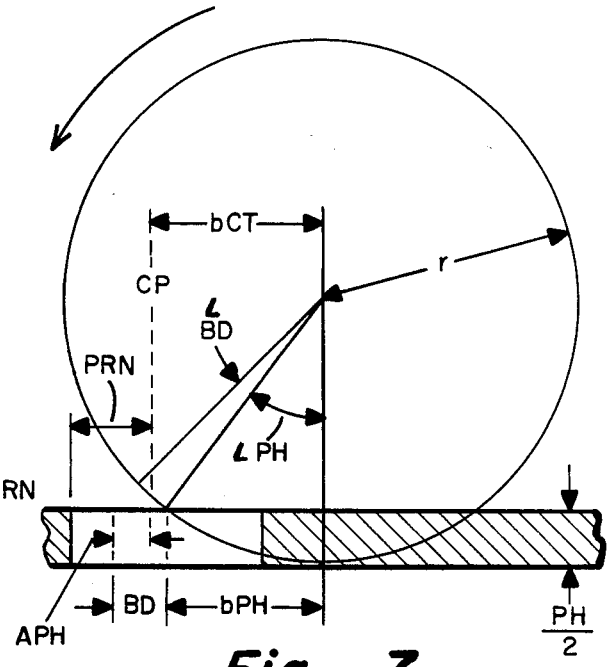
Fig. 7

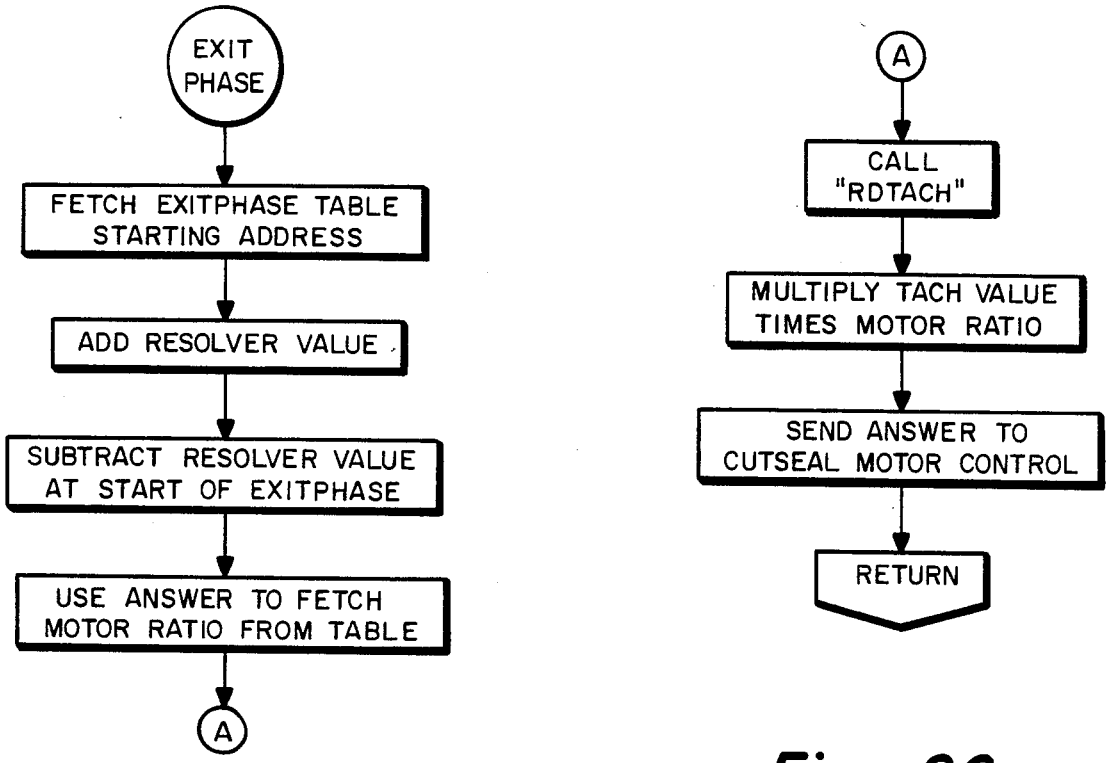
Fig. 26c
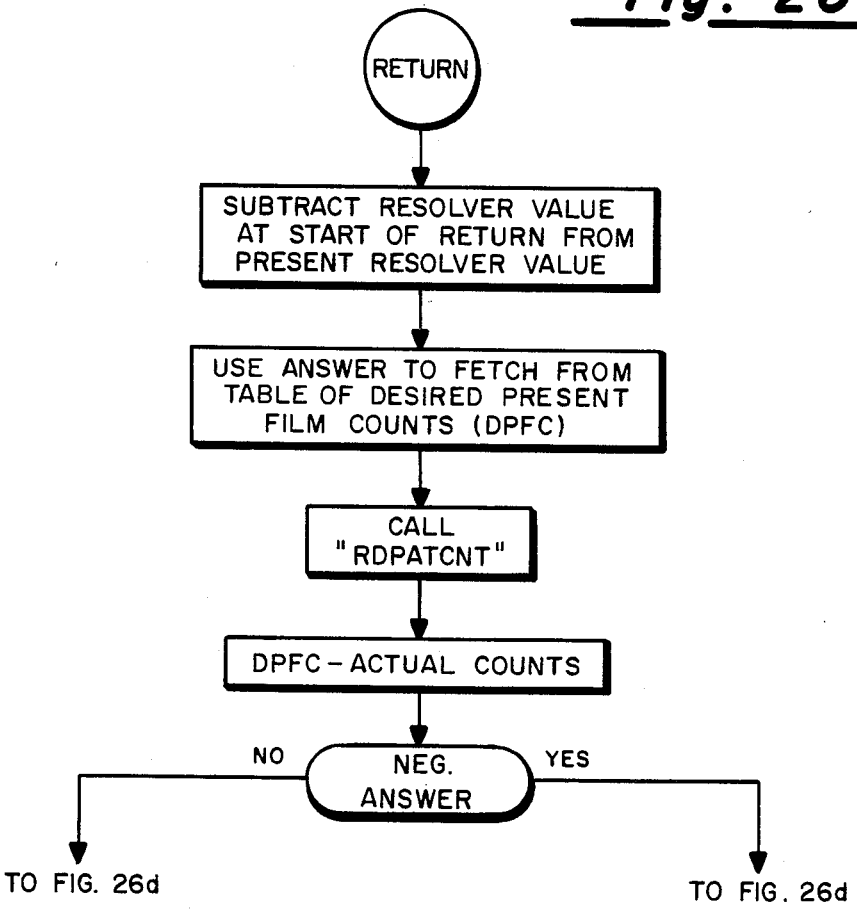

FINWHEEL

RAMP

WRAPPING MACHINE AND METHOD

BACKGROUND OF THE INVENTION

This invention relates generally to wrapping and packaging machines and more particularly concerns a horizontal wrapping machine utilizing a microprocessor-based control system (MBS) and method wherein separate drives and operating temperatures in the wrapping machine are independently servo controlled.

In a horizontal wrapping machine, a continuous film of packaging material is supplied from a roll and drawn past a former which shapes the film into a continuous tube of packaging material. Products to be wrapped are supplied through the former into the tube of packaging material such that the products are spaced apart from one another in the tube. The seam of the tube is longitudinally sealed and the tube of packaging material is then cut and transversely sealed as each product, carried within the tube, passes through a sealing and cutting station. In this way, an individual sealed package is formed about each product.

Typically, the products to be packaged are supplied to the former on an infeed conveyor in the form of an endless chain having a number of product pushers extending from the chain. Each adjacent pair of pushers defines an infeed conveyor flight, and each product is advanced to the former in an individual conveyor flight. As each product is advanced into the film former, it is picked up by the bottom surface of the interior of the now-formed film tube and carried in the tube to the cutting and sealing station.

The film is formed in the former such that the lateral edges of the film, when the tube is formed, extend downwardly from the center of the film tube in a side-by-side relationship. A number of pairs of finwheels rotating about vertical axes in a finwheel assembly engage opposite sides of the downwardly extending pair of film edges to drive the film toward the cutting and sealing station. At least one pair of finwheels in the finwheel assembly may be heated, serving to heat seal the downwardly extending film edges together to seal the tube of heat sealable film. Other so-called cold-seal film do not need heat but instead use the pressure of one or more finwheel assemblies to create the seal.

As the now-enclosed tube of film carrying products which are spaced apart from one another advances past the sealing and cutting station, opposed cut/seal heads, one containing a knife member and the other an anvil, are rotated into engagement with the film tube between each successive pair of products. The cut/seal head may also include heated members so as to seal the film as it is cut to thereby form individual sealed packages, each containing a now-wrapped product.

In the past, a typical horizontal wrapping machine has been driven by a single motor through a single line shaft. In such a wrapping machine, separate gear boxes, belt and pulley, and chain and sprocket drives are coupled to the main shaft and the infeed conveyor, the finwheel assembly, and the cut/seal heads.

There are a number of disadvantages associated with such prior art horizontal wrapping machines which are overcome by the horizontal wrapper disclosed in the present application. For example, in such prior horizontal wrapping machines, in order to change the cut length, i.e., the distance between cuts on the tube of film, it is necessary to make a number of mechanical adjustments to change drive ratios and the like. In the present wrapping machine, a change in cut length may be effected in a short period of time without the necessity of mechanical adjustments by merely entering a number on a keyboard entry device connected to the controlling microprocessor.

Also, in prior horizontal wrappers, different sections of the machine cannot be operated independently of other sections without the use of mechanical clutches. Such independent operation is desirable during servicing of the machine in order to isolate problems in machine operation. In the present horizontal wrapper, different sections of the wrapping machine can be driven separately, again under computer control.

Another problem with prior horizontal wrapping machines is a difficulty in reorienting the phasing of the cut-heads relative to the desired cut locations between the products in the tube of packaging material. In the presently disclosed horizontal wrapping machine, the velocity profile of the cut-heads is automatically adjusted for correct phasing when the package length is changed.

In addition, in prior horizontal wrappers, it has generally not been possible to readily vary the product pusher position relative to the film position in order to correct product registration errors. In the past, it has been necessary to stop the wrapping machine and disengage a mechanical clutch between the main drive and the pusher drive while reorienting the pusher chain relative to the main drive. In the presently disclosed horizontal wrapper, the pusher location relative to the film position is sensed and it is possible to advance or retard the pusher by adjusting the infeed conveyor velocity on a real-time basis. A related problem has been an inability of prior machines to change the product-to-film registration during operation of the machine. It has been necessary to stop the machine and adjust the pusher position relative to the main drive. In the present system, however, the product registration can be changed using operator accessible inputs without stopping the operation of the machine.

In order to obtain the above-mentioned advantages of the presently disclosed horizontal wrapping machine, the present wrapper includes three separate closed loop servo-controlled motor drives for the infeed conveyor, for the finwheel assembly which drives the film, and for the cut-head drive, respectively. Each closed loop servo control circuit includes a motor which is driven by a summing-amplifier. The summing-amplifier receives as a feedback signal the actual motor velocity and receives as a control signal a desired motor velocity. Each servo control circuit is thereby operable to maintain its associated motor at the velocity established by the desired velocity control signal. Each of the servo control circuits forms a part of a microprocessor-based controller which coordinates the motor speeds to effect the desired synchronous operation of the horizontal wrapping machine.

To produce an acceptable packaged product, it is necessary, within selected tolerances, for the package to contain a certain desired length of film and for the product to be at a desired location relative to the length of film, which is formed into a completed package. There is an additional positioning requirement which arises typically due to the provision of printed material on the packaging film. This requirement is that each length of film used to form a package should have thereon the properly-oriented printed matter for the package.

Thus, for example, if the product to be packaged is a candy bar having a length of two and one half inches, it may be desired to package the candy bar in a package having a length of packaging film of four inches. It may further be desired to center the candy bar in the package. The length of film used for the package, four inches, is the cut length of the package. The length of the candy bar, two and one half inches, is designated the product length. Thus, for each four inch cut length of packaging film, it is desired to have a candy bar centrally located therein. This meets the above-mentioned first two requirements of proper centering of the product in the package and of proper package length.

Typically, a candy bar wrapper contains printed matter including the name of the candy bar and its manufacturer, and perhaps a list of ingredients, etc. The name is typically in large letters extending across most of the length of the product. In order for the product name to be properly located on each package, not only must the package length be approximately equal to the desired cut length, but also the positioning of the product and cut relative to the printed matter must be approximately correct so that the product name lies on the product and not across a cut location on the film.

In the usual case, marks called "eyespots" are placed on the film, such as along one of the film edges, to provide a reference for the beginning and end of each cut length. It is therefore desirable that as each such indicated cut length of film moves past the film former that one product be placed in the film tube at the desired location relative to the beginning and the end of the cut length. Where each cut length is defined as beginning at a fixed relationship to an eyespot, the distance along the film tube from the eyespot to the trailing edge of the product is termed the product orientation. Thus, in the above-mentioned example, if the two and one half inch candy bar is to be centered in each package, and each cut is to be on an eyespot, then the desired product orientation is three and one-quarter inches.

Not only must the proper product orientation relative to the marked film be obtained, but the sealing and cutting by the cut/seal heads must also occur between the products. The heads will engage the film at an entered relationship to the film eyespots.

In the horizontal wrapping machine illustrated herein, the master control for each of the servo motors is derived from a master tachometer on the film drive mechanism. In the illustrated machine, a microprocessor-based controller receives the output from the master tachometer which relates to film speed. Based upon this actual film speed, the controller outputs the desired product infeed conveyor speed to the infeed conveyor motor summing-amplifier and outputs the desired cut/-seal speed to the cut/seal head motor summing-amplifier.

To infeed one product per cut length of film, the desired infeed conveyor speed must be set to be a proportion of the actual film speed so that exactly one product is delivered to the film former for each cut length of film which passes the film former. To maintain proper product orientation relative to the film cut lengths, the controller varies the desired velocity signal supplied to the infeed conveyor servo loop to correct for errors in product orientation relative to the film.

The cut/seal heads may be viewed as operating in two modes. During a cut and seal mode, wherein the cut/seal heads are in contact with the film, their film-engaging faces must move at the same rate as the film. During what is termed a return mode, the cut/seal heads are not contacting the film. They must move at a different rate of speed, usually a higher rate, in order to be repositioned for the next cut and seal phase.

The microprocess-based controller supplies a desired cut/seal-head velocity to the cut/seal head servo motor amplifier during a cut cycle to move the film-engaging surfaces at a rate substantially equal to the film speed in the direction of film travel. During a return cycle, the controller supplies a desired velocity signal to the cut/-seal head summing-amplifier, which is derived from the film velocity, such that the cut-heads are in proper position for the next cut cycle.

SUMMARY OF THE INVENTION

In summary, the present horizontal wrapper, having a control arrangement as described, overcomes the above-enumerated disadvantages of prior, mechanically synchronized, horizontal wrapping machines. Since the drive motors for the different sections of the present horizontal wrapper are separately servo controlled, the different sections of the wrapper must be operated independently and may be operated in forward or, in some cases, in reverse. Due to the independent control of the cut/seal head drive, the return velocity of the cut/seal heads may be individually controlled. Likewise, the independent control of the product infeed conveyor motor permits variation of pusher position and product orientation relative to film cut lengths.

There are a number of additional difficulties with prior art horizontal wrapping machnes. The accuracy of such prior art machines is reduced since the total error of the entire gear train in a prior art machine is the sum of the errors of the individual gears. In the presently illustrated system, there is a closed servo loop for each function and therefore no accumulation of errors through the entire machine controller.

In addition, in prior horizontal wrappers, abrupt changes to correct orientation errors are not possible. For example, if the product orientation degrades due to film splicing, the error remains and is corrected only gradually, at best, as packages are produced by the machine. In prior horizontal wrappers, product orientation corrections are made by adjusting the film feed, based upon eyespot measurements on the film. If an attempt is made to adjust the film too rapidly, the film can be torn or broken and product can slip in the film tube. In the present system, the product infeed is adjusted in order to alter the product registration.

In a typical prior horizontal wrapper, it is not easy to add auxiliary functions, such as, for example, a card feeder for placing a paper card beneath each product introduced into the film former, without several additional components to link the auxiliary function drive to the main drive shaft of the machine in proper synchronization. In the present system, synchronous auxiliary devices can be added to the horizontal wrapper using an individual servo control with the synchronization derived electronically from the film travel. In addition, adding auxiliary functions in the present horizontal wrapper does not require resizing a main drive motor, since separate drive motors are used for the different functions.

Also in prior art wrappers, if product orientation is in error, and/or cut/seal head orientation is in error, there can be a collision between the cut/seal heads and the product. In the past, such collisions could not be sensed on real time basis. The system of the present invention prevents such collisions.

In the use of an automatic splicer on a wrapping machine, for example, a new roll of film is spliced onto the end of a previous roll to maintain continuous machine operation. In performing such splicing, the eyespots on the rolls of film generally are not in a correct position, or they may be omitted entirely from the leading or trailing edge of one of the film rolls. The prior horizontal wrappers were unable to quickly adapt to this condition, resulting in orientation errors for several packages which then had to be rejected.

In the present wrapping machine, the controller determines the product orientation relative to the cut length to establish, if possible within the acceptable tolerances, a desired cut point, which may differ from the eyespot location.

In the past, when using film lacking pre-printed eyespots to mark the cut lengths, both the film variator and the amount of epicycle of the cut/seal head had to be adjusted to change the cut length. With the present horizontal wrapper, it is possible to change the cut length with a digital input, and the controller adjusts the cut/seal head velocities as necessary to accommodate the change.

The present horizontal wrapping machine provides a number of additional advantages unavailable in prior art horizontal wrappers. In the present horizontal wrapper, a film travel indicator is utilized to detect film breakage. Further, precisely controlled acceleration and deceleration of the film is possible when film speed is to be changed. For example, if new operator-selected product packaging rate is introduced into the machine controller, a controlled ramp-up of film velocity can be made in order to prevent tearing or breaking of the film. An immediate response when one parameter is varied is not required since there is not a single mechanical linkage connecting the various portions of the machine.

In horizontal wrappers, when heat-sealable packaging film is used, the longitudinal seal is affected by at least one heated pair of finwheels in the finwheel assembly and the transverse seal by heated rotatable cut/seal heads. It is necessary to determine if the heat applied to the film is within a safe operating range. This may be accomplished by monitoring the time-temperature product of the heat applied to the film to see if it is within a safe band. This safe band of time-temperature product is a range of temperatures for a particular film speed at which the heating elements will neither burn the film nor fail to obtain a complete bonding of the film. In the present horizontal wrapper, the film rate is monitored as is the temperature of each heating element. Where the applied temperatures are outside the acceptable range of temperatures for the film speed at which the machine is operated, a warning is given and the packaged products may be rejected.

Summarizing some of the advantages attendant in the wrapping machine comprising the present invention, it affords, as far as improved performance is concerned:

- Higher packaging rate capability for a given amount of cut/seal head epicycle.
- A continuous match of film speed with the intersecting faces of the cut/seal head in the seal zone.
- Improved cut and product placement accuracy due to the correction capabilities of the cutting/sealing head and infeed drive motors.
- Reduced product slippage in the film tube because abrupt film speed changes are eliminated.
- More rapid recovery from mis-positioned eyespot following splice.
- Reduced film breakage due to control of film tension by the use of automatic tensioning power feed roll.

In addition to the above improved performance advantages, the present invention leads to significant improvements in operation as contrasted with prior art electro-mechanical horizontal wrapping machines. Specifically, in the present invention, because the operator inputs for wrapper speed, temperature, package length, and cut position are all digital quantities, greater accuracy and repeatability can be achieved. Such accuracy was difficult, if not impossible, to achieve in prior art wrapping machines which used potentiometer settings and the like to effect a fine-tuning of these parameters.

In addition, the present invention provides increased information to the machine operator. As will be explained, a digital display on the control panel is used to present various error messages, temperature set points, wrapper speed, mode of operation, cut-length, etc. Furthermore, the control panel used with the present invention permits quick and easy inputting of the initial set-up parameters for each product. The operator is presented with "prompts" which are easy to understand and follow when performing these functions.

With the present invention, wrapper speed and temperature set points can be changed while the wrapper is running simply by entering new data values from the operator's keyboard. Product placement position and cut position can be incrementally advanced or retarded in small increments merely by depressing appropriate keys on the control panel.

Still further features and advantages attendent in the present invention are that the changeover time of a machine for packaging different products is reduced because the new information for various products is either selected from a pre-loaded memory or is entered from a keyboard. Those would be the only steps necessary, provided the film former and the infeed flight length do not require change.

Overall, the microprocessor controller of the present invention permits a great deal of flexibility in the operation and contol of the wrapper system. This is due to the fact that changes in operating mode can be accomplished merely by replacing printed circuit cards in a cardrack rather than undertaking to do significant mechanical readjustments and alignments. Furthermore, the conventional belts, chains, sprockets, bearings, etc. associated with prior art systems are significantly reduced using the teachings of this invention, thus simplifying maintenance and repair. The microprocessor controller also is preprogrammed with diagnostic routines which become available to the repair technician, via the control panel, to permit more rapid location of failed components, should they occur.

Other objects and advantages of the invention, and the manner of their implementation, will become apparent upon reading the following detailed description and upon reference to the drawings, in which:

DESCRIPTION OF THE DRAWINGS

FIGS. 5a–5c is a series of illustrations of a cut-head of the machine of FIG. 1 and a sealed and unsealed package produced by the machine, showing certain geometrical relationships;

FIG. 6 is an illustration of the angular length of the phases of a one-up cut-head in the machine of FIG. 1;

FIG. 7 is an illustration of a portion of a phase of a one-up cut-head in the machine of FIG. 1 showing certain geometrical relationships;

DESCRIPTION OF THE PREFERRED EMBODIMENT

Figure 1:
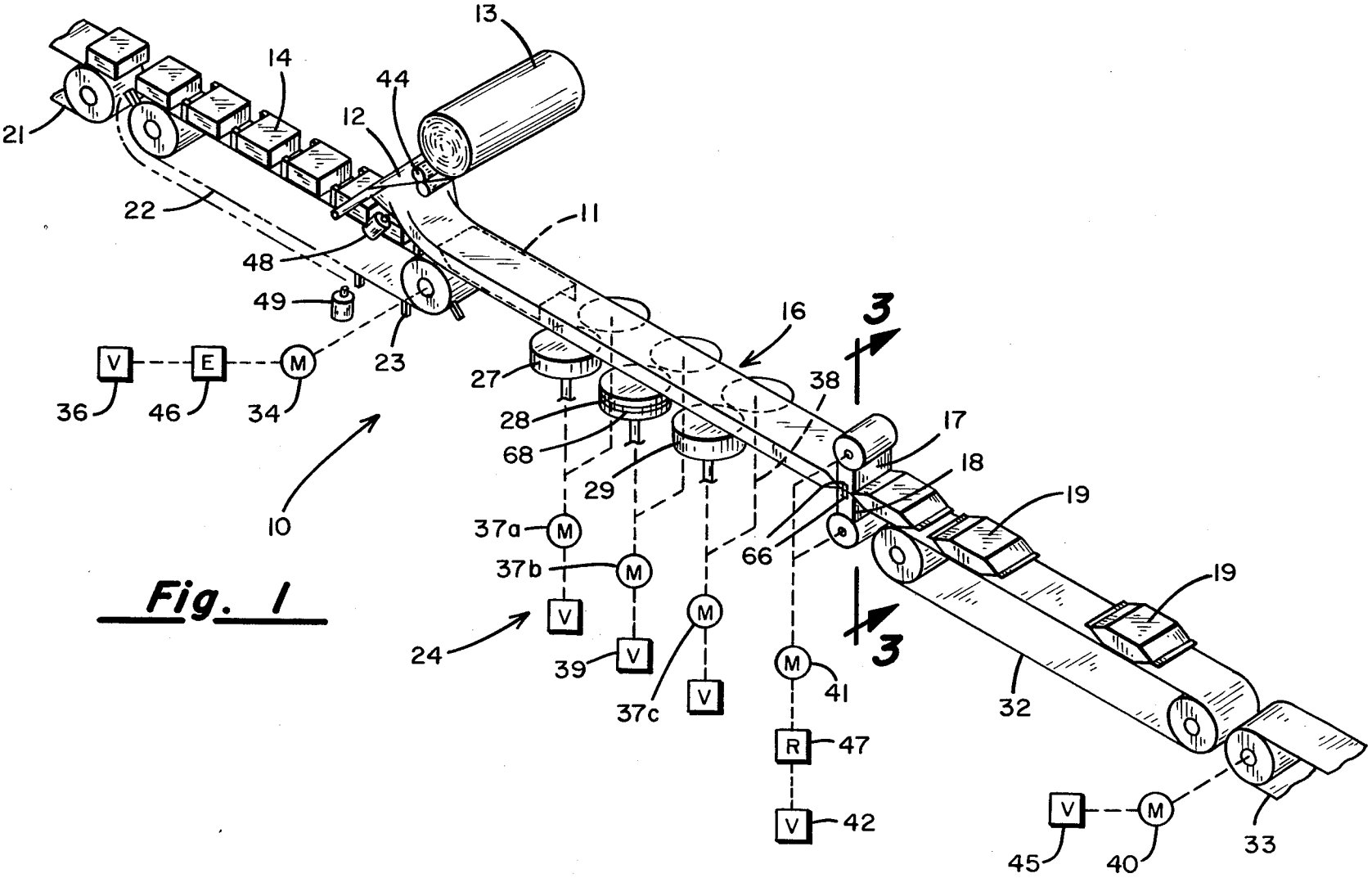
FIG. 1 is a diagrammatic perspective view of a horizontal wrapping machine in accordance with the present invention.
Figure 4:
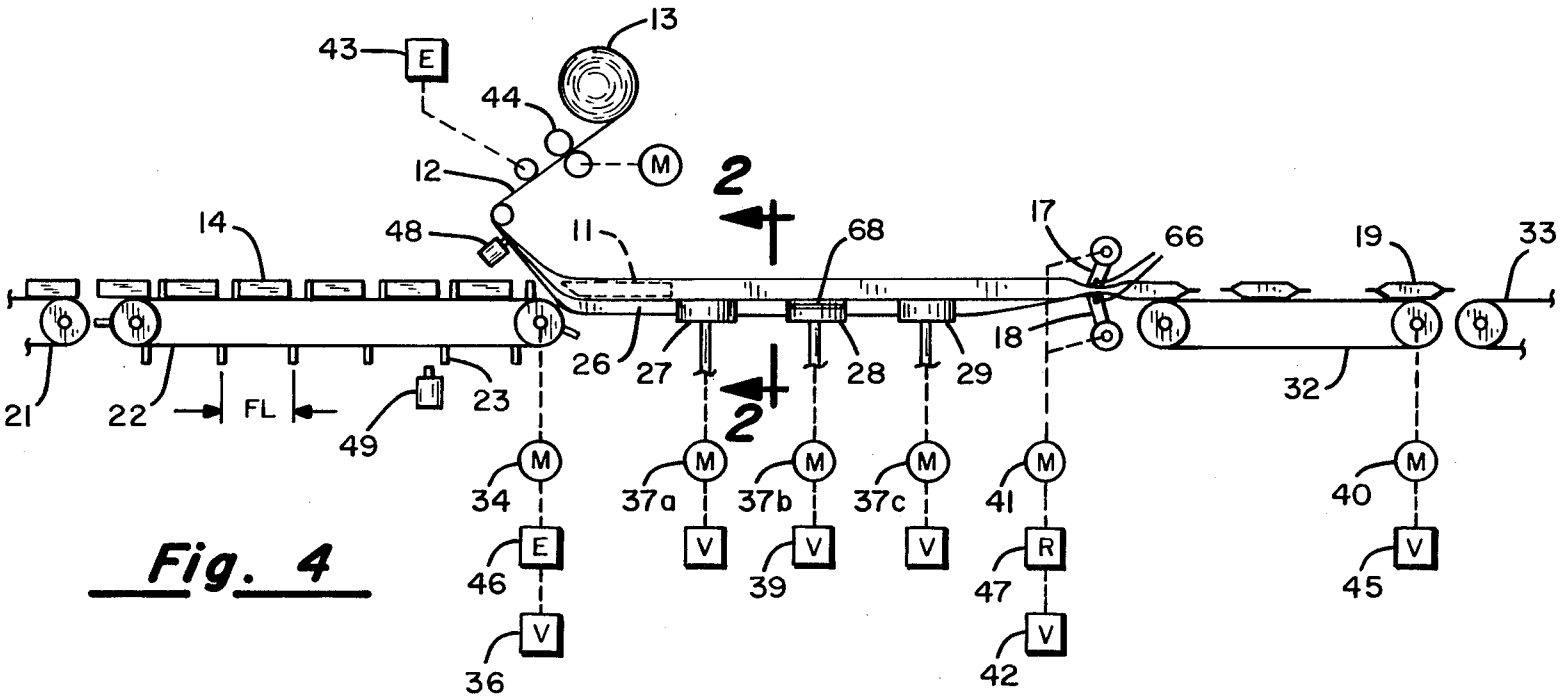
FIG. 4 is a diagrammatic side view of the horizontal wrapping machine of FIG. 1.
Figure 3:
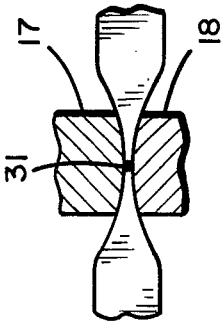
FIG. 3 is an enlarged side view of a portion of the machine of FIG. 1.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

Referring now to the figures, and in particular to FIGS. 1–4 initially, a horizontal wrapping machine 10 includes a former 11 for shaping a continuous film 12 of packaging material which is drawn past the former 11 from a roll of sheet film 13, which may be printed or unprinted. Products 14 to be wrapped are fed into the former 11 and carried within the packaging film tube 16 formed by the former 11. The products 14 are carried within the tube 16 spaced apart from one another past a sealing and cutting station at which a pair of opposed sealing and cutting heads 17, 18 cut and seal the film tube as each product moves past the cutting and sealing station to form discrete sealed product packages 19.

In order to supply the products 14 to the film former 11, the products are received from a suitable supply source conveyor 21 on an endless conveyor 22 termed the infeed conveyor and which is divided into a series of flights by a number of product pushers 23. Each product 14 is carried in a flight on the conveyor with its trailing end resting against a pusher 23.

Figure 2:
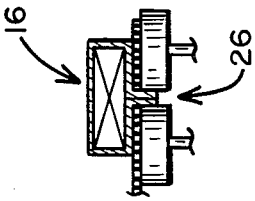
FIG. 2 is a cross-sectional view of the machine of FIG. 1 taken along the line 2—2 in FIG. 4.

The products 14 are introduced into the interior of the tube 16 of film formed by the former 11 by advancing the products 14 into the former. Each product is then received on, and carried along by, the interior bottom surface of the film tube 16. The film tube 16 is shown as being formed into a generally rectangular shape, having its two edge portions formed into downwardly extending strips 26 (FIG. 2). The film is driven by a suitable drive arrangement such as a finwheel drive or a band sealer. In the present instance, separate motor-driven finwheel assemblies advance the film tube 16 toward the cut/seal head 17, 18 by gripping the downwardly extending adjacent pair of film (edges) 26. To do this, the finwheel area 24 includes three pairs of opposed finwheels 27, 28 and 29. Each finwheel in each pair of finwheels rotates in an opposite direction, firmly gripping the film (edges) 26 therebetween, moving the film tube 16 toward the cut-heads 17, 18. The middle pair of finwheels 28 may be heated to seal the edges of film 26 together to close the film tube 16.

The now-sealed tube 16 containing the spaced apart products 14 is advanced by the finwheels past the cut/seal head 17, 18. The cut/seal heads are rotated in opposite angular directions to meet and engage the film tube 16 after each product moves past the cutting and sealing station. The cut/seal heads, when in engagement with the film tube 16, must move at substantially the same linear rate as the film and coact to compress the film tube together into a flattened condition.

Each of the cut/seal heads 17, 18 may be heated and the compressed film tube is sealed as it is cut, thereby enclosing each product in an enclosed, sealed package. In order to cut the sealed film to produce discrete packages, the upper head 17 contains a knife blade 31 extending from its film-engaging surface. The lower cut/head 18 contains an anvil 18. The knife and anvil coact to cut the film as it is sealed (FIG. 3), all as is well known in the art.

The packages 19 are carried from the cutting and sealing station by a discharge conveyor 32, which operates at a higher rate than the rate of travel of the film tube 16. The products 19 are then discharged onto a suitable receiving apparatus 33.

In order to drive the infeed conveyor 22, a motor 34 is coupled to a drive shaft of the conveyor (not shown). As shall be described in more detail hereinafter, the motor 34 is driven under closed-loop servo control. The infeed conveyor's "actual velocity" feedback signal used in the servo loop is provided by a tachometer 36 on the motor 34.

The finwheel assemblies 27, 28 and 29 are likewise driven by motors 37(*a*), 37(*b*) and 37(*c*) which are under closed loop servo control. As in the case of the infeed motor, the finwheel motors 37(*a*)–37(*c*) have an associated tachometer 39 for providing an "actual velocity" feedback signal for the finwheel motor servo loop.

The cut/seal heads 17, 18 are each driven in unison by a single motor 41, which is also operated under closed loop servo control. The motor 41 has an associated velocity-sensing tachometer 42 for providing the actual cut/seal head velocity feedback signal for the servo loop.

The discharge conveyor 32 is driven by a motor 40, operated under closed loop servo control. The discharge conveyor motor 40 has an associated tachometer 45 for providing the actual discharge conveyor velocity feedback signal for the servo loop.

In the illustrated horizontal wrapping machine, the infeed conveyor speed, and hence the product feed rate into the film former and film tube 16, is controlled to be dependent upon the film speed as it moves past the former and past the cutting and sealing station. In like manner, the cut-head velocities, for each of the cut-head phases (the dive phase, the cut phase, the exit phase and the return phase), are dependent upon the film velocity.

Since there may be slippage between the finwheels and the film, the film travel is not measured at the finwheel drive. Instead, an encoder 43 rides directly upon the film as it passes around a rubber idler roller upon leaving the roll 13. The movement of the film and the production of encoder pulses by the encoder 43 are directly related to the film travel over the idler roller.

In order to measure the infeed conveyor travel, an encoder 46 is coupled to the drive shaft of the infeed motor 34. The angular position of the cut/seal heads is derived from the output of a resolver 47 mounted on the drive shaft of the cut-head motor 41.

As noted earlier, it is important to obtain the proper orientation of each product 14 relative to a cut length of film, which is the amount of film used in each package 19. It is also important to seal and cut the tube of film 16 with the cut/seal heads 17, 18 at the proper cut point between the products in the film tube. The film cut lengths are defined by eyespots on the film 12 when it is necessary to maintain registration between the product and its wrapper. The spacing between the eyespots defines the cut lengths of the film. These eyespots are sensed by a sensor 48 to provide film position information to the control system for the horizontal wrapping machine.

A second sensor, an infeed conveyor pusher sensor 49, provides the control system with infeed pusher position information. As shall be described, the film and product conveyor position information permits the positioning of the products 14 in the proper orientation relative to the cut lengths of film and also permits the timely operation of the cut/seal heads 17, 18 to seal and cut the film tube 16 at the proper cut points to form the product packages.

Figure 8:
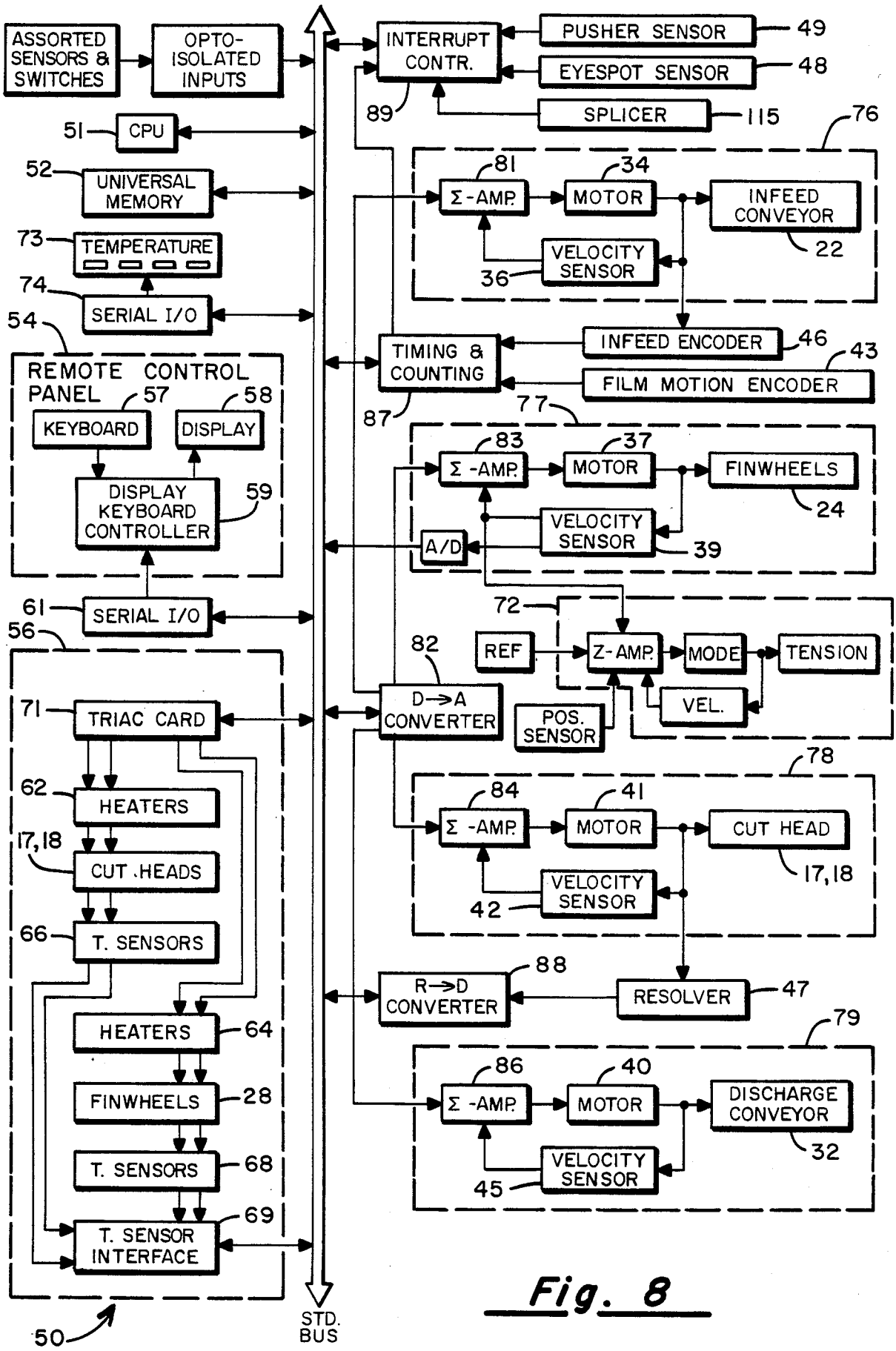
FIG. 8 is a hardware block diagram of the controller for the machine of FIG. 1.
Figure 9:
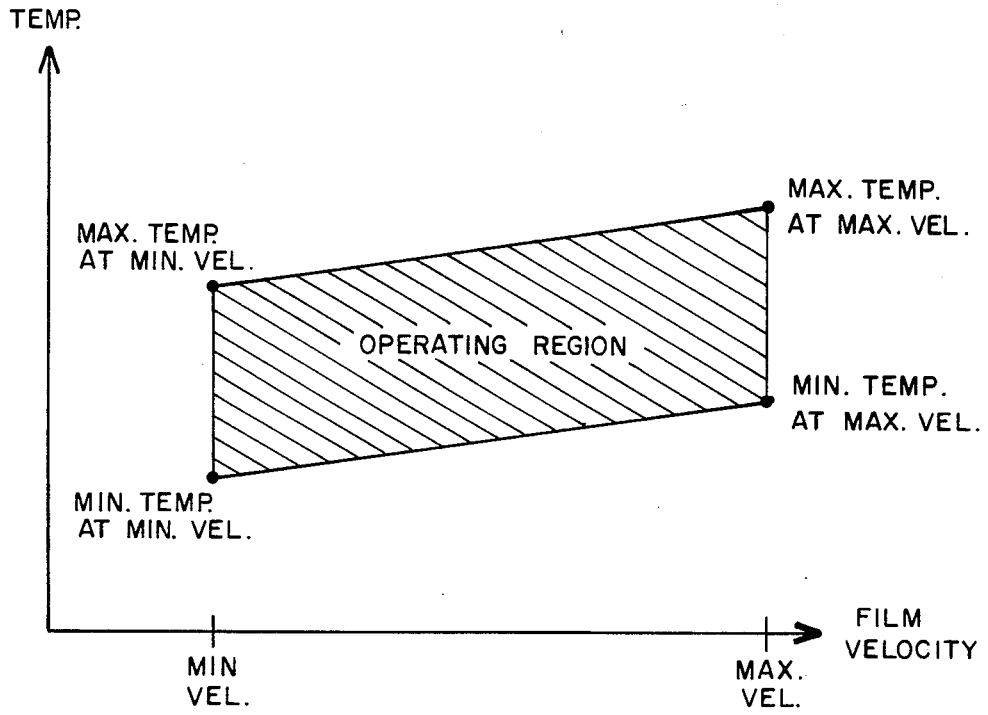
FIG. 9 is a diagrammatic illustration of the temperature-film velocity operating region for the heated sealing elements of the machine of FIG. 1.

With reference now to FIG. 8, the controller for the horizontal wrapping machine 10 is illustrated, in conjunction with certain of the controlled elements of the machine. The controller, indicated generally by numeral 50 is a microprocessor-based controller (MBC) including a central processing unit (CPU) 51 and a universal memory 52 coupled to a common bus 53.

The controller 50 includes an operator interface section 54 and a temperature control section 56. The operator interface section 54 includes a keyboard entry device 57 and an alpha/numeric display device 58 coupled through a display and keyboard control circuit 59 and a serial input/output circuit 61 to the system bus 53. A processor associated with the remote control panel 54 is operable to provide display prompts to the machine operator on the display 58 so that the operator can input desired machine operating parameters to the processor through the keyboard.

The temperature control section 56 includes circuitry for providing closed loop control of the heaters on the upper and lower cut/seal heads 17, 18 and the finwheels 28. The cut/seal heads and finwheels each contain heaters 62, 64 (not shown in FIG. 1), respectively. In addition, the cut-heads and finwheels carry temperature sensors 66 and 68, respectively.

The outputs of the temperature sensors 66, 68 are coupled through a temperature sensor interface circuit 69 to the bus 53. The processor 51 provides heater activation signals to the heaters 62, 64 by way of the bus 53 through a triac output circuit 71. The heater activation signals are based upon the temperatures of the cut/seal heads and finwheels as provided by the temperature sensors 66, 68.

The temperatures of the cut/seal heads and finwheels are presented by the processor 51 to a temperature display 73 through a serial I/O circuit 74 which is coupled to the bus 53.

The microprocesor-based controller 50 further includes an infeed conveyor motor servo control circuit 76, three finwheel motor servo controls (only one of which is identified as 77), film tension motor control 72, a cut/seal head motor servo control 78 and a discharge conveyor motor servo control 79. The infeed control 76 includes a summing-amplifier 81 which receives a desired infeed velocity signal from the processor 51, via the bus 53 and a digital-to-analog converter 82. As previously described, the feedback loop from the motor to the summing-amplifier is completed by a velocity sensor (tachometer)36 which provides an actual infeed velocity signal to the summing-amplifier 81. Similarly, one of the finwheel servo circuits 77 includes a summing-amplifier 83 which receives a desired finwheel velocity signal from the processor via the digital-to-analog converter 82. The feedback loop is completed by a tachometer 39 which couples the finwheel motor speed to the summing-amplifier 83. The other two finwheel motor controls use current feedback as a means of controlling their respective motors.

The cut/seal head motor servo control circuit 78 includes a summing-amplifier 84, which receives a desired velocity signal from the processor via the digital-to-analog converter 82. The cut/seal head servo loop is completed by the tachometer 42 which is coupled to the summing-amplifier 84.

The discharge conveyor servo 79 includes a summing-amplifier 86, which receives a desired discharge conveyor motor velocity signal from the processor 51 by way of the digital-to-analog converter 82. The discharge conveyor servo loop is completed by the tachometer 45 which is coupled from the discharge conveyor motor output to the summing-amplifier 86.

The infeed encoder 46 indicative of infeed conveyor travel is coupled through a timing and counting circuit 87 and the bus 53 to the processor 51. The film motion encoder 43 indicative of film travel is also coupled through the timing and counting circuit 87 to the processor 51. The cut/seal head position sensor, i.e., the resolver 47, is coupled to the processor through a resolver-to-digital converter 88 via the bus 53.

The eyespot sensor 48 for detecting eyespots on the film 12 is coupled to an interrupt controller circuit 89 as is the pusher sensor 49 which senses the pushers on the infeed conveyor. The interrupt control circuit 89 also receives a signal from a film splice eye 115. The interrupt control circuit 89 produces hardware interrupt signals to the processor via the bus 53 when the eyespot sensor senses an eyespot on the film, when the pusher sensor 49 senses a pusher on the infeed conveyor at the pusher sensor location, and when the splicer eye 15 senses an eyespot.

Interrupt routines are initiated based upon a counter in the circuit 87 coupled to the film motion encoder 43.

Another interrupt routine is initiated based upon a 1 ms. timer in the CPU 51.

The primary function for the controller 50 in the operation of the horizontal wrapping machine 10 is to maintain proper product/film flow. The control problem may be considered to be two distinct subproblems. The first is to cause each product to be oriented properly with respect to the eyespots on the film (product orientation). The second subproblem is to cause each cut to be oriented properly with respect to the eyespots (cut orientation). The plural motors, i.e., the infeed, tension, finwheel and cut/seal head motors, must be synchronized in order to provide these two necessary orientations to properly package a product. Film travel is used as the master input to control the synchronization of the product infeed and the cut/seal head movement.

With reference to FIGS. 5*b* and 5*c*, which illustrate a sealed and unsealed packaged product, respectively, the cut length, the length of film for each package, is designated CL. For proper packaging, one product 14 must be supplied from the infeed conveyor for each cut length of film passing past the former. In the present desription, each cut length CL is defined as extending from one eyespot to an adjacent eyespot on the film. Other film registrations are possible, such as the case in which each cut length begins at the midpoints between eyespots. Film registrations other than that discussed herein (eyespot to eyespot) may be readily accommodated by utilizing an appropriate offset term for the location of the cut lengths relative to the eyespots. In the absence of eyespots, the processor sets each cut length equal to an operator-entered value.

Now that the general organization of the hardware components have been explained, consideration will next be given to the software organization and an explanation is given as to how a microprocessor, when executing the software, produces the necessary control data for governing the functioning of the hardware components comprising the high-speed wrapper.

SOFTWARE ORGANIZATION

Being a microprocessor controlled system, practically all functions performed by the machine are carried out by the microprocessor's execution of a program of computer instructions. What follows is an explanation of the various routines and subroutines executed by the system in carrying out the overall control functions. Because the detailed machine coding would vary, depending upon the particular microprocessor employed, it is deemed unnecessary to present such machine coding herein. Instead, detailed flow charts of the main routines and all subroutines are set out in the drawings and an explanation thereof will be given. Persons skilled in the art having the flow charts and explanation would be in a position to write machine code for a microprocessor whereby the various control functions can be accomplished.

From the standpoint of organization, the software can be considered as comprising six main routines:

1. NORUN—FIGS. 11(*a*)–11(*d*)
2. NORMRUN—FIGS. 12(*a*)–12(*c*)
3. SYNCNORUN—FIGS. 13(*a*)–13(*c*)
4. EMERGENCY—FIGS. 14(*a*)–14(*b*)
5. INTERRUPTS—FIGS. 37–41
6. CONTROL PANEL—FIG. 42

Each of the above main routines incorporates a plurality of subroutines. Set forth below under each of the main routines is a designation of the particular subroutines used in that main routine.

Figure 15A:
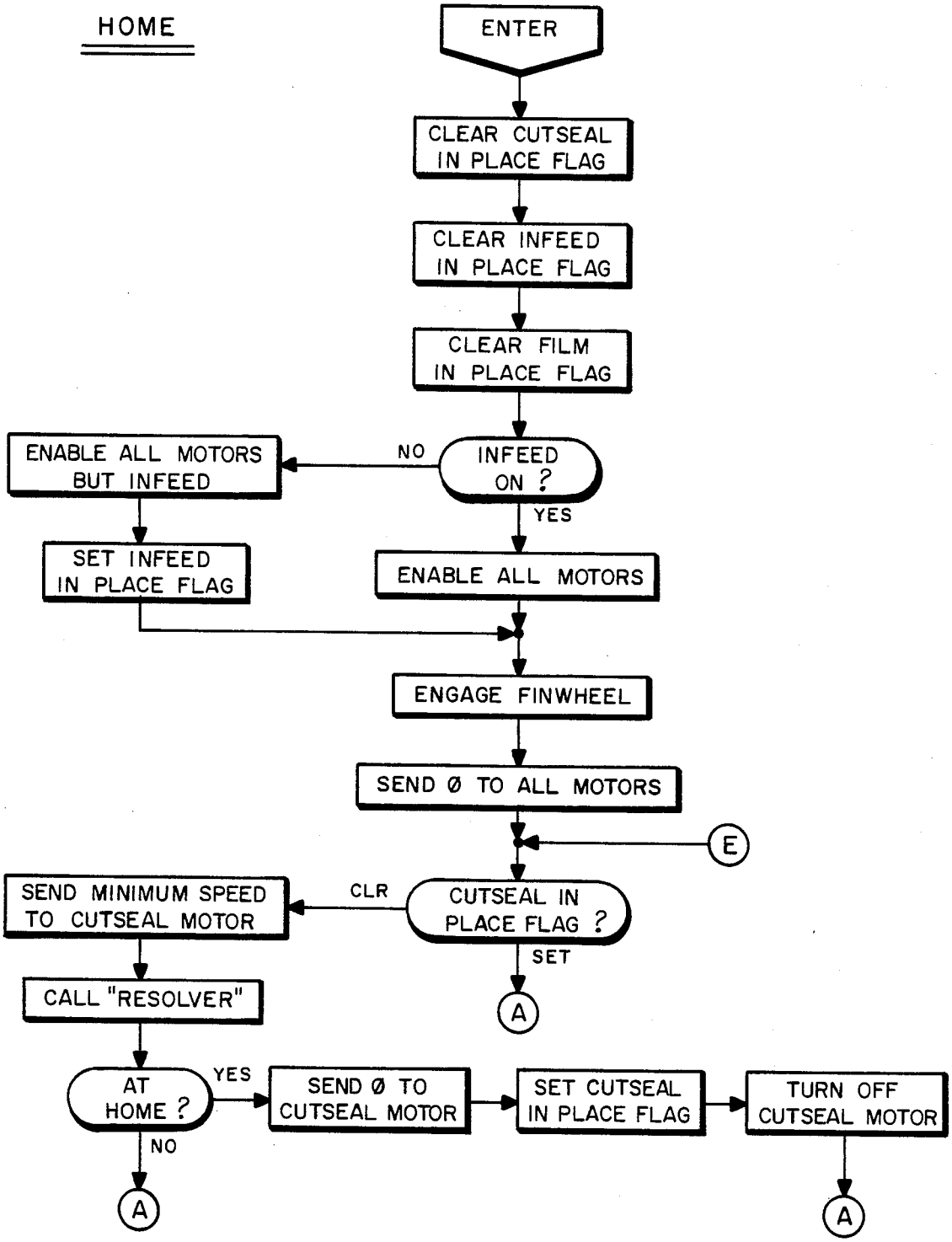
FIGS. 15(*a*) through 15(*c*) together comprise a software chart of the subroutine termed "HOME"
Figure 15B:
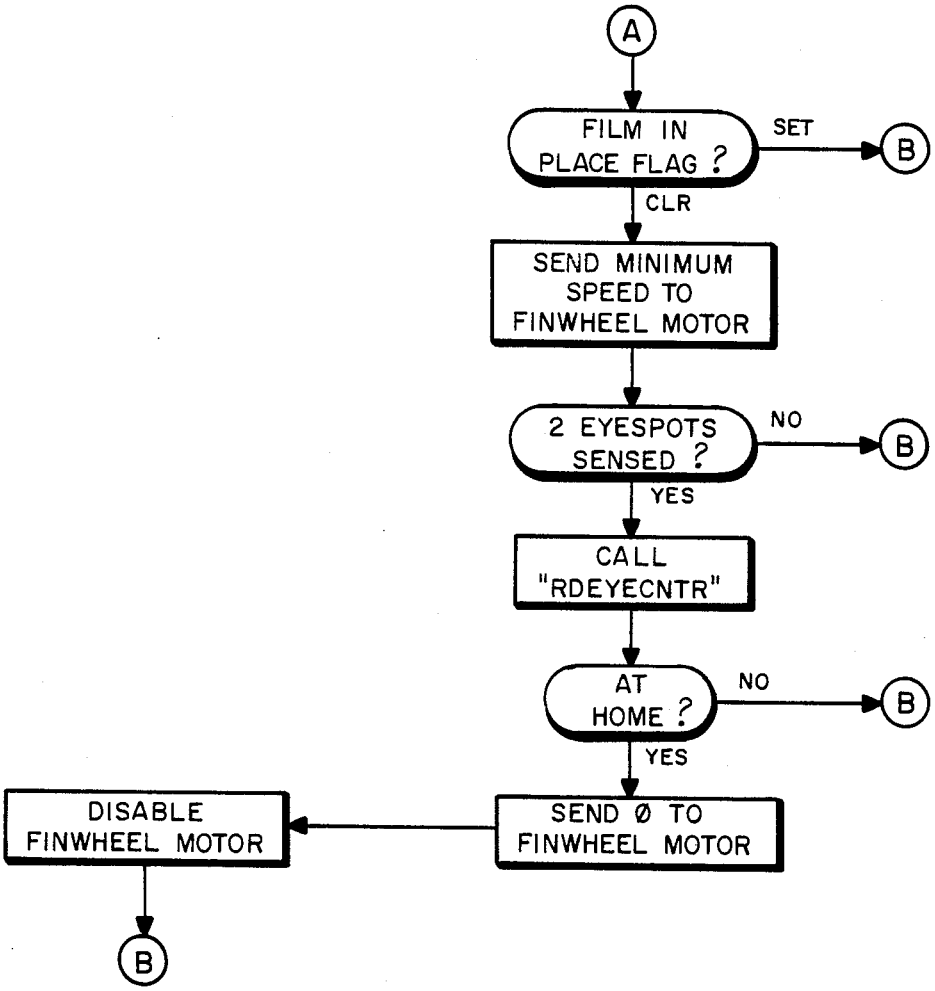
Figure 15C:
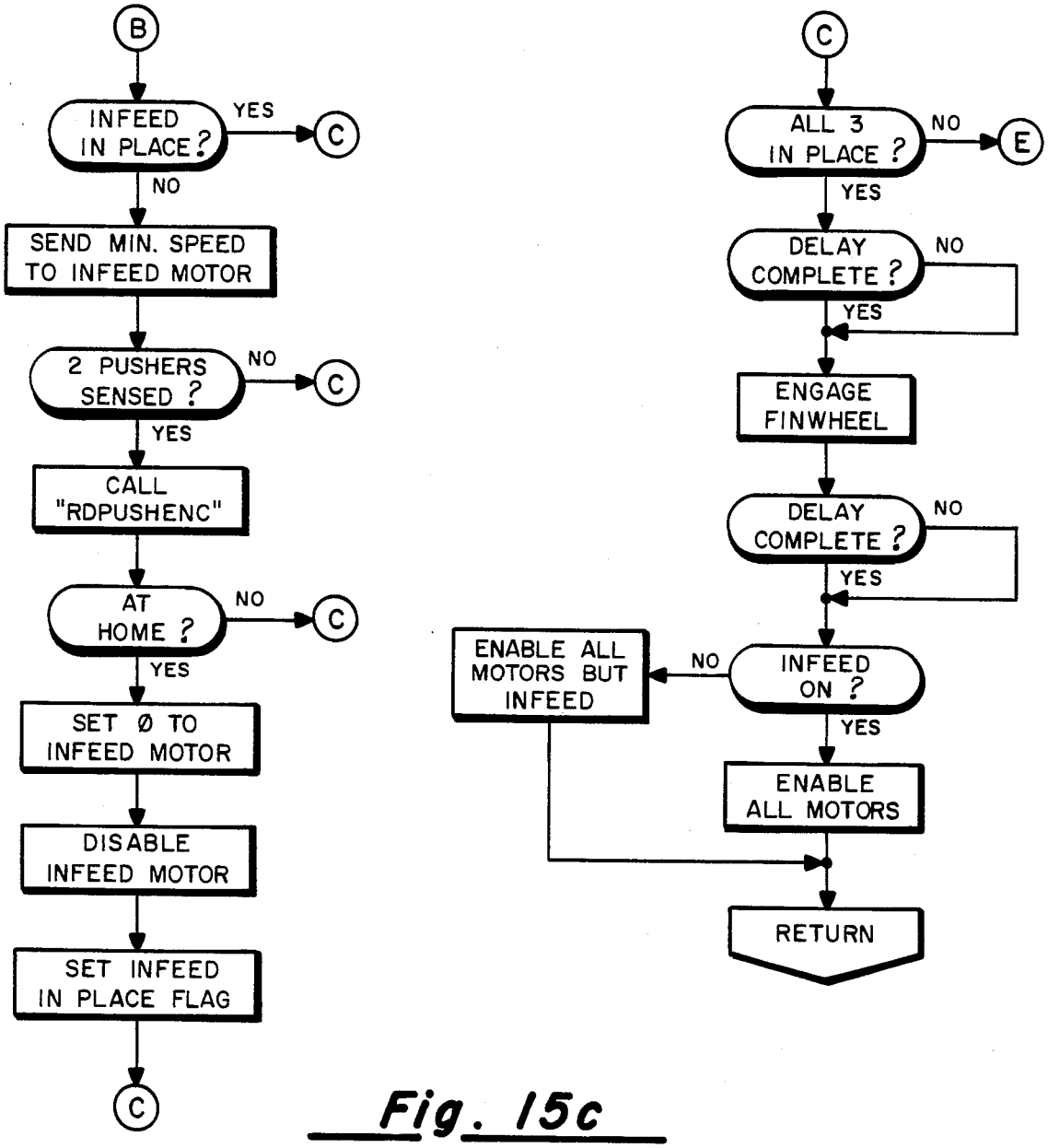
Figure 16:
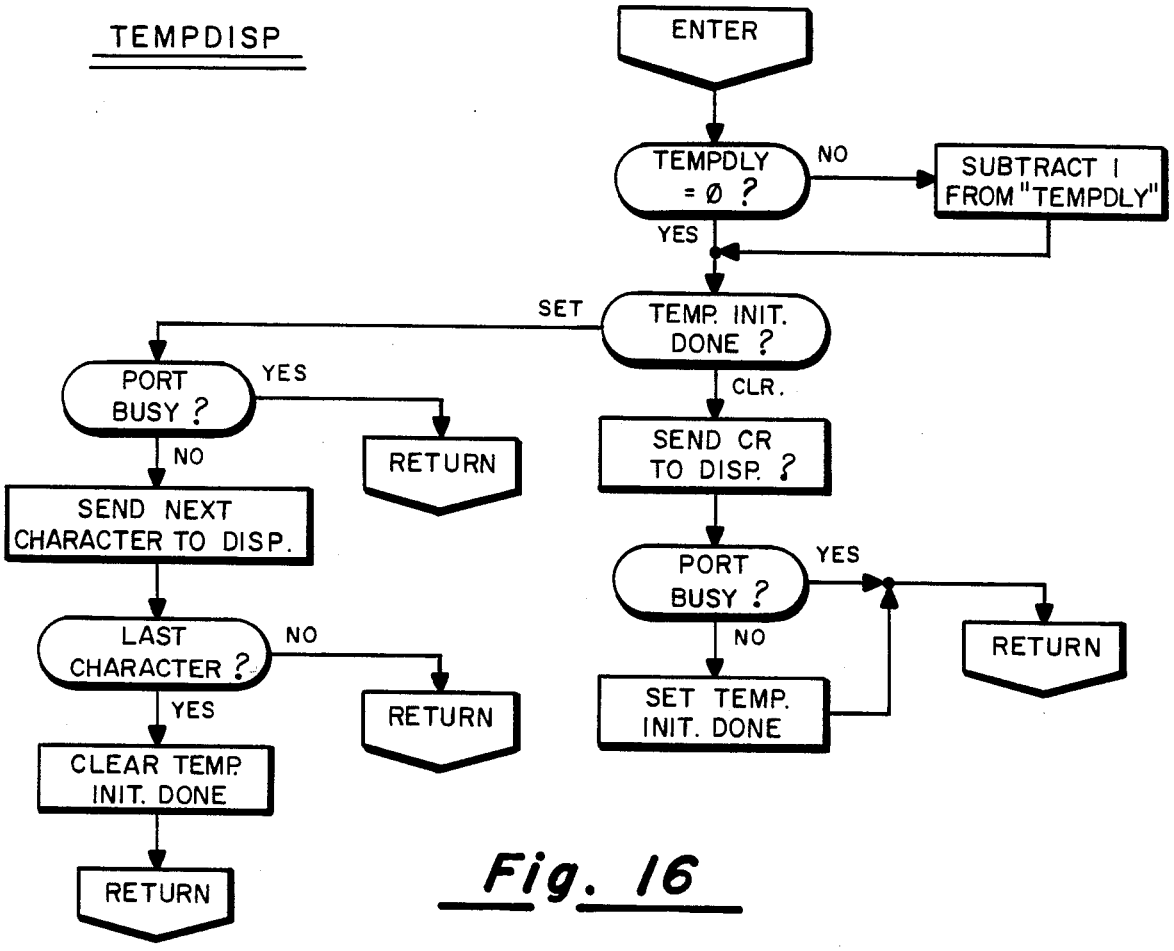
FIGS. 16 through 25 are flow charts of various subroutines callable during the execution of the "NORUN" main routine.
Figure 29A:
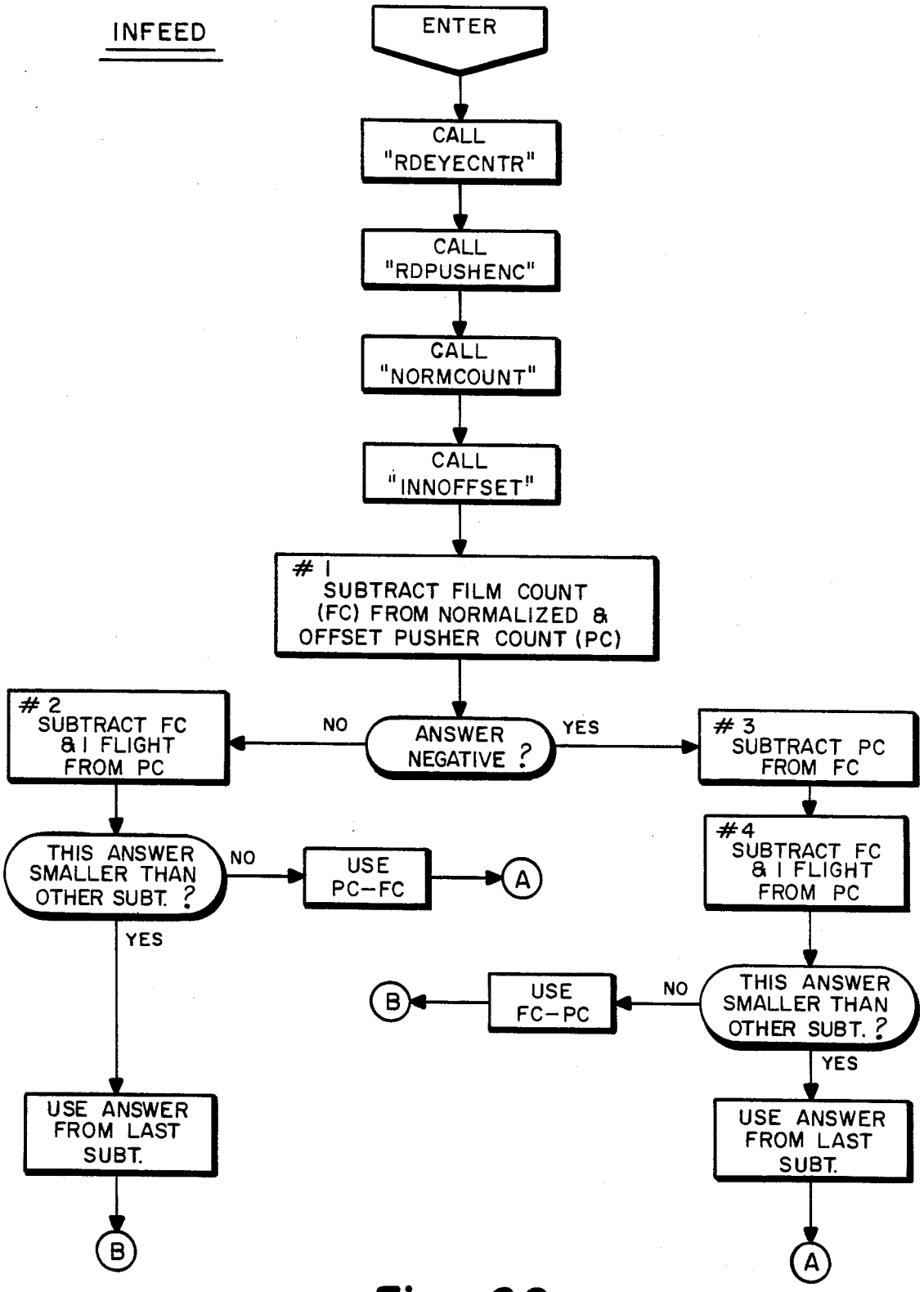
Figure 29B:
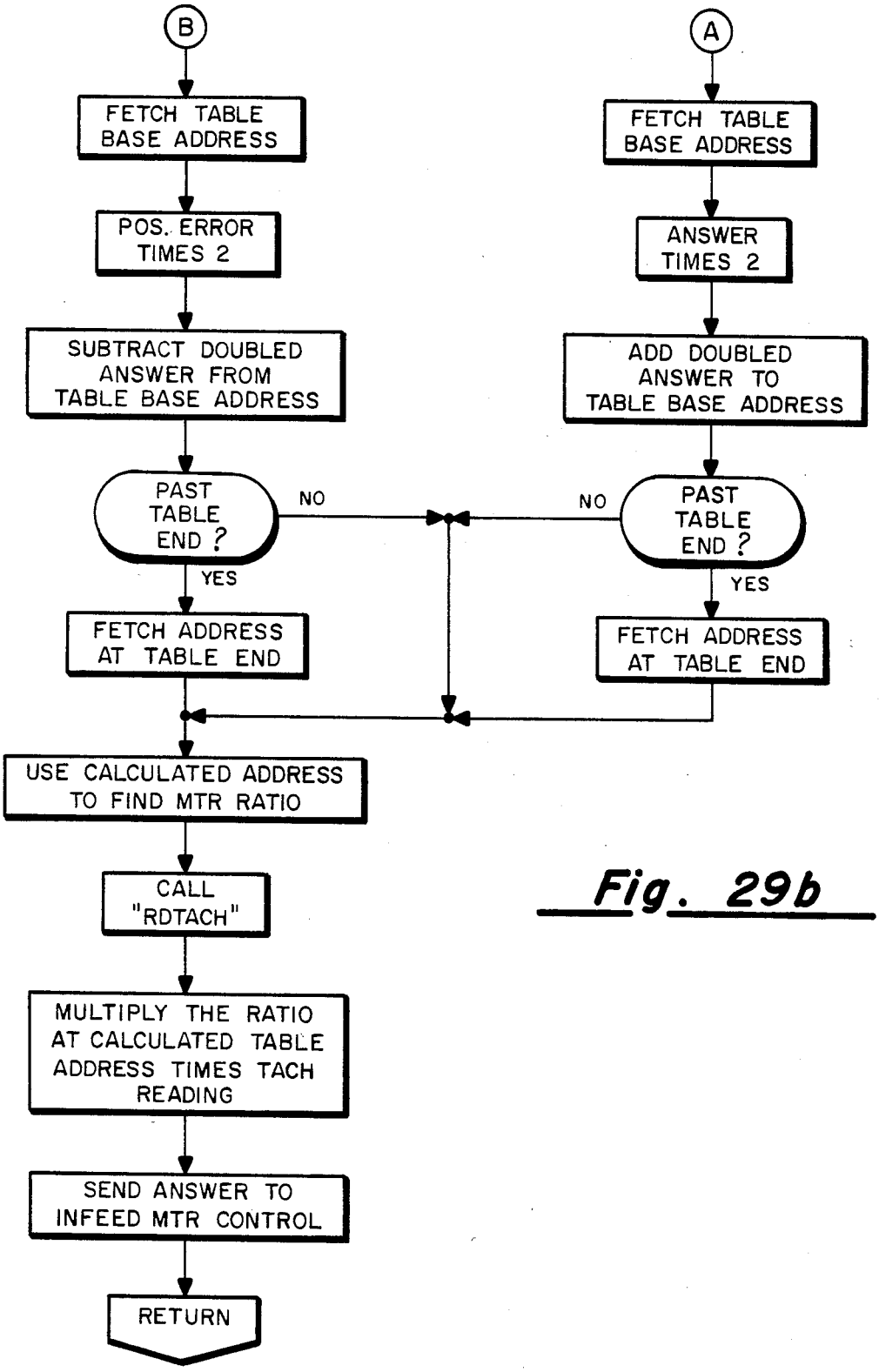
Figure 30:
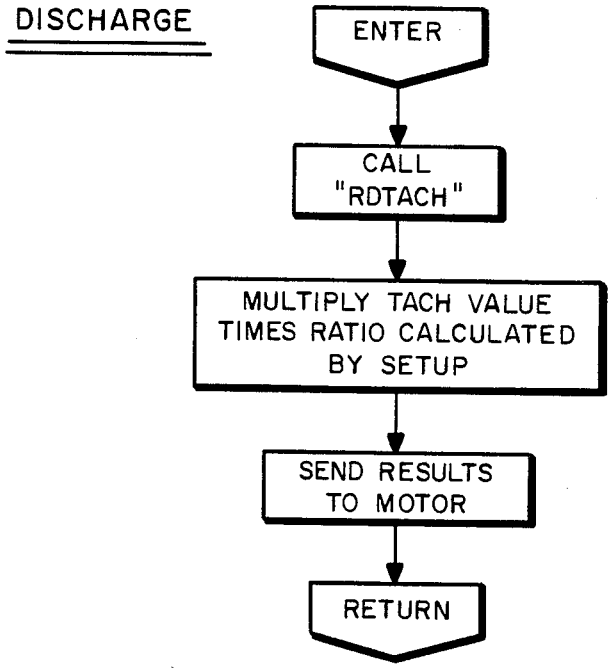

| | | | |
|---|---|---|---|
| 1. NORUN | | | |
| HOME | FIGS. 15(a)–15(c) | RESPLICE | FIG. 21 |
| TEMPDISP | FIG. 16 | INFONOFF | FIG. 22 |
| SPEED | FIG. 17 | JOGFIN | FIGS. 23(a) & 23(b) |
| ACTIVEINFO | FIG. 18 | JOGCUT | FIG. 24 |
| ERRMSG | FIG. 19 | JOGWRAPPER | FIG. 25 |
| TSETPT | FIG. 20 | | |
| 2. NORMRUN | | | |
| CUTSEAL | FIGS. 26(a)–26(d) | RETCUTPOS | FIG. 34 |
| FINWHEEL | FIG. 27 | SYNCSTOP | FIG. 35 |
| RAMP | FIG. 28 | TEMPDISP | FIG. 16 |
| INFEED | FIGS. 29(a)–29(b) | SPEED | FIG. 17 |
| DISCHARGE | FIG. 30 | ACTIVEINFO | FIG. 18 |
| ADVPRODPOS | FIG. 31 | ERRMSG | FIG. 19 |
| RETPRODPOS | FIG. 32 | TSETPT | FIG. 20 |
| ADVCUTPOS | FIG. 33 | RESPLICE | FIG. 21 |
| 3. SYNCNORUN | | | |
| SYNCSTART | FIG. 36 | RESPLICE | FIG. 21 |
| TEMPDISP | FIG. 16 | INFONOFF | FIG. 22 |
| SPEED | FIG. 17 | JOGFIN | FIGS. 23(a) & 23(b) |
| ACTIVEINFO | FIG. 18 | JOGCUT | FIG. 24 |
| ERRMSG | FIG. 19 | JOGWRAPPER | FIG. 25 |
| TSETPT | FIG. 20 | | |
| 4. EMERGENCY | | | |
| TEMPDISP | FIG. 16 | TSETPT | FIG. 20 |
| SPEED | FIG. 17 | RESPLICE | FIG. 21 |
| ACTIVEINFO | FIG. 18 | INFONOFF | FIG. 22 |
| ERRMSG | FIG. 19 | | |

-continued

Figure 44A:
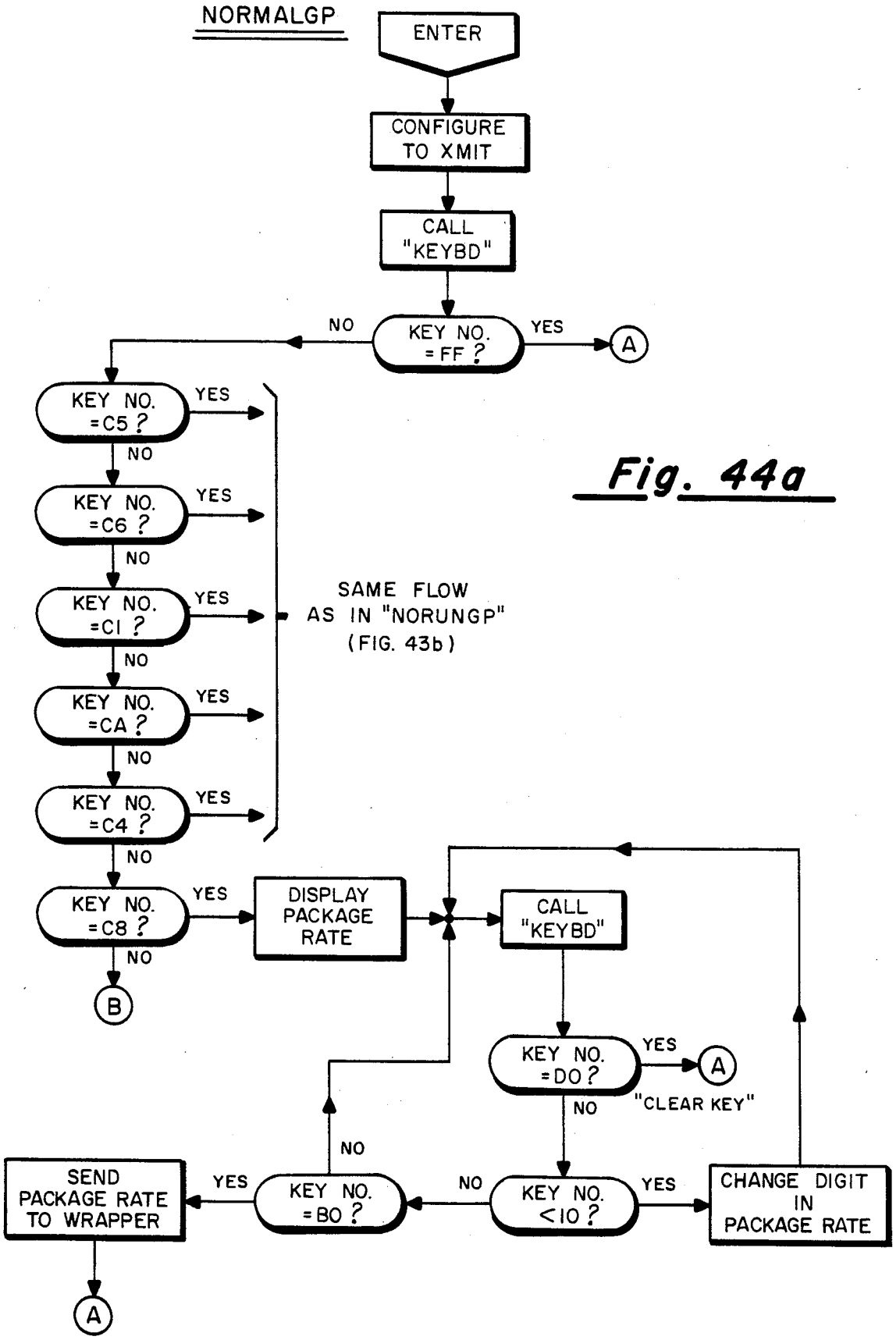
FIGS. 44(*a*) through 44(*b*) illustrate the NORMALGP subroutine used in the main routine of FIG. 42.
Figure 45:
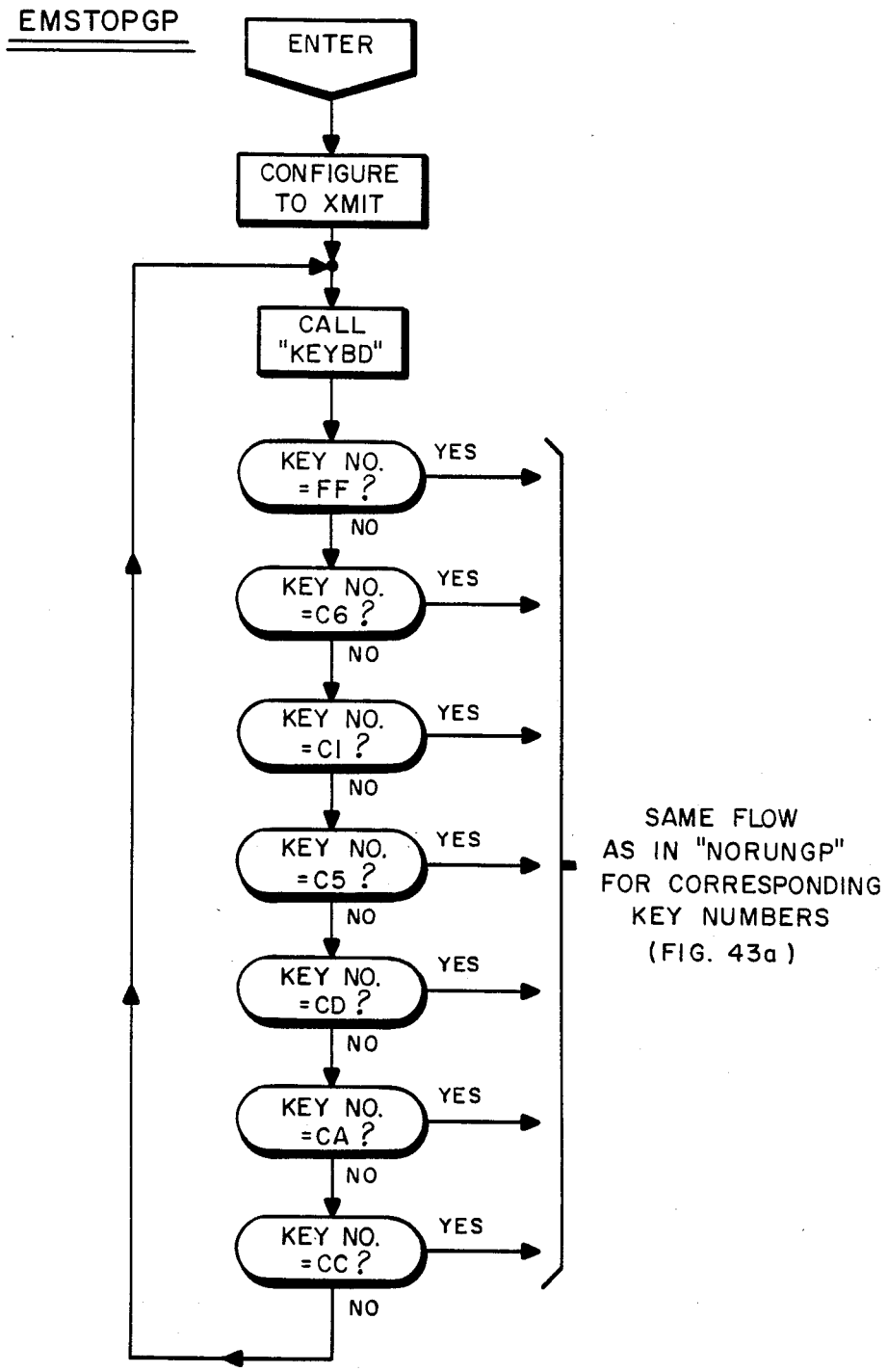
FIG. 45 is flow diagram the EMSTOPGP subroutine referred to in the main routine of FIG. 42.
Figure 46A:
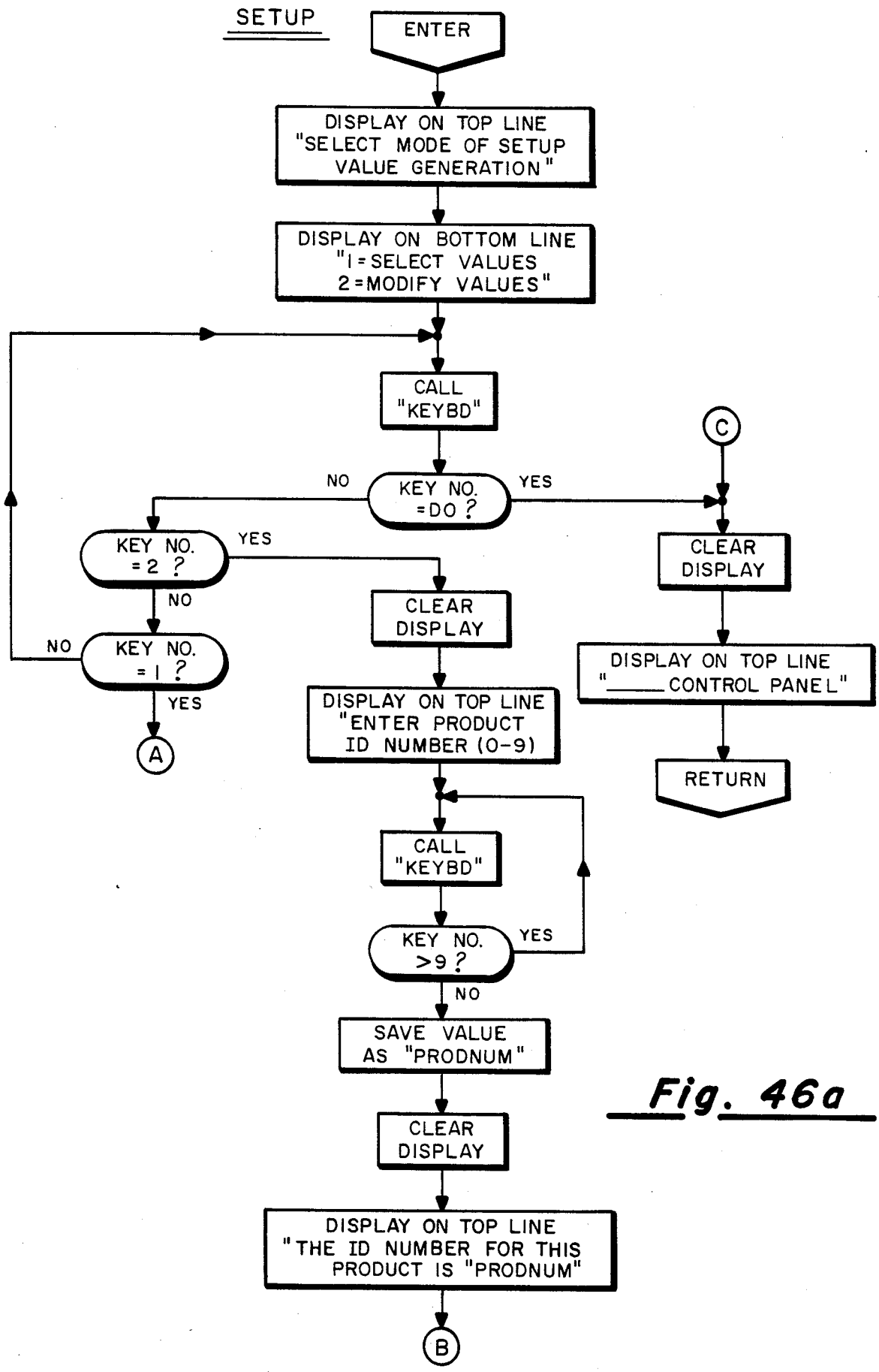
FIGS. 46(*a*) through 46(*k*) comprise the flow chart of the SETUP subroutine referred to in the NORUNGP subroutine of FIG. 43(*a*).
Figure 46B:
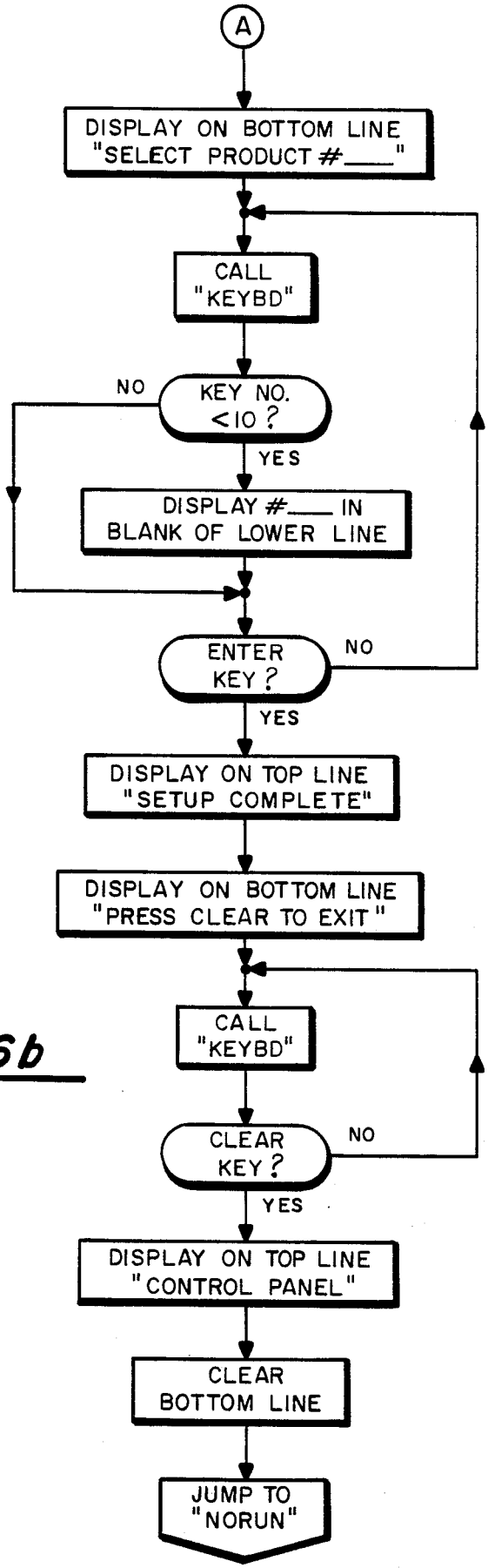
Figure 46C:
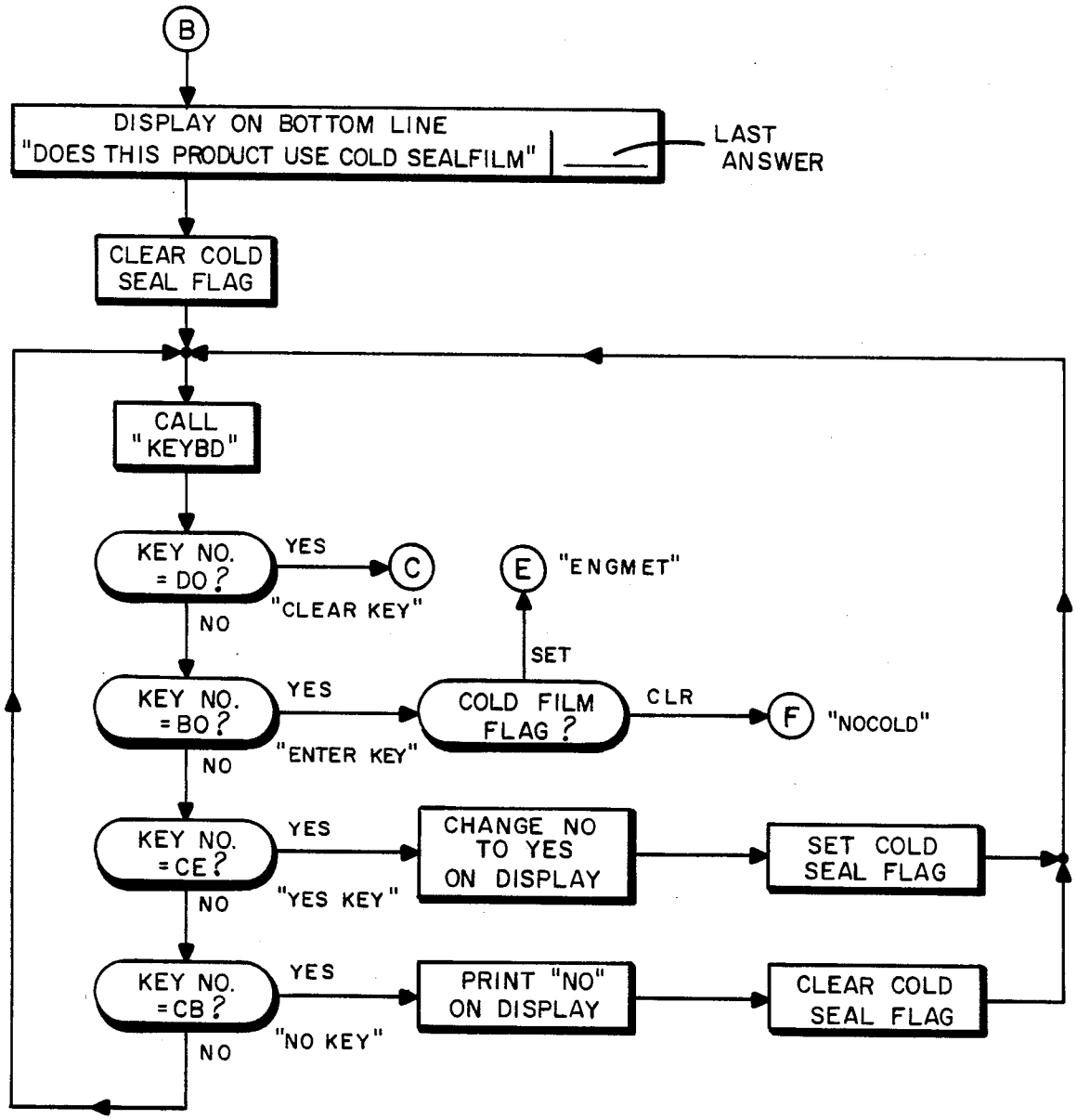
Figure 46D:
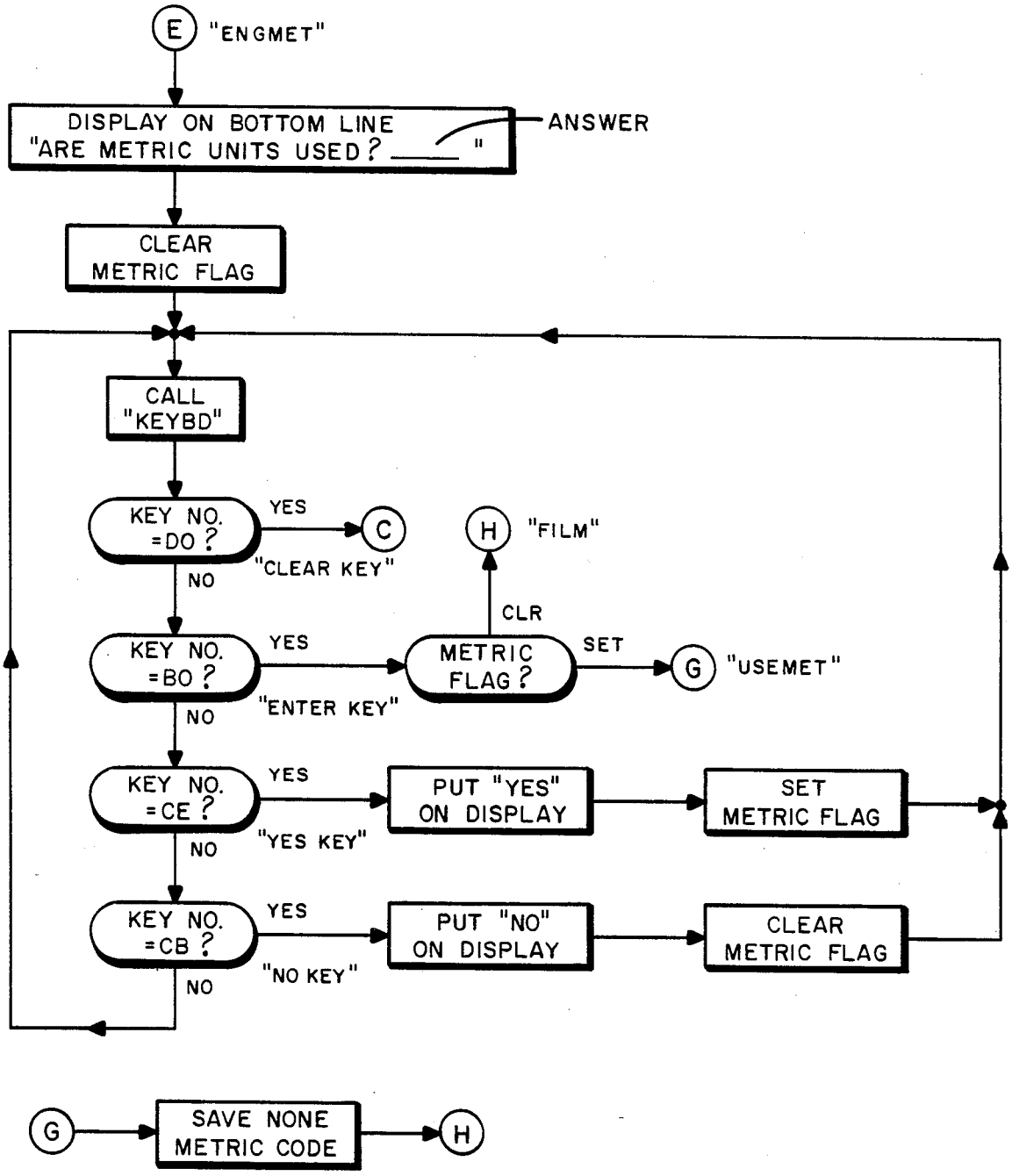
Figure 46E:
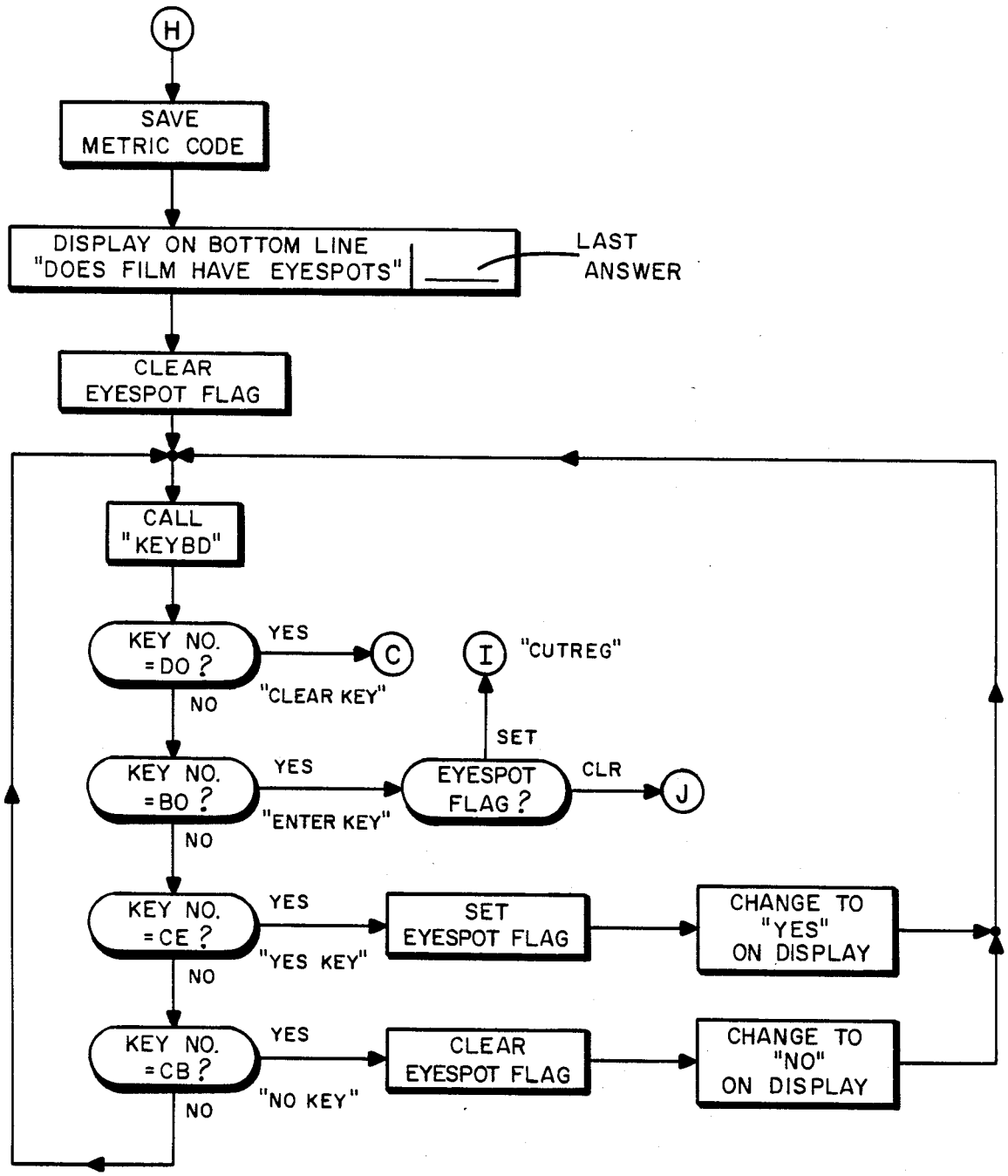
Figure 46F:
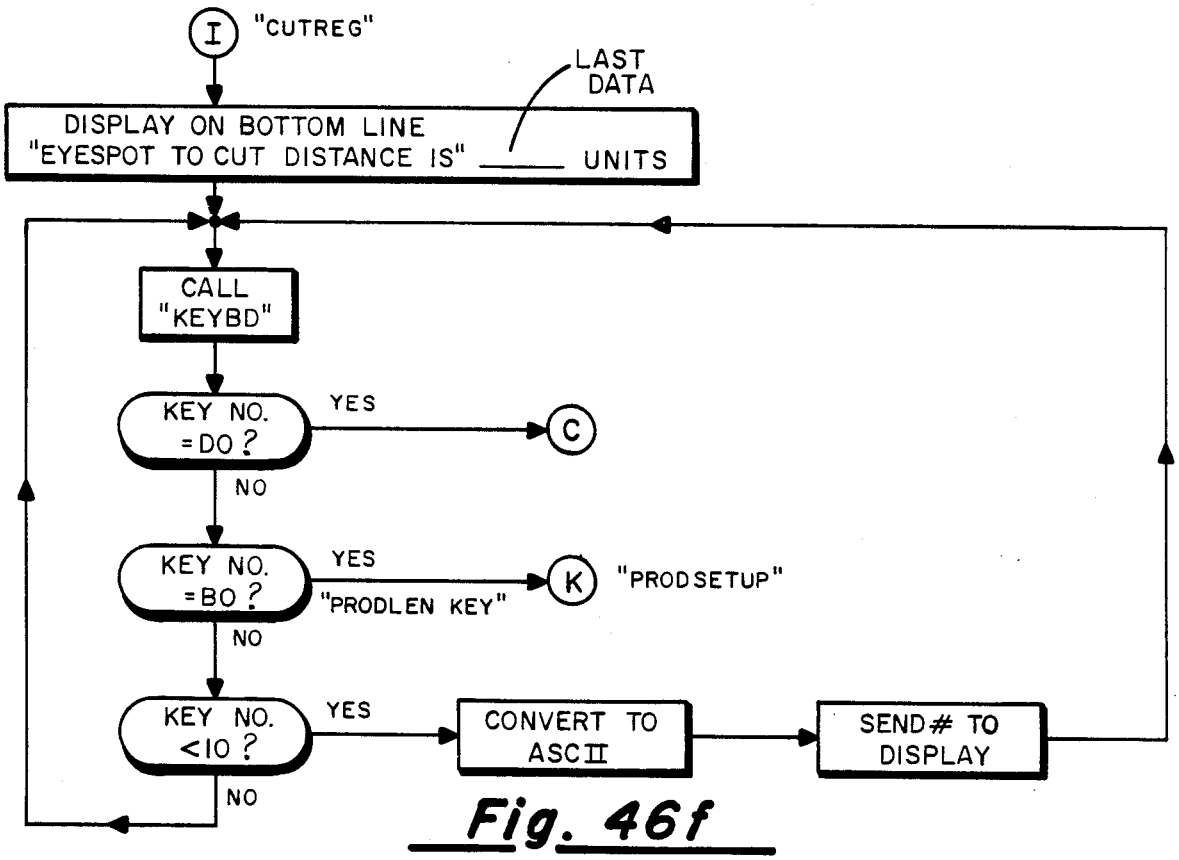
Figure 46G:
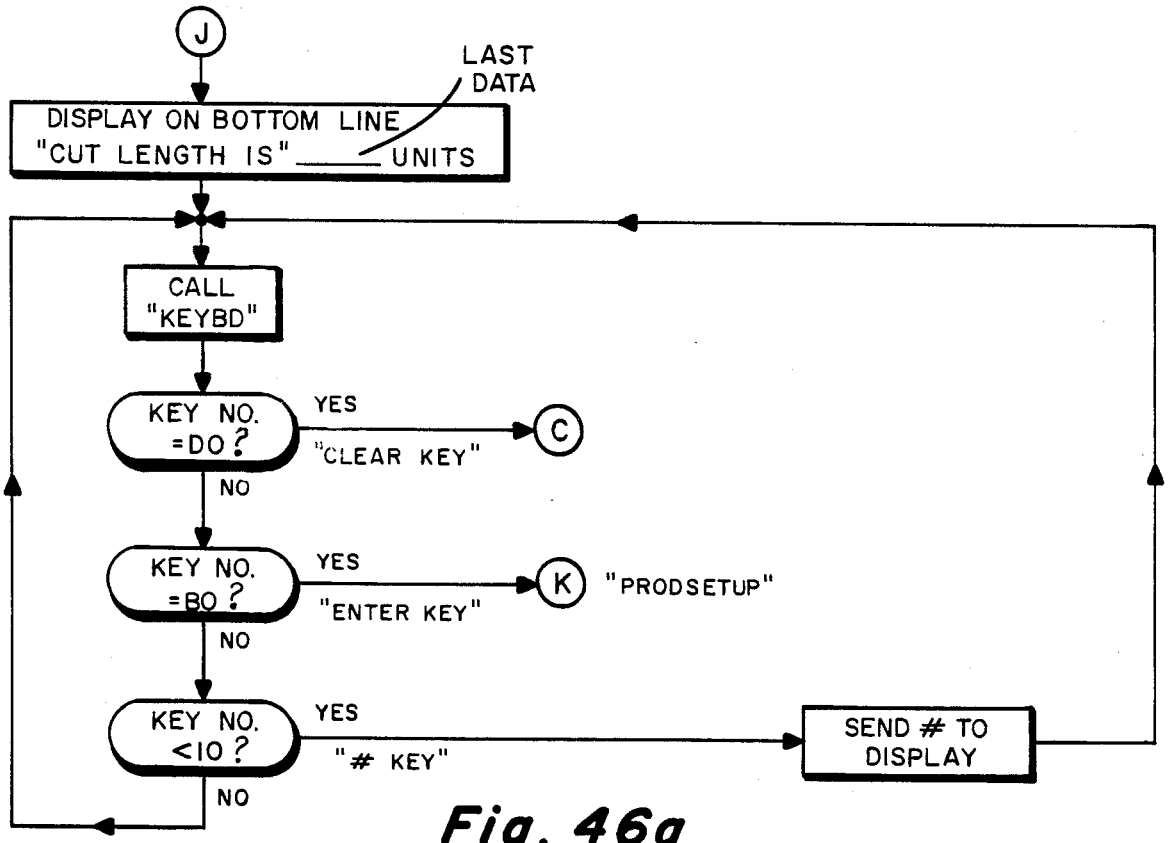
Figure 46H:
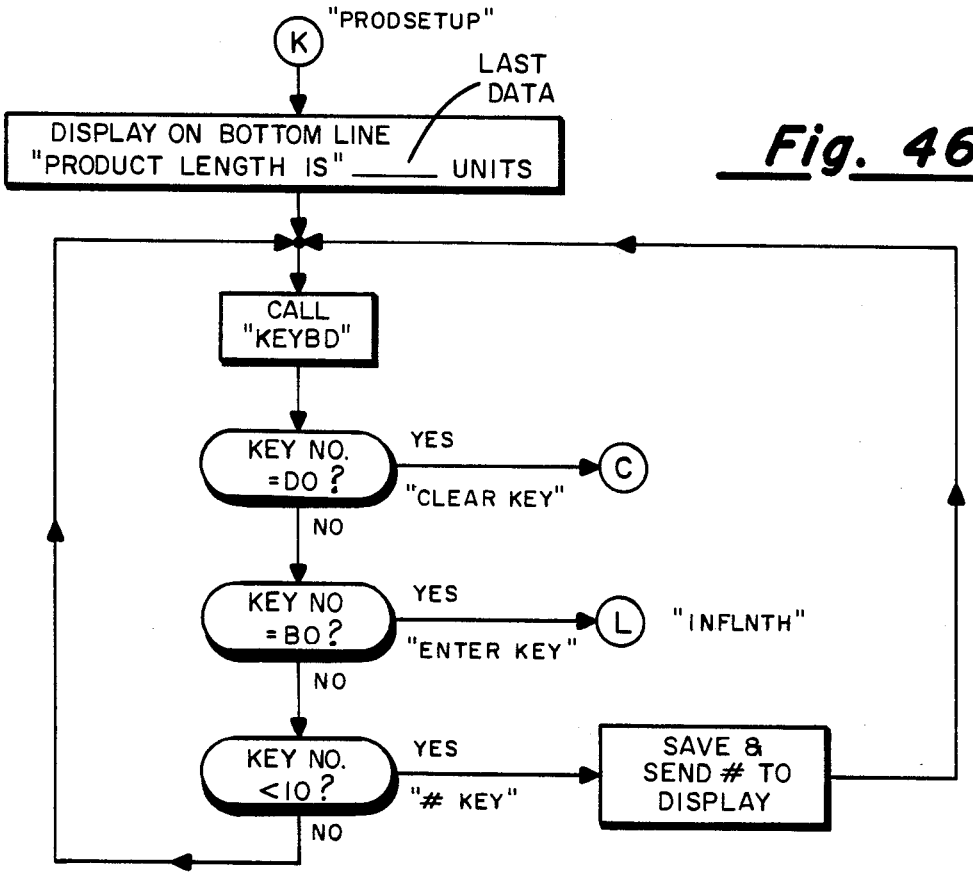
Figure 46I:
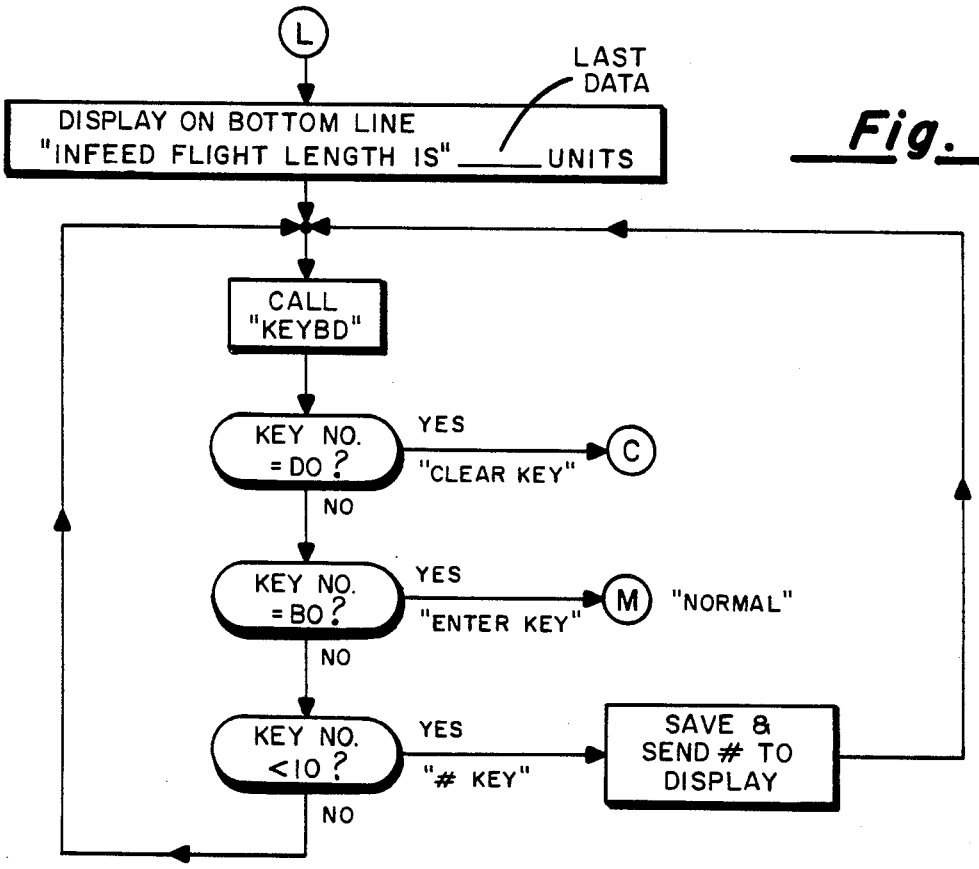
Figure 46J:
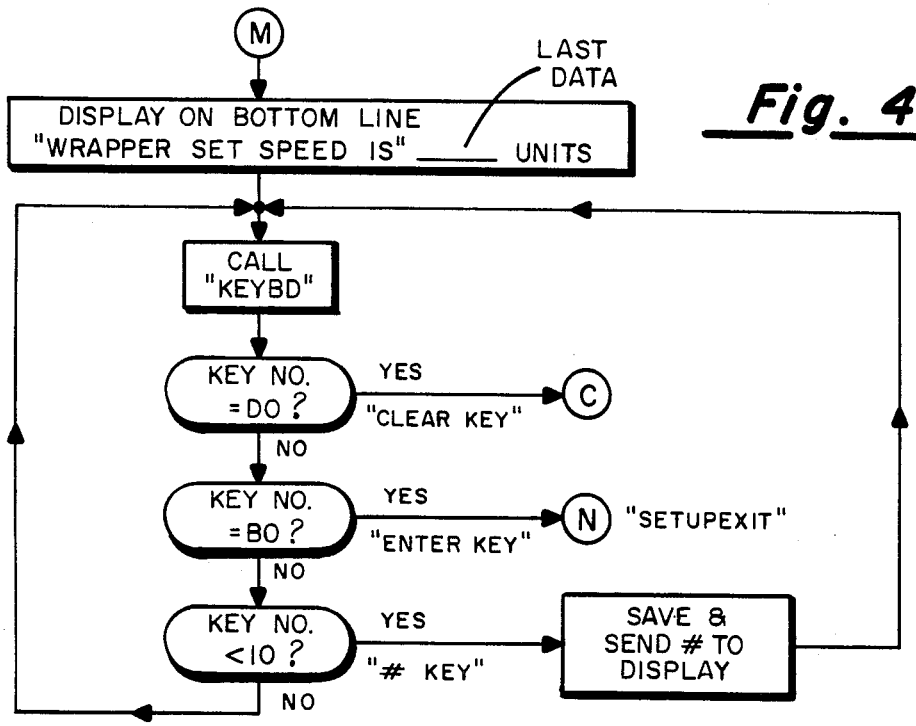
Figure 46K:
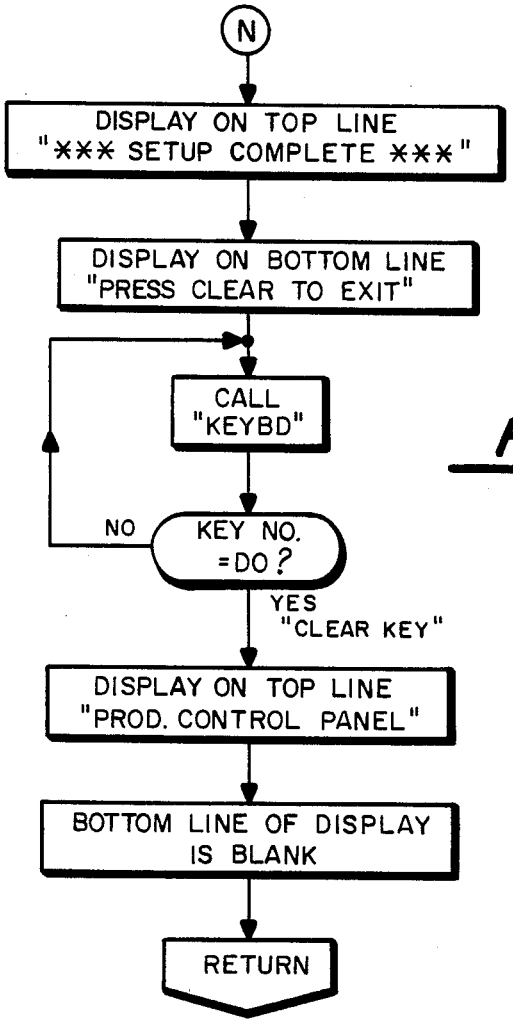

| | | |
|---|---|---|
| 5. INTERRUPT ROUTINES | | |
| EYESPOT | FIGS. 37(a) & 37(b) | |
| MISSEDEYSPOT | FIG. 38 | SPLICER EYESPOT - FIG. 40 |
| PUSHER | FIG. 39 | TIMEOUT - FIG. 41 |
| 6. CONTROL PANEL | | |
| NORUNGP | FIGS. 43(a)–43(d) | |
| NORMALGP | FIGS. 44(a) & 44(b) | |
| EMSTOPGP | FIG. 45 | |
| SETUP | FIGS. 46(a)–46(k) | |

Now that the organization of the various routines and subroutines have been set out, machine operation will now be explained utilizing the above-identified software flow charts.

NORUN

The "NORUN" routine covers the power-up sequence and the initialization of the hardware and software, readying the system for normal operation. Upon entry, a test is made to determine whether the AC power is on. If not, nothing happens and the system remains idle until the power is applied. Assuming that the power-on switch has just been closed, certain registers and flags are cleared and the microprocessor is readied for entry of set-up information. Specifically, in designing the system, an assumption is made that upon power-up, it will be desired to run the same product through the wrapper as had been involved prior to turning off the power switch. Thus, certain parameters which had been stored in a non-volatile memory are called up and calculations are made defining various parameters to be employed.

Upon entry of the "NORUN" software loop, the wrapper status is set to specify the "NORUN" routine. A test is then made to determine whether the control panel is connected and if it is a test is made to determine whether the emergency switch is on (FIG. 11(*b*)) and operations proceed based upon the condition of that switch. If the control panel is not connected, a test is made to determine whether the local start switch on the wrapper is on or off. If it is on, signifying that the wrapper is to be run, the status message "NORMRUN" is presented and the subroutine "HOME" (FIGS. 15(*a*), (*b*) & (*c*)) is entered. Following the execution of the operations set forth in that subroutine, a jump or branch is made to the "NORMRUN" main routine described later on in this specification. Assuming that the emergency switch had been closed, status message "EMERGENCY" would have been presented on the operator control panel and the software would execute a jump instruction, bringing the "EMERGENCY" routine of FIGS. 14(*a*) and 14(*b*) into play.

Had the emergency switch been off, a test is made as to whether a command code is available from the RS232 serial I/O port from the control panel. If such a command code is present, it is sequentially examined to determine whether it is a "SETUP" code, a "DIAGNOSTIC" code, a "JOGFIN" code, or any one of the other codes identified in the flow diagram of FIGS. 11(*b*) and 11(*c*). When any one of these codes are detected, an appropriate corresponding status message is presented and a jump is made to an appropriate routine or subroutine. Following the completion of called routines or subroutines, a return is made to the operation of FIG. 11(*d*) "CALLUPJAWTEMP". This routine compares the temperature of the cut/seal head with a predetermined set point and turns off the current through the cut/seal upper jaw heaters if the temperature is above the set point. The subroutine is also effective to turn on current through the cut/seal upper jaw heaters when a temperature comparison reflects that the actual temperature of the head is below the set point. The routine LOJAWTEMP operates in a similar fashion with the lower jaw heaters.

With continued reference to FIG. 11(*d*), the "CALLFINTEMP" subroutine works in much the same fashion. It compares the actual temperature of the finwheels with a predetermined set point and appropriate commands are sent from the CPU 51 to the triac card 71 whereby the temperature of the finwheels are maintained at the predetermined set point temperature.

In sequence, then, the further subroutine "TEMPDISP" and "CONTPAN 232" are executed. The TEMPDISP routine causes actual temperature readings to be presented on the machine display. The CONTPAN232 subroutine oversees the transmission of data between the operator control panel and the high speed wrapper. Following the latter operation, the sequence returns to the point where the wrapper status is set to "NORUN" (see FIG. 11(*a*)).

Having described the overall sequence of the "NORUN" routine, consideration will next be given to the various subroutines which are involved in executing that main routine.

The function of the "HOME" subroutine is to bring various operational elements of the machine into position before entering into the normal running mode. The "Cut Seal In Place" flag, the "Infeed In Place" flag, and the "Film In Place" flag are all cleared upon entry into the "HOME" subroutine and then a test is made to determine whether the "Infeed" flag is set or cleared. If it is cleared, the cut/seal motor and the film drive motor are enabled, followed by the setting of the "Infeed In Place" flag. If the "Infeed" flag had already been set, all the motors would be enabled. In either case, a signal is sent to cause the finwheels to engage the film edges 26 following the passage of the film over the film former. A zero command is then sent to all motors, the zero command corresponding to zero speed.

Next, the so-called "Cut Seal In Place" flag is tested and if it is not, a speed signal is sent to the cut seal motor servo-control 78 via the D/A converter 82 causing the cut/seal motor to run at a fixed low. The output of the resolver associated with the cut/seal head is monitored, that output being indicative of the angular position of the cut/seal head. This angular position is tested to determine whether it has reached its "HOME" position and when the "HOME" position is reached, a zero command is sent to the cut/seal motors telling them to stop. Because at this time the cut/seal head is at its "HOME" position, the "Cut Seal In Place" flag is set. Then, power to the motor is itself cut off.

If earlier in the subroutine it had been determined that the "Cut Seal In Place" flag had been set, the next test to be determined would be whether the "Film In Place" flag was set. This last-mentioned test is also made at the conclusion of the "AT HOME" test if an indication is given that the cut/seal head is not at its "HOME" position and after the stopping the motor if the head is at its "HOME" position.

If it is assumed that the "Film In Place" flag is not set, a low speed signal is sent to the servo-control for the finwheel motors. Next, a test is made to determine whether two eyespots have been sensed during this homing procedure. If so, the "RDEYECNTR" subroutine is executed whereby the position value for the film is fetched from a counter. Next, a test is made to determine whether the film is at its "HOME" position by comparing the contents of the aforementioned counter with a prescribed value. If the indication is that the film is at its "HOME" position, a zero command is sent to the finwheel motors causing their motion to stop and then, the power is removed from the finwheel motors.

If earlier in the sequence the tests conducted indicated that the "Film In Place" flag had been set or that two eyespots had not been sensed, or that the film was not at its "HOME" position, or that it is at "HOME" and the motor is stopped, a series of instructions relating to the infeed conveyor homing operation would be executed. Specifically, and with reference to FIG. 15(*c*), the "Infeed In Place" flag is tested and if cleared, a speed value is supplied to the infeed motor control servo, causing the infeed conveyor motor to operate at a slow speed. A test is made to determine whether two pushers on the infeed chain have passed a sensing eye. If so, the "RDPUSHENC" subroutine is executed. As was already mentioned, an encoder is associated with the pusher drive motor and produces pulses corresponding to the travel of the infeed conveyor. This position information is reviewed and if it is determined that the infeed conveyor is at its home position, a zero command is sent to the infeed conveyor motor to stop its motion, followed by the disabling of the power to the motor itself. Following that, the "Infeed In Place" flag is set to indicate that the "HOME" position for the infeed conveyor had been achieved.

If upon the initial testing of the "Infeed In Place" flag it had been determined to have been set or if the test relating to the pushers had indicated that two such pushers had not been sensed or if the "AT HOME" test had failed or if at "HOME" with infeed stopped, a final series of instructions relating to the testing of all three of the cut/seal head, the finwheels, and the infeed conveyor takes place. If this test indicates satisfactory homing of all three of these elemens, and a predetermined delay has elapsed, a signal is provided to cause the finwheels to engage the film.

There is a desired mode of machine operation in which film is to be run through the system but without product being present. As such, the infeed conveyor has an on/off switch whose status is reflected by the "Infeed" flag. The "Infeed" flag is tested and if set, all motors are enabled. However, if that flag is not set, all motors except the infeed conveyor motor are enabled. Control is then returned to the main NORUN routine (FIG. 11(*a*)) and then on to the NORMRUN routine.

It can be seen, then, that the HOME subroutine results in prepositioning of (1) the cut/seal head, (2) the film, and (3) the infeed conveyor. Once this homing operation is completed, the system is poised and ready to move into its normal running mode.

The temperature sensors 66 and 68 communicate with the CPU 51 by way of the temperature sensor interface 69. Specifically, a RS 232 port allows data transmitted from the temperature sensor interface, via the standard bus 53, to be displayed on the temperature display panel 73. Once the temperature initialization is done, a test is made to see if the serial I/O port 74 is busy and, if so, control returns to the main program. Ultimately, however, in cycling through the software again and again, the point in time will be reached when the serial I/O port is not busy and, at that time, a digital value corresponding to temperature is transmitted character by character to the display panel while the control system continues to perform its functions on a simultaneous basis. Where the temperature initialization is not completed and the port is not busy, a carriage return (CR) character is sent to the display as a command and the "Temp Int Done" flag is set. In this fashion, temperature readings are presented to inform the operator of the temperatures.

Figure 17:
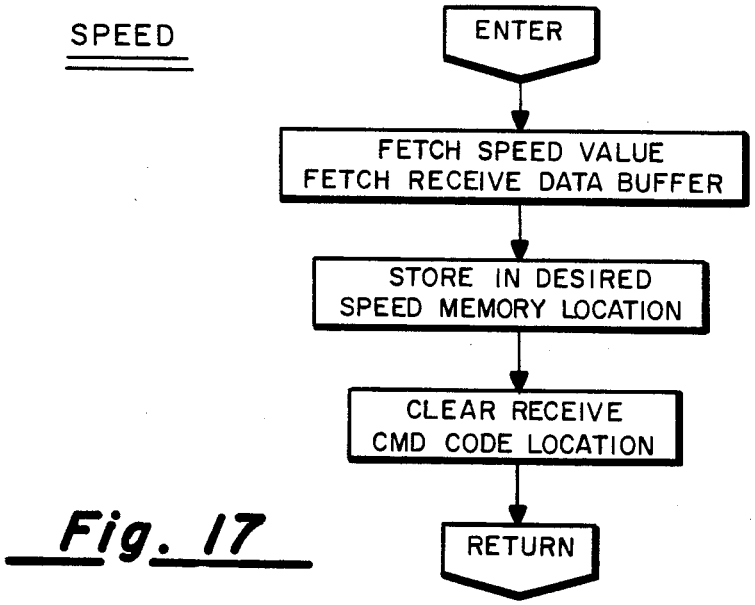
Figure 18:
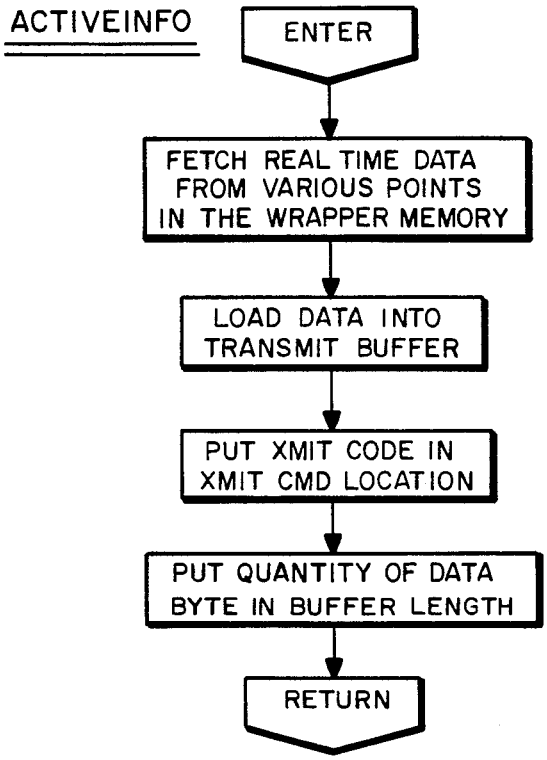

The subroutine captioned "SPEED" illustrated in FIG. 17 of the drawings indicates the manner in which digital values corresponding to desired wrapper speed in packages per minute are stored for later use by the control system of the present invention. It will be recalled in the "NORUN" routine, periodically a test is made to determine whether a command code is being received from the control panel RS 232 serial I/O port. If so and a test reveals that it is a so-called "SPEED" code, then the subroutine reflected in FIG. 17 is executed. Specifically, the digital value corresponding to a predetermined speed is retrieved from the received data buffer and stored away in a predetermined memory location. Following that, the command code is cleared and a return is made to an appropriate point in the program.

Figure 19:
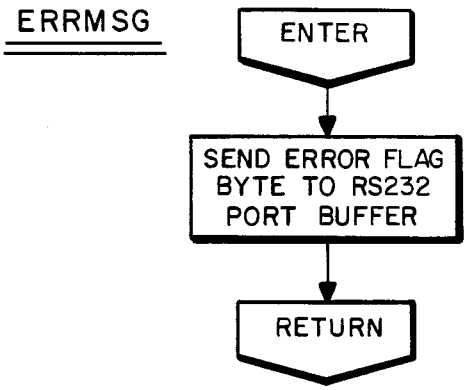

The active information subroutine (ACTIVEINFO) permits information useful to the operator to be periodically withdrawn from various points in the memory and transmitted to a utilization device. For example, any piece of digital equipment capable of communicating with the CPU 51 via the serial I/O port 74 or either of the optional serial I/O ports can extract data from the universal memory 52 after it has been placed there from various sensors and encoders used in the system.

Where the command code from the RS232 port is tested and found to be an error message code, the so-called "ERRMSG" subroutine of FIG. 19 is called for. This is a simple routine in which an error flag byte is sent to the buffer associated with the RS232 port. Once in that buffer, it becomes available to an external device capable of communicating with that port.

Figure 20:
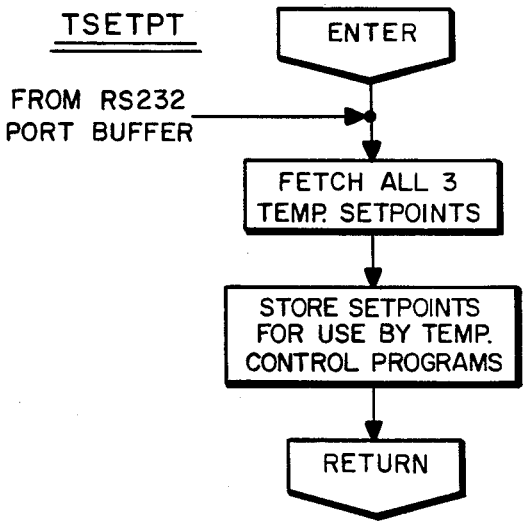
Figure 21:
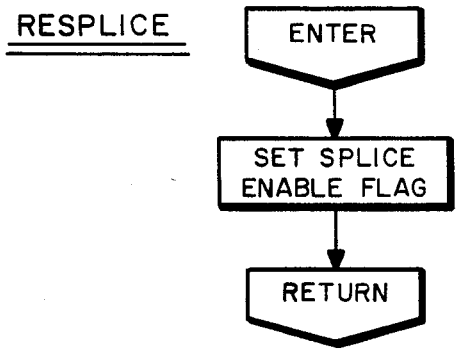

The presence of a temperature set point command code at the RS 232 port causes the "TSETPT" subroutine of FIG. 20 to be executed. Here, all three temperature set points are fetched from the RS232 port buffer and stored for later use by the temperature control programs illustrated in FIG. 11(*d*) of the drawings.

The command code from the RS232 port may also test out to be a "Reset Splicer" code. This code is activated by the operator whenever a new roll of film is installed on the wrapper. The resulting "RESPLICE" subroutine merely results in the setting of the so-called "Splice Enable" flag. The manner in which that flag is used will become more apparent as the discussion of the overall software progresses.

Figure 22:
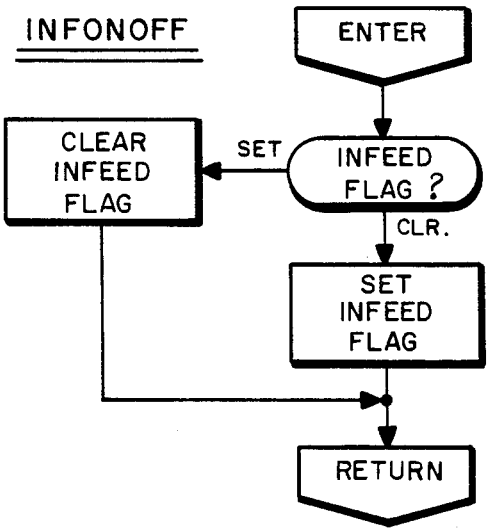

The "INFONOFF" command code results in the execution of the subroutine shown in FIG. 22 of the drawings where if the "Infeed" flag is tested and found to be set, it is cleared, and if tested and found to be cleared, it is set. This is a simple toggling function.

Figure 23:
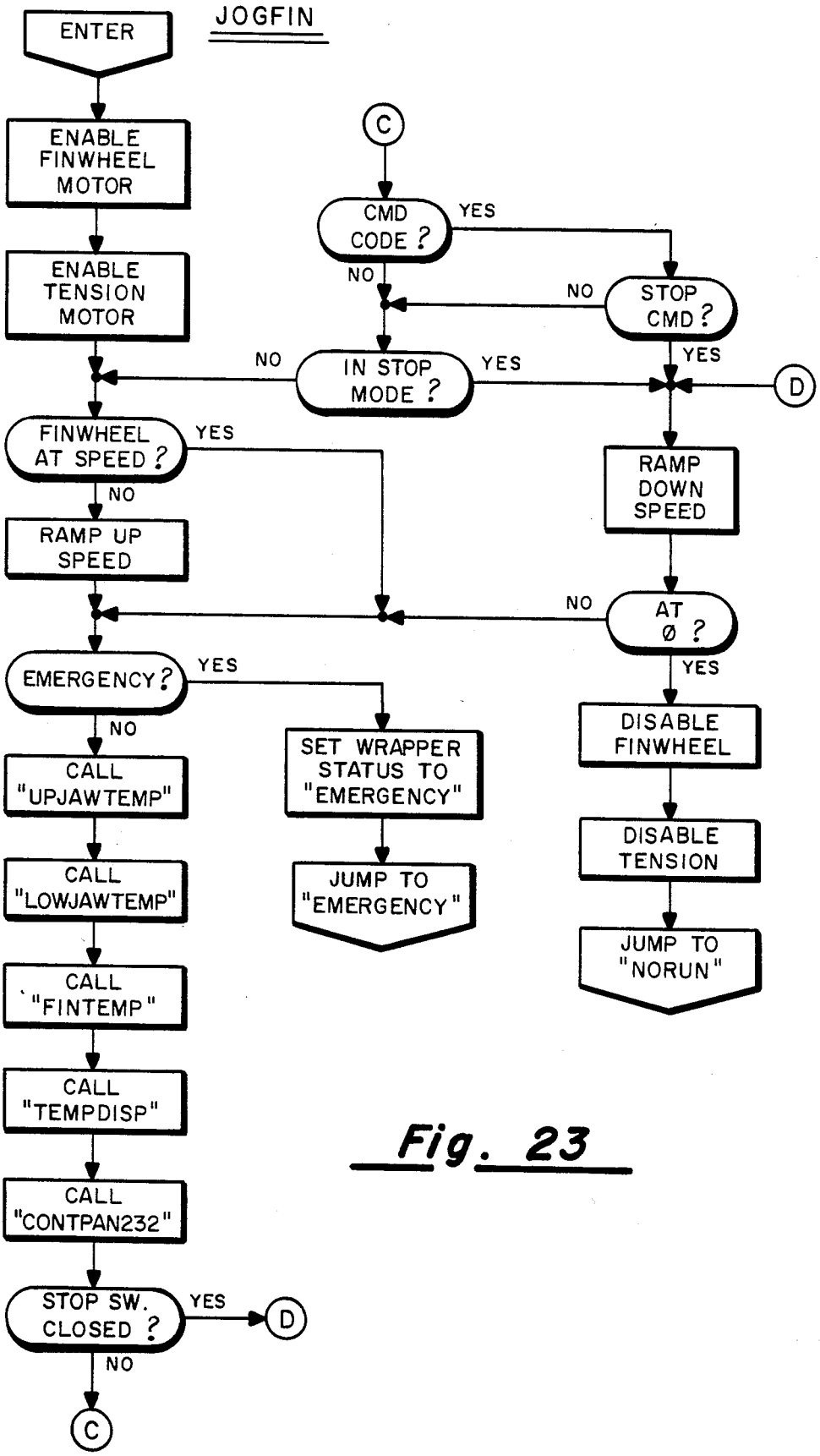
Figure 24:
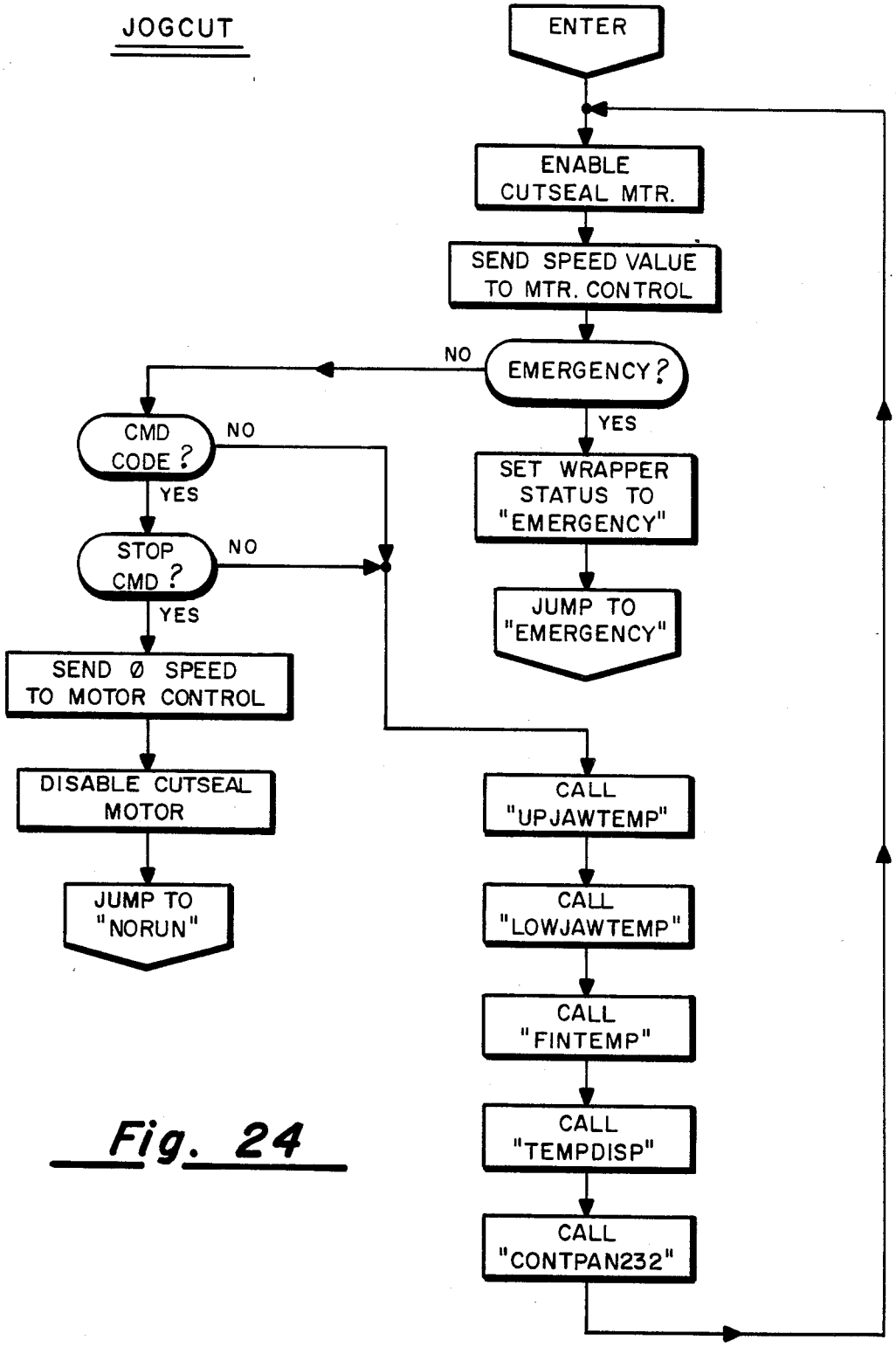

The presence of a "JOGFIN" command code from the RS232 port causes control to jump to the "JOGFIN" subroutine which is depicted by the flow diagram of FIGS. 23(*a*) & 23(*b*). The "JOGFIN" subroutine causes the finwheels to be driven until an operator-controlled Stop pushbutton is depressed. Upon entry of the "JOGFIN" routine, the finwheel motors and the film tension motors are enabled and a test is made to determine whether the finwheels are rotating at the predetermined film speed associated with the wrapper speed. If not, the finwheel speed is increased and a test is made to determine whether the emergency switch is closed. If the emergency switch is closed, the message "EMERGENCY" appears on the remote control panel's display panel and a jump is made to the "EMERGENCY" routine. However, if the emergency switch is not closed, then the following subroutines are called and executed in order:

UPJAWTEMP
LOJAWTEMP
FINTEMP
TEMPDISP
CONTPAN232

Following this, the position of the Stop switch is tested, and if it is not active, a test is made to determine the presence of a command code. If a command code is detected and it turns out to be a STOP command, the finwheel speed is ramped down and tested to determine whether it is yet at a zero-speed value. Once the finwheel is at a stop, the finwheel motors are disabled as is the motor associated with the film tension mechanism. If no command code is present, the next test is to determine whether the system is in the STOP mode. If it is, again the finwheel speed is ramped down to zero. If not, however, control loops back to the point where the test is made to determine whether the finwheel is at its desired speed. Once the Stop switch is operated, the speed ramps down until the zero-speed condition is reached. The finwheel stops without a particular positional relationship to infeed, cut/seal or eyespot.

The cut/seal head can also be operated in a Jog mode, meaning that so long as the Cut/Seal Jog switch is closed, the cut/seal motors will be enabled. Next, the low speed command is sent via the D/A convertor 82 to the cut/seal head motor 41. Provided the Emergency switch is not set, the "UPJAWTEMP", "LOJAWTEMP", "FINTEMP", "TEMPDISP" and "CONTPAN232" subroutines will be executed with control looping back to the point where the cut/seal head motor is enabled. Should a STOP command be detected from the RS232 port, a ZERO-SPEED command is sent to the motor control causing it to stop. Once stopped, the cut/seal motor is disabled and control returns to the appropriate point in the "NORUN" main routine. The cut/seal head stops without particular relationship to infeed, eyespot or cut/seal home position.

Figure 25:
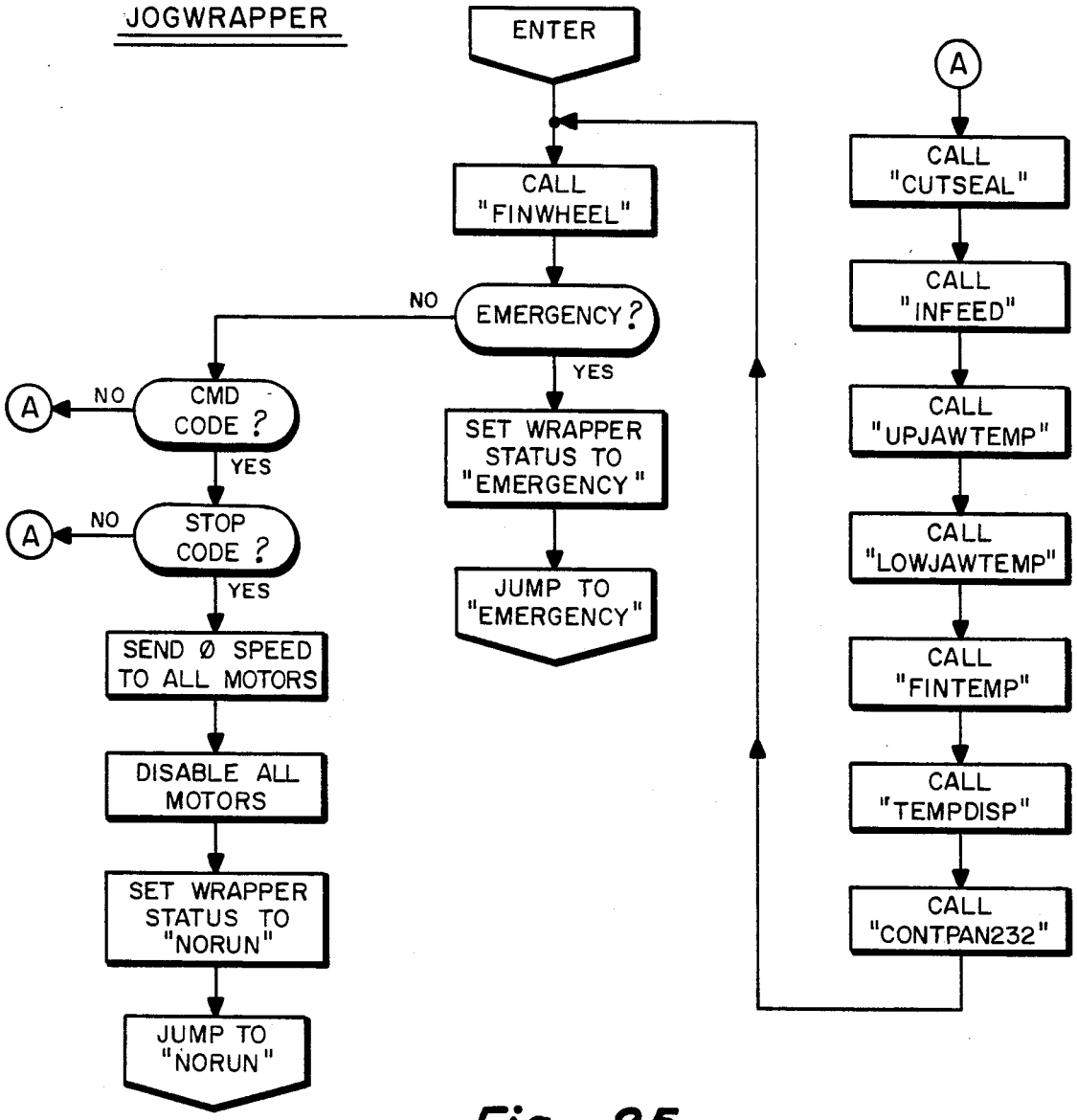
Figure 26A:
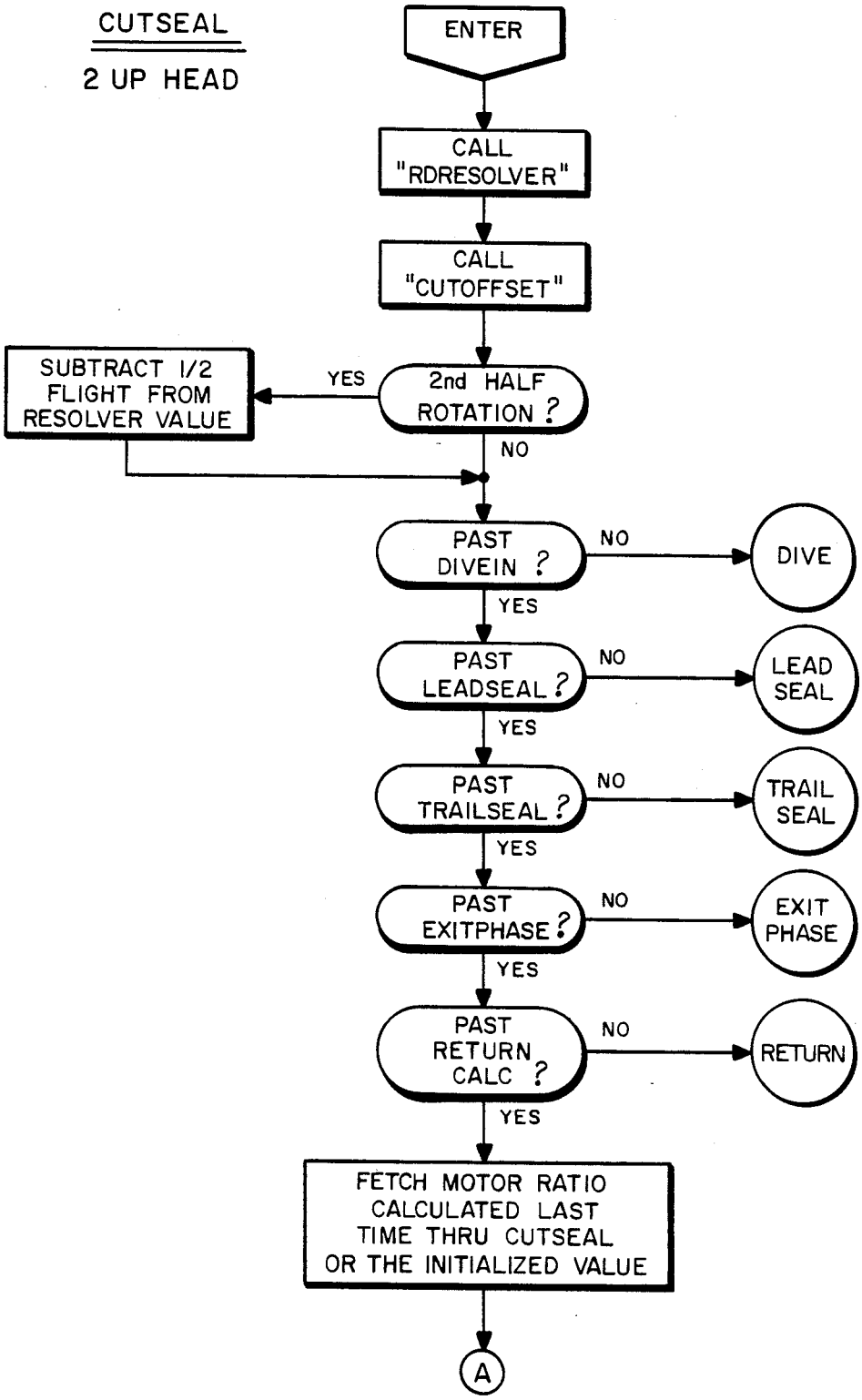
FIGS. 26(*a*) through 26(*d*), 27, 28, 29(*a*) & 29(*b*) and 30 through 35 are software subroutines called for during the execution of the main routine "NORMRUN"
Figure 26B:
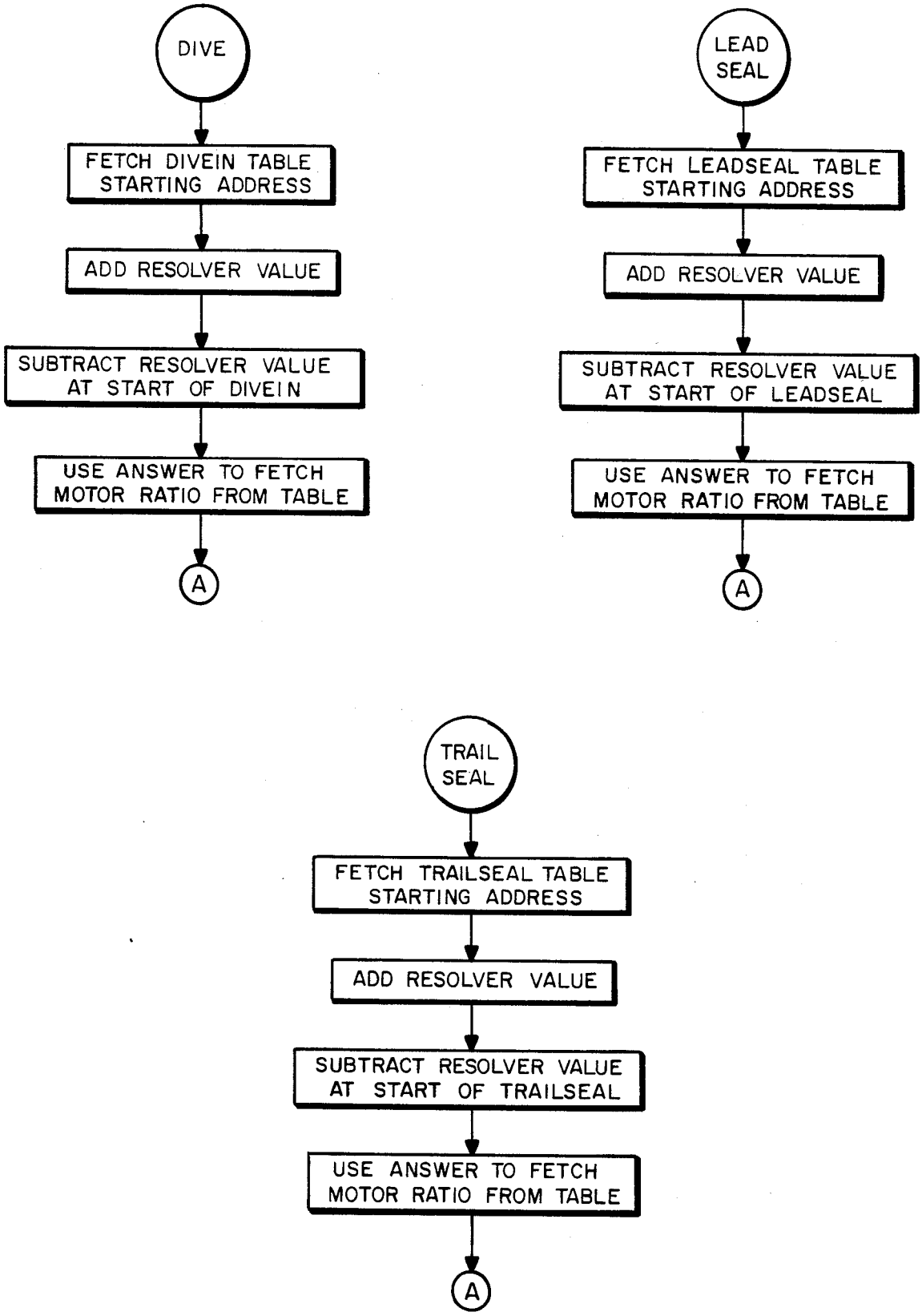
Figure 26D:
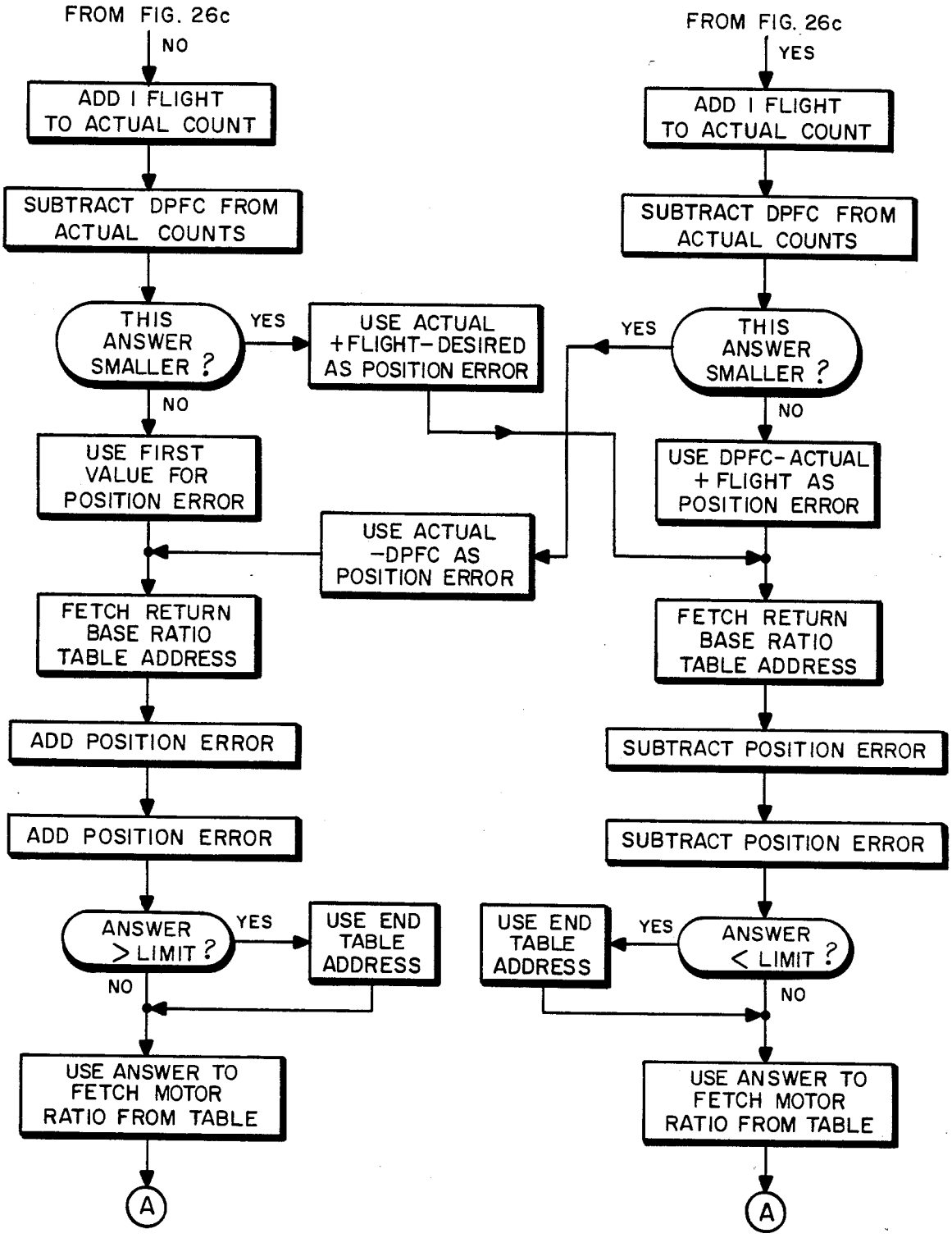

It is also possible to operate the entire high-speed microprocessor-controlled wrapper in a so-called "JOG" mode. Rather than singly causing either the finwheels, the cut/seal head motor or the infeed conveyor motor to operate individually, all of these devices can be operated in a fashion causing them to run only so long as the wrapper jog switch is closed. It is possible also to run the finwheel and cut/seal motors without having this infeed motor off. The subroutine associated with the "JOGWRAPPER" mode is illustrated in FIG. 25. Thus, when the jog switch on the control panel is pressed, an appropriate command code becomes available for sampling at the RS232 port and, when detected, causes the "JOGWRAPPER" subroutine to be executed. The JOGWRAPPER subroutine functions very much like the NORMRUM routine, which is described in detail immediately below. The only essential differences are that in the JOGWRAPPER mode a fixed low wrapper speed is mandated and that the JOGWRAPPER routine is active only while the remote control panel Start switch is depressed. Hence, it is not deemed necessary to provide a further explanation of the JOGWRAPPER subroutine because it is adequately covered in the following NORMRUN description.

Figure 12A:
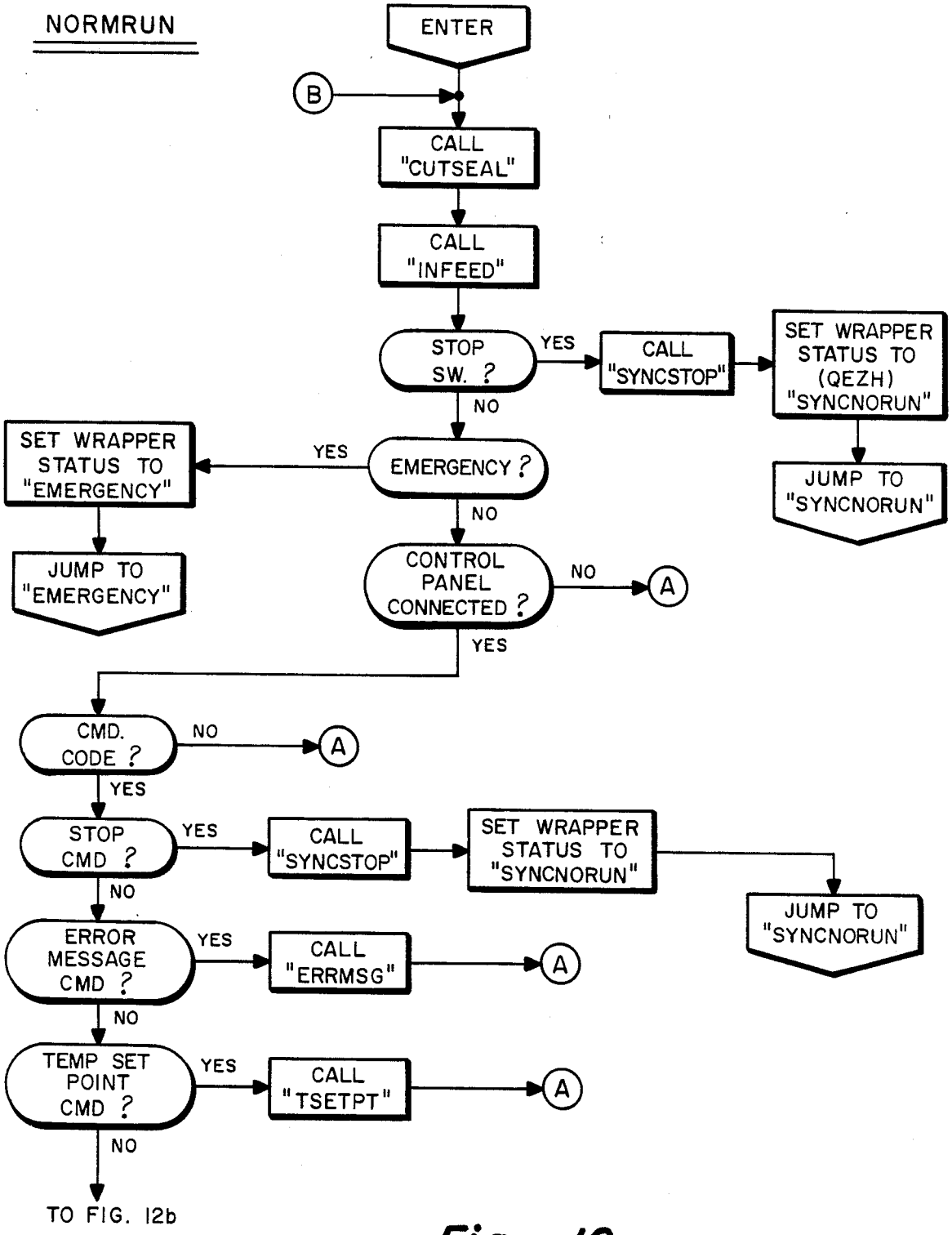
FIGS. 12(*a*) through 12(*c*) together comprise a flow chart of the main routine referred to as "NORMRUN"
Figure 12B:
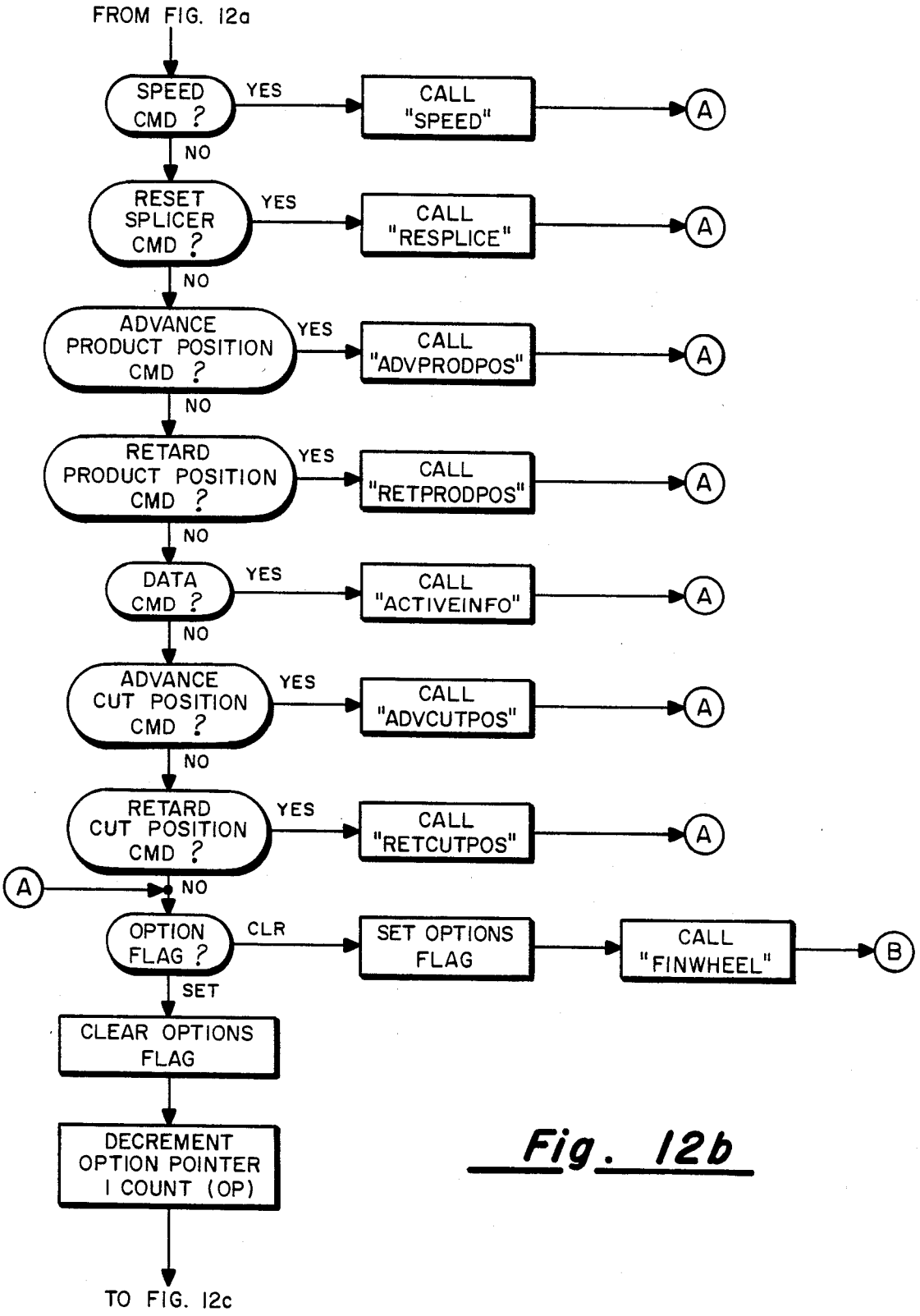
Figure 12C:
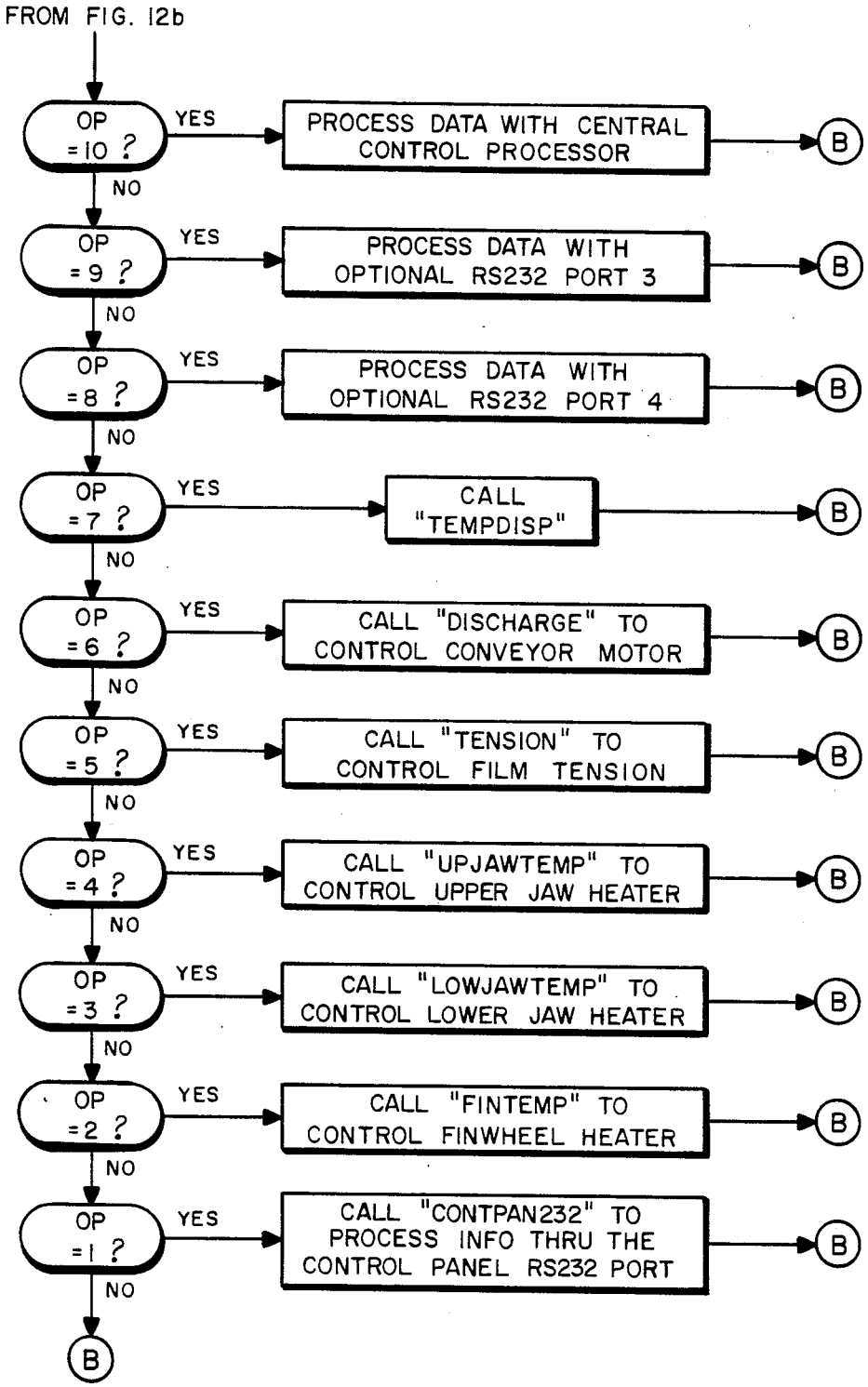

It will be recalled that before jumping to the "NORMRUM" routine reflected in FIGS. 12(*a*)–(*c*) of the drawings the "NORUN" routine called for the execution of the "HOME" subroutine in which all motors were brought to the point where the film, the cut/seal heads and the infeed conveyor would start in synchronism. The first operation then is the "CUTSEAL" subroutine, which, in turn, is reflected in FIGS. 26(*a*)–(*d*) followed by the execution of the "INFEED" subroutine of FIGS. 29(*a*) & (*b*). If the wrapper's Stop switch on the local control panel is closed, the "SYNCSTOP" subroutine is executed and the status message "SYNCNORUN" is presented on the control panel display and will control exiting to that particular main routine. If the Stop switch on the local control panel had not been set but the Emergency switch had, then the status message displayed would be "EMERGENCY" with control shifting to the "EMERGENCY" main routine. Assuming that neither the Stop switch nor the Emergency switch is set, a test is made to determine whether the pluggable remote control panel 54 (FIG. 8) is connected to the wrapper. If not, the so-called "OPTION" flag is tested, and if that flag is cleared, it will first be set and then the "FINWHEEL" subroutine will be executed with control returning to the initial "CUTSEAL" subroutine. If upon testing it was found that the "OPTION" flag had been set, then the first operation would be to clear that flag and the option pointer would be decremented by one count.

As can be seen from FIGS. 12(*c*), there are ten possible options which are sequentially sampled under control of the option pointer. Each pass through the "NORMRUN" routine can result in a different one of the several options being called into play, depending upon whether the OP=1 through OP=10 flags are set.

Options 10, 9 and 8 each relate to the ability of the processor 51 to communicate via the serial I/O ports with other digital data-handling devices. For example, when a test is made and it is found that the OP=10 flag is set, a remote computer located elsewhere in the factory may communicate with the wrapper to, for example, implement the user's Management Information System (MIS) involving such things as inventory, production control, etc.

Options 9 and 8 are similar to Option 10 and permit a user to tie various types of digital data processing equipment for two-way communication with the wrapper. In this fashion, a remotely-located device can be used to operate the wrapping machine.

The remaining options set forth in the portion of the flow chart shown in FIG. 12(*c*) comprise calls to various subroutines, the function and purpose of which will be described in greater detail below. Upon completion of any of the option routines or a finding that none of the option flags are set will result in a loop-back to the beginning of the "NORMRUN" routine.

The "CUTSEAL" subroutine reflected in the flow diagrams of FIGS. 26(*a*)-(*d*) reflect the manner in which the speed profile or epicycle of the cut/seal head is controlled. The problem is to be solved is to ensure that the cutting knife and the anvil come together with the film to be cut travelling at the same speed and with the cut being made at a desired point on the film between adjacent products. Because the angular distance that the anvil and cutting knives must travel is greater than the cut length of the film, the average angular velocity of the cut/seal head must be greater than the linear velocity at which the film is moving. Nonetheless, at the time that the cut/seal head assembly contacts the film, both must be travelling at the same velocity. Hence, there is the need for a controlled angular velocity profile for the cut/seal head.

Figure 10:
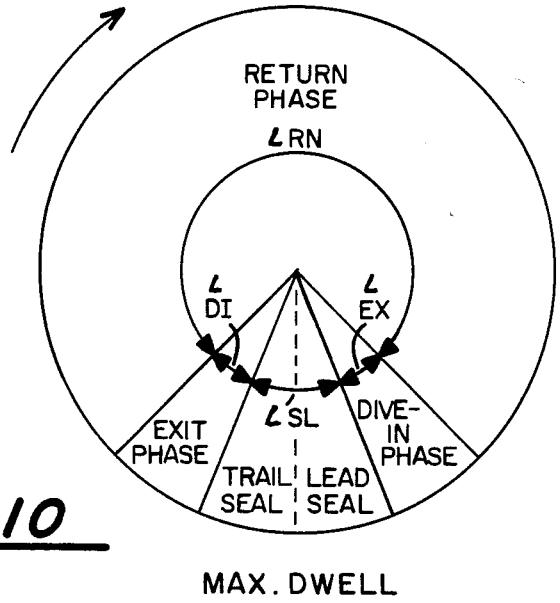
FIG. 10 is a diagram for illustrating the cut/seal head epicycle.
Figure 11A:
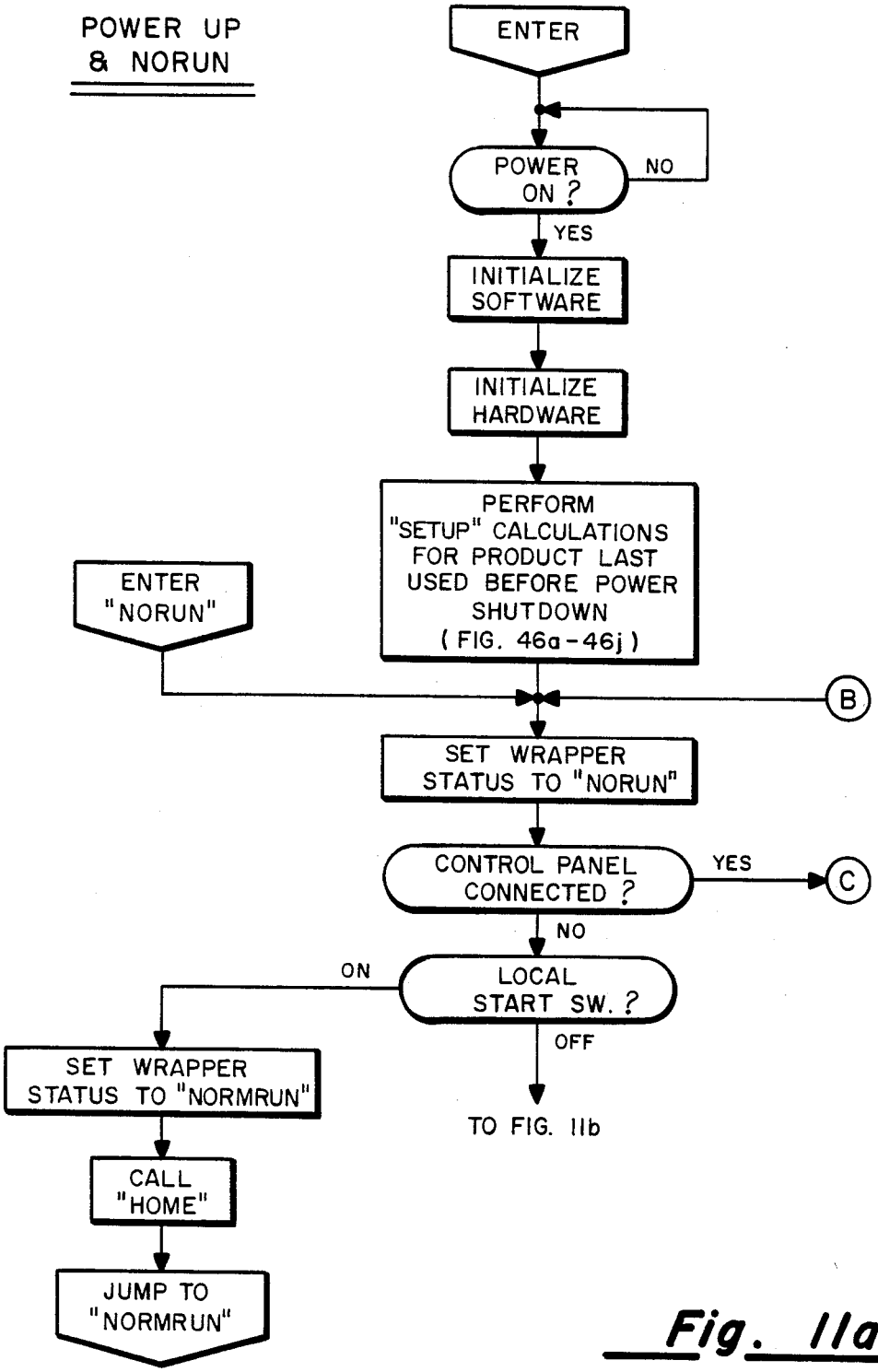
FIGS. 11(*a*) through 11(*d*) together comprise a flow chart of the main routine referred to as "NORUN"
Figure 11B:
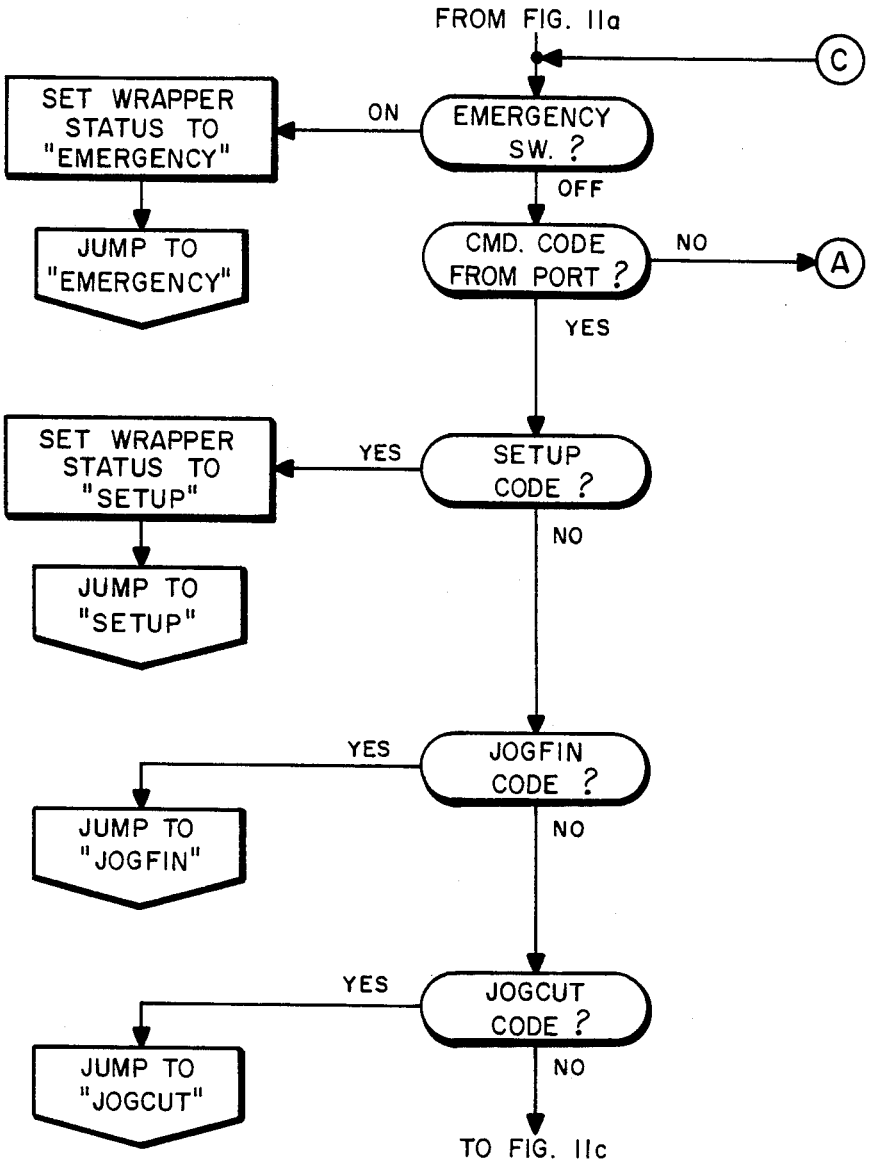
Figure 11C:
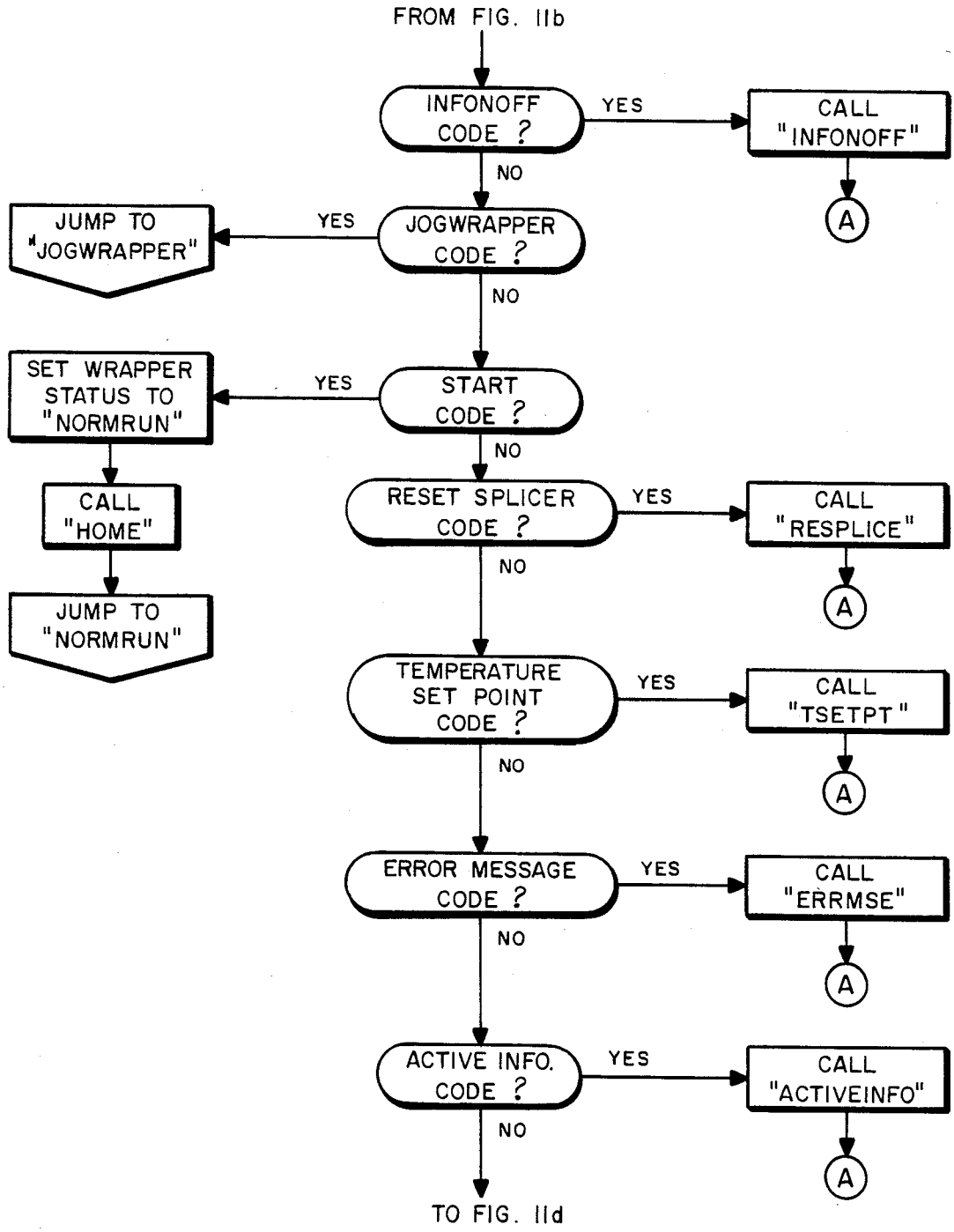
Figure 11D:
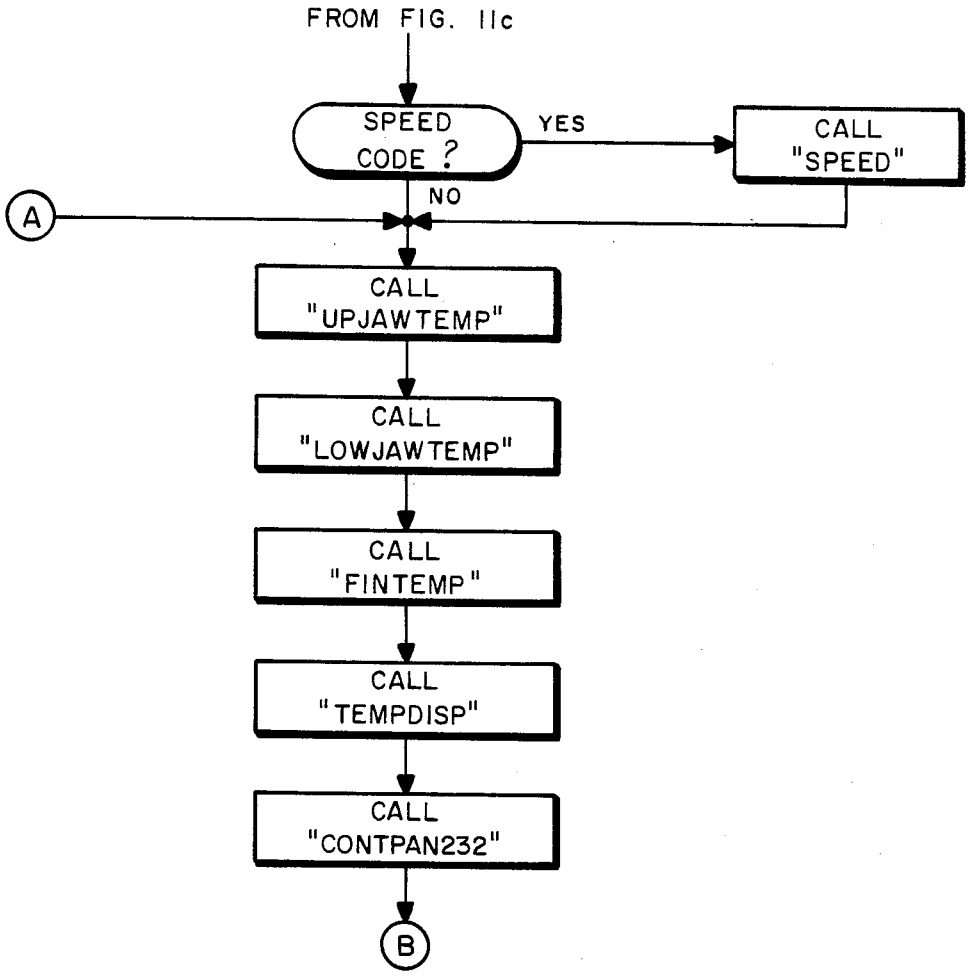

It is envisioned that different types of cut/seal head assemblies may be used in the present invention. For example, the head assembly may only include one blade member allowing its 360° of periphery (a 1-up head) or, alternatively, it could be a 2-up head where two blades are spaced 180° apart about the periphery. Additional cutting blades may also be employed, it being understood that, when they are, they are spaced equally about the periphery of the rotating head. With reference to FIG. 10, the epicycle of the cut/seal head is divided into two basic segments, namely, the cut phase, C, and the returnphase, RN, (FIG. 6). The cut phase is, in turn, divided into four discrete zones referred to as "dive-in", "lead seal", "trail seal", and "exit". The length of each of these zones is arbitrarily defined for a particular cut/seal head configuration. In FIG. 10, the point where the actual cut is assumed to take place is represented by a broken line. This line divides the lead seal and trail seal zone. The return phase, both in length and speed profile, is dependent upon the particular cut/seal head configurations employed, i.e., whether it is a 1-up head, a 2-up head, etc.

Referring to the flow diagram, the first operation to be performed upon entry into the "CUTSEAL" subroutine is to call the resolver (RDRESOLVER) which provides an indication of the actual angular position of the head relative to an arbitrary reference point. Next, the value of the cut off-set, if any, is obtained, that value corresponding to any phase shift that might be desirable for timing purposes.

Assuming that a 2-up head is involved, a test is next made to determine whether that head is in its second half rotation. If it is, a digital value corresponding to one-half of the cut/seal revolution is subtracted from the resolver value. Had a four-up head been employed, the preceding test would have been made to determine in which particular quadrant the head was positioned in and then, a quarter, half or three-quarter revolution would have been subtracted from the resolver value.

Next, a test is made to determine whether the head is in its "dive-in" phase, dive-in referring to the action of the head in trying to get from a relatively high angular velocity corresponding to the return speed down to the film speed before contact is made between the cut/seal head and the film. If the second half rotation has not passed the dive-in zone, then the "DIVE" subroutine shown in FIG. 26(*b*) is executed. It is this series of steps that provides the cut/seal head speed commands to the appropriate motor for controlling the angular velocity of the head. It is accomplished by referencing a look-up table which has a series of speed-determining commands stored at addressable memory locations where those addresses are determined by the angular position of the cut/seal head. Thus, for example, the dive-in table may have a starting address of zero. To determine what the appropriate speed should be for the actual angular position of the head at any moment, the resolver value obtained during the "RDRESOLVER" operation is added to the starting address, and then the resolver value at the start of the dive-in phase is subtracted. The net result, then, is the actual distance of the cutting blade into the dive-in zone and associated with that actual distance value is a speed value in the look-up table. Actually, what is stored in the look-up table is a "motor ratio" which, when multiplied by the speed reflected by the master tachometer on the wrapper drive, yields the motor speed command for the cut/seal head motor control 78.

Returning again to FIG. 26(*a*), if it had been determined that the angular position of the cut/seal head had been beyond the dive-in zone but before the precise point where the film cut occurs, that is defined as the leadseal zone. In this zone, the cutting knife and anvil are constantly in contact with the film material and it is necessary that the linear velocity of the blade and anvil be equal to the linear velocity of the film in this zone. Again, there is associated with this zone a separate look-up table which, when addressed by a number corresponding to the actual location of the cut/seal blade and anvil relative to the starting of that zone, provides a motor ratio value which, when multiplied by the reading from the master tach on the wrapper, will provide the appropriate angular velocity for the head.

The termination of the leadseal zone ends at the point at which the cut is made. That also marks the start of the so-called trailseal zone. The trailseal zone is basically a mirror-image of the leadseal zone in that it, too, relates to a velocity profile which will ensure that the head and the film are moving at the same linear velocity until the end of the trialseal where the head again lifts free of the film.

Similarly, the exitphase zone is a mirror-image of the dive-in zone. Where as in the dive-in zone the control was such that the return speed was reduced to the point where it equalled the linear velocity of the film. In the exit zone, the speed profile is such that the angular velocity of the cut/seal head is increased from that corresponding to the linear velocity of the film to the angular velocity of the head during the return phase.

Ideally, the angular velocity of the cut/seal head during the return portion of the cycle remains constant, with only mirror corrections being made, either positively or negatively, to the base ratio so as to achieve positional correction. With that in mind and looking at the flow chart of the "RETURN" subroutine shown on FIGS. 26(*c*) and 26(*d*), the resolver value is subtracted from the resolver value pertaining to the actual angular position of the head at the beginning of the return zone and that answer is used to address a table which, in this instance, contains values corresponding to what the film position should be at this particular positioning of the cut/seal head. Next, the contents of the film counter is read, that value providing an indication of the actual film location. Next, the actual location count is subtracted from the film count corresponding to the desired position, and a test is made to determine whether that difference results in a negative or a positive answer. If it is a negative answer, it is known that the actual position is in advance of the desired position and that slow-down should take place. Contrawise, if the results of the subtraction yields a positive number, it is known that the actual position is less than the desired position and that speed-up is called for. Having determined the direction (increase or decrease) of the speed change, it is also necessary to know the magnitude of the change. Moreover, the algorithm employed determines the shortest distance in which the correction is to be made. This latter aspect is implemented by adding a count corresponding to one full flight, i.e., the distance between cuts, to the actual position count value followed by subtracting the desired position film count therefrom. A comparison is then made between these two values and, if the former is less than the latter, it is the sum of the actual count plus one flight less the desired count, which is used as the position error value. However, if the comparison reveals that the former is larger than the latter, then the first value computed is employed as the position error. In either case, once the position error is computed, it is employed as an address for accessing the return base ratio table.

Ultimately, what is secured from the table is a motor ratio value, when multiplied by the signal proportional to film speed obtained from the master tachometer on the wrapper, a speed command is generated which, when applied to the velocity servo associated with the cut/seal head, causes the cut/seal head to rotate at a particular angular velocity corresponding to its actual position in the epicycle.

Figure 27:
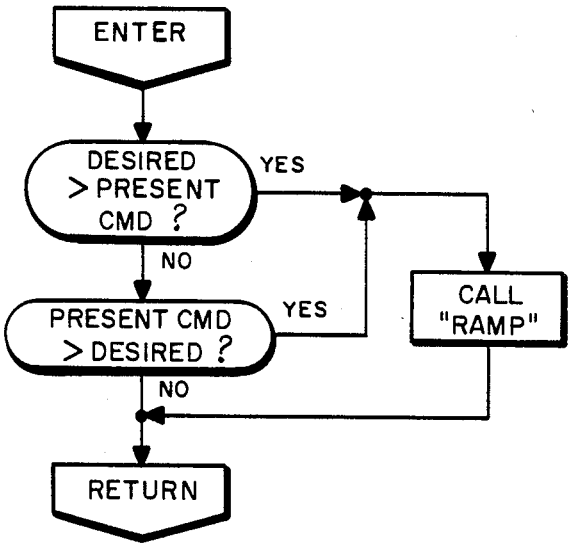

The "FINWHEEL" subroutine of FIG. 27 reflects a fairly simple programming concept. Specifically, when this subroutine is called, a test is made to determine whether the desired finwheel speed is greater than or less than that determined by the present speed command. If it is neither greater than nor less than the present speed command, then it is known that the finwheels are rotating at the desired speed and no further speed adjustment need be made. However, if the desired speed is greater than the present speed command or if the present speed command is greater than the desired speed, the "RAMP" subroutine is executed.

Figure 28:
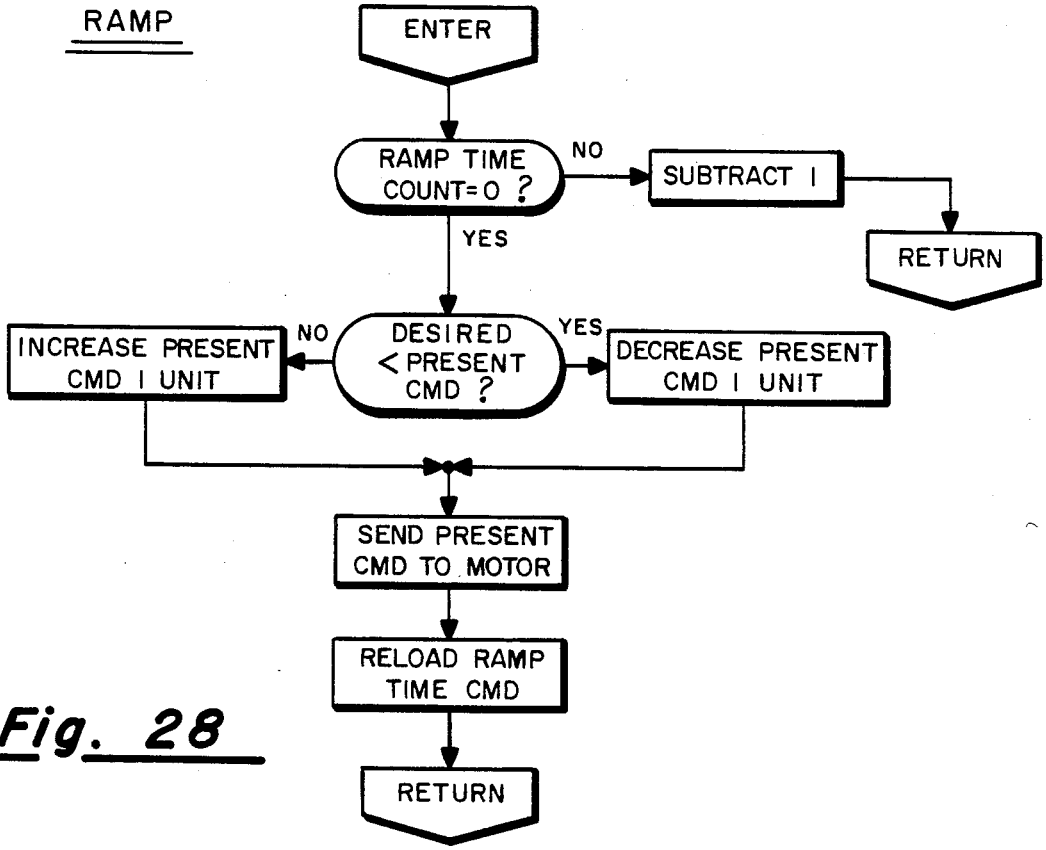

The "RAMP" subroutine itself is shown in FIG. 28 of the drawings. Upon entry into the "RAMP" subroutine, a test is made of the ramp time counter to determine if it has timed out. If not, it is decremented and a return is executed. Ultimately, when the ramp time counter reads zero, a test is made to determine whether the desired finwheel speed is less than that dictated by the present speed command in place. If not, a speed-up is dictated and this is accomplished by incrementing the present speed command by one unit. On the other hand, if the desired speed had been tested and found to be less than the present speed command, then it is known that the finwheel is moving at too high a rate and speed adjustment is accomplished by decreasing the present speed command by one unit. After the incremented or decremented speed command is sent to the finwheel motors, the ramp time counter is again reloaded and control returns to the point in the program where the "RAMP" subroutine was first entered.

The "INFEED" subroutine used in the "NORMRUN" main routine is reflected by the flow diagram of FIGS. 29(*a*) and (*b*). It is the general purpose of the "INFEED" subroutine to adjust the speed at which the infeed conveyor is operating so that the arriving products will be properly oriented and aligned with the eyespots on the film and, ultimately, with the operation of the cut/seal head assembly. To determine the location of the film, the "RDEYECNTR" subroutne is executed. Following that, the pusher location is determined by executing the "RDPUSHENC" subroutine, which relates to the encoder device associated with the infeed chain. Two other subroutines referred to as "NORMCOUNT" and "INFOFFSET" are included to shift or normalize the relative relation between the distance between eyespots and the finwheel location. Because it would only be sheer coincidence that the pusher-to-pusher distance is equal to the printed pattern length on the film as defined by the eyespots, a normalizing technique is used in which the actual pusher-to-pusher distance is divided by the actual eyespot-to-eyespot distance and that ratio is used as a multiplier for the pusher count, the result being that the pusher count used in the computations is adjusted to accommodate variations in the aforementioned ratio on a real time basis. Then, because it is necessary to time the product being packaged to the pattern on the film, the pusher count is offset to the extent necessary to maintain registration.

If ideal conditions could be maintained in which there could be no variation in the eyespot-to-eyespot distance and in the pusher-to-pusher distance throughout the length of the infeed chain, then the contents of the normalized and offset pusher counter would at all times remain equal to the contents of the film counter. However, because there can be variation, the difference between these two count values is proportional to the speed difference necessary to effect synchronization.

With these preliminary steps completed, the film count (FC) obtained from the film counter is subtracted from the normalized and offset pusher count value (PC), and a test is made to determine whether that difference yields a positive or a negative result. If positive, the film count plus a count corresponding to one flight is subtracted from the pusher count. If this computation results in an answer that is smaller in magnitude than that achieved during the preceding subtraction operation, then the latter answer is retained. However, if the second subtraction results in an answer that is larger than the prior subtraction produced, then the PC-FC value is subsequently utilized.

If, on the other hand, the value PC-FC had resulted in a negative answer, a further subtraction is performed in which the pusher count is subtracted from film count. Next, a computation is made in which a quantity corresponding to the film count plus a count corresponding to one flight distance is subtracted from the pusher count. Then, a test is made to determine whether the second computed difference is less than the first computed difference. If it is, the last computed difference is retained for later use. However, if the test reveals that the last computed difference is larger than the first, then it is the difference between the film count and the pusher count that is retained.

Stored in the memory for the microprocessor during the "Setup" sequence is a table of motor ratios for the infeed conveyor motor. The motor ratio is the ratio of the infeed conveyor motor speed to the finwheel speed for an ideal system where no variations in eyespot-to-eyespot distance or pusher-to-pusher distance are taken into account. The center address in this table is its base address, and once the position error, as computed by the previous subtraction operations, is determined, that position error is used to move upwards or downwards in the table from the base address value for reading out the motor ratio associated with that degree of error magnitude. Then, as was the case with the cut/seal motor control, the finwheel tachometer is read to obtain data as to actual film speed and the motor ratio obtained from the computed table address is multiplied by the tachometer reading to provide the new speed command used by the infeed motor controller.

One of the options periodically sampled during the "NORMRUN" routine is the "DISCHARGE" subroutine, which is used to control the speed of the disclosure conveyor motor used to carry the wrapped and sealed products from the high-speed wrapper itself. The subroutine for controlling the discharge conveyor motor is set forth in FIG. 30 of the drawings. As is indicated in that figure, the master tachometer associated with the wrapper is read to determine its operating speed. The discharge belt is designed to run at a speed which is greater than that of the infeed conveyor to the wrapper. This insures that wrapped products are removed at a sufficiently high rate that there will not be a jam-up. The "DISCHARGE" routine results in the development of a motor speed command by multiplying the wrapper speed by a ratio greater than one, that ratio calculated at the time of set-up. That speed comand is sent to the discharge conveyor motor velocity servo, resulting in a speed value for that motor which is sure to drive it faster than that of the wrapper itself.

Figure 31:
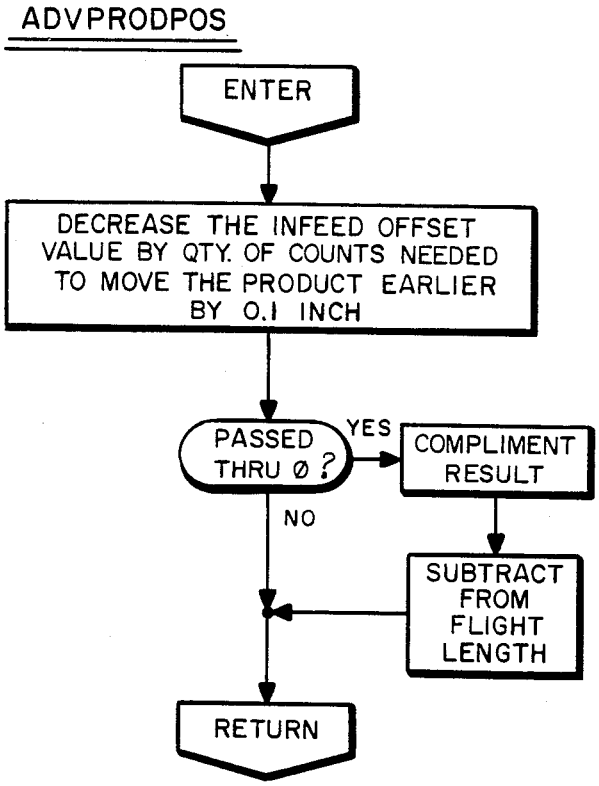

Referring to the flow chart of FIG. 31, the advance product position for "ADVPRODPOS" subroutine for in the main "NORMRUN" routine will now be described. When the "INFEED" subroutine was discussed, mention was made of the fact that it is necessary at times to introduce a so-called offset wherein the product count is phase-shifted to properly align the product with any printed pattern which may be on the film. The "ADVPRODPOS" subroutine operates to decrease the amount of offset by a quantity of counts corresponding to a product position shift of 0.1 inches each time the operatiion actuate the "Advance" button and the remote control panel. A test is made to determine whether the offset has been reduced to zero or beyond and, if so, the amount of shift is complimented and then subtracted from the flight length such that the offset value continues to decrement through a flight on into the next flight.

Figure 32:
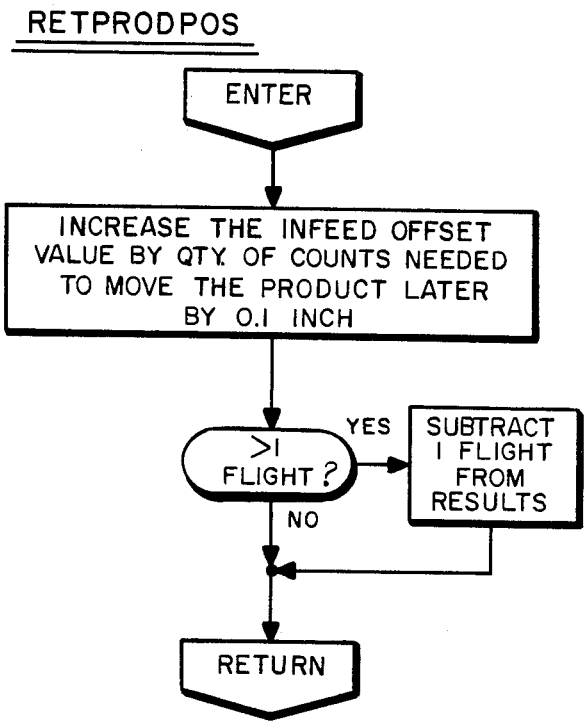

The retard product position (RETPRODPOS) subroutine of FIG. 32 is quite closely related in concept to the "ADVPRODPOS" subroutine described above except that an incrementing rather than a decrementing operation is employed. Further explanation of the flow chart of FIG. 32 is, therefore, deemed unnecessary for a full understanding by those skilled in the art.

Figure 33:
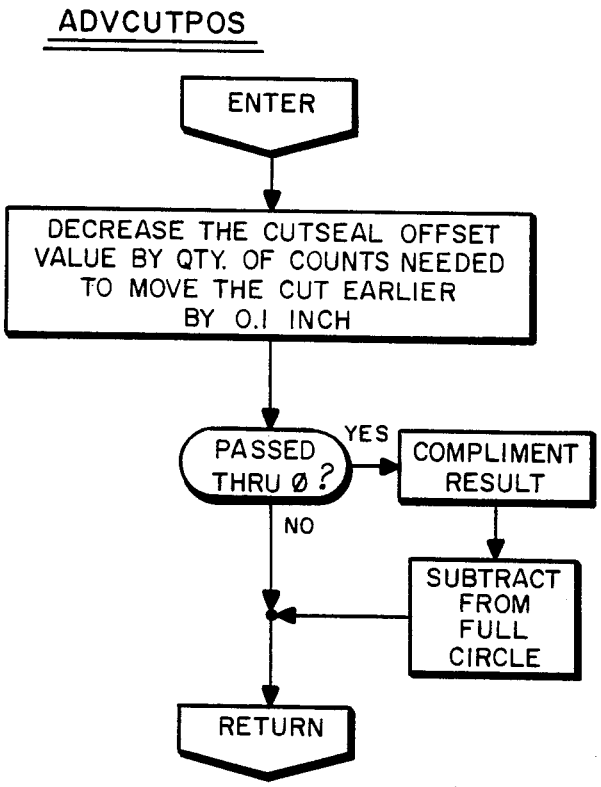

FIG. 33 is the software flow diagram for the subroutine "ADVCUTPOS", i.e., advanced cut position. It will be recalled from the previous description of the "CUTSEAL" subroutine that the concept of "offset" is used therein as well as to adjust the phase between product position and cut length. When the "ADVCUTPOS" subroutine is called, a count value corresponding to a 0.1 inch movement of the cut position is subtracted from the offset and then a test is made to determine whether the offset value has passed through zero. If so, the computed count value is complimented and subtracted from the value corresponding to a full circle.

Figure 34:
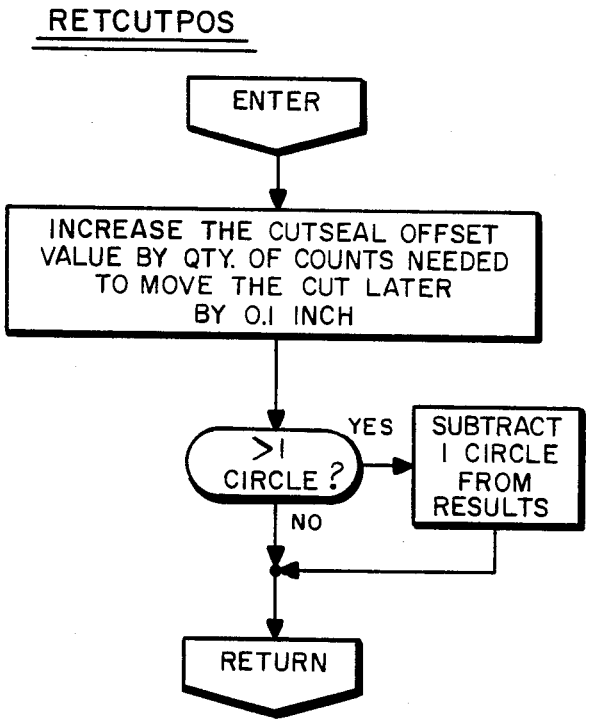

The subroutine "RETCUTPOS" of FIG. 34 relates to the prior subroutine except that it provides a way of iteratively increasing the amount of cut/seal offset in predetermined increments. If a test reveals that the shift has gone beyond the point corresponding to a full circle, a count corresponding to a full circle is subtracted from the computed results.

Figure 35:
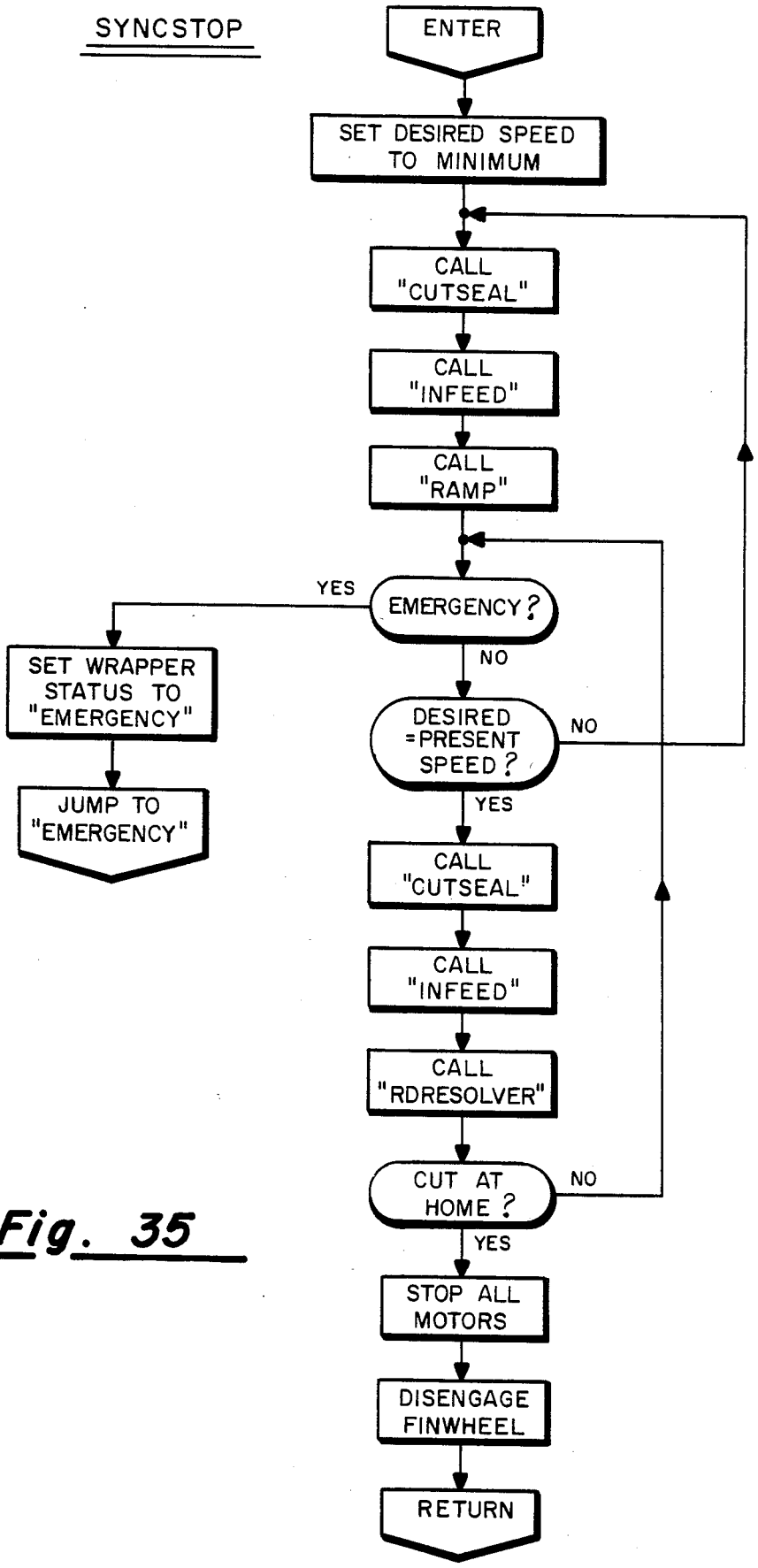

During the execution of the "NORMRUN" routine, if it is determined that the stop switch is set or closed, a call is made to the "SYNCSTOP" subroutine. This subroutine is shown in FIG. 35 of the drawings. The "SYNCSTOP" subroutine insures that the machine will be brought to a halt with the product, the film and the cut/seal heads at their "HOME" position such that when the system is again started, all functions will remain in synchronism. The first operation is to set the "desired" speed to the minimum value established at the time of set-up. Next, the "CUTSEAL", the "INFEED" and the "RAMP" are executed in sequence, the result being that the cut/seal head, the infeed conveyor and the film movement produced by the finwheels have their speed reduced in a way that does not cause a loss of relative positioning between these elements. Provided the emergency switch is not set, a test is made to determine whether the present speed has reached the desired minimum speed. If not, control loops back through the "CUTSEAL", the "INFEED" and the "RAMP" subroutines until the test produces this result. Then, the "CUTSEAL", the "INFEED" and the "RDRESOLVER" subroutines are executed until such time as it is determined that the cut/seal head is at its "HOME" position. When this point is reached, all motors, i.e., cut/seal head motor, the infeed conveyor motor and the wrapper are all stopped. An air solenoid is operated to disengage the finwheel from the film and control is returned to the point in the "NORMRUN" routine where the "SYNCSTOP" subroutine was called.

If earlier in the "SYNCSTOP" subroutine, the test of the emergency switch had revealed that it was set, then an "EMERGENCY" message would be displayed on the operator control panel and a jump instruction is executed to the main "EMERGENCY" routine, yet to be described.

The remaining subroutines, which are called for or executed during the main "NORMRUN" routine, have previously been explained in connection with the explanation of the "NORUN" main routine and need not be repeated here. Next to be considered is the main routine referred to as "SYNCNORUN" and the various subroutines unique to it.

Figure 13A:
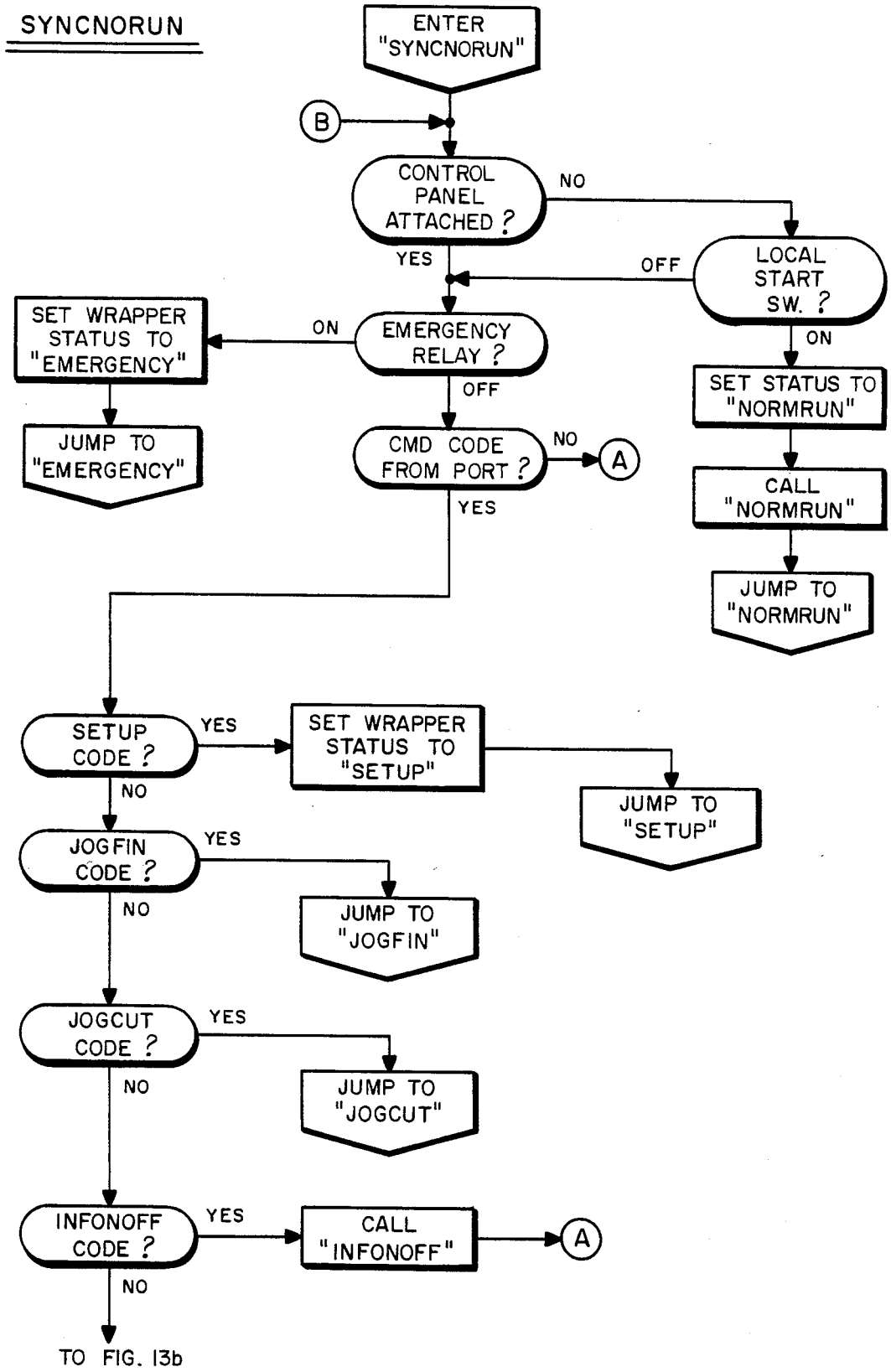
FIGS. 13(*a*) through 13(*c*) together comprise a flow chart of the main software routine referred to as "SYNCNORUN"
Figure 13B:
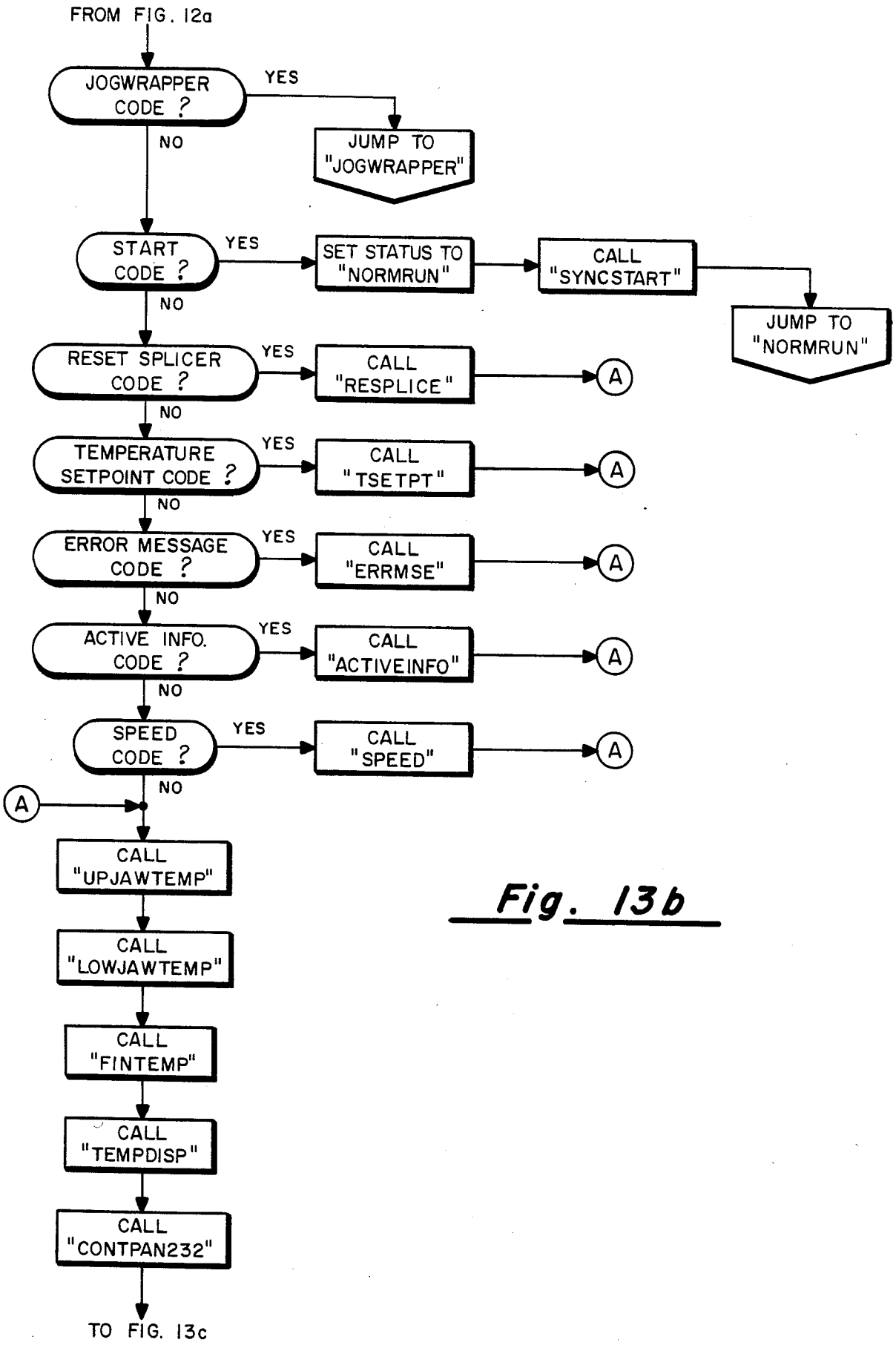
Figure 13C:
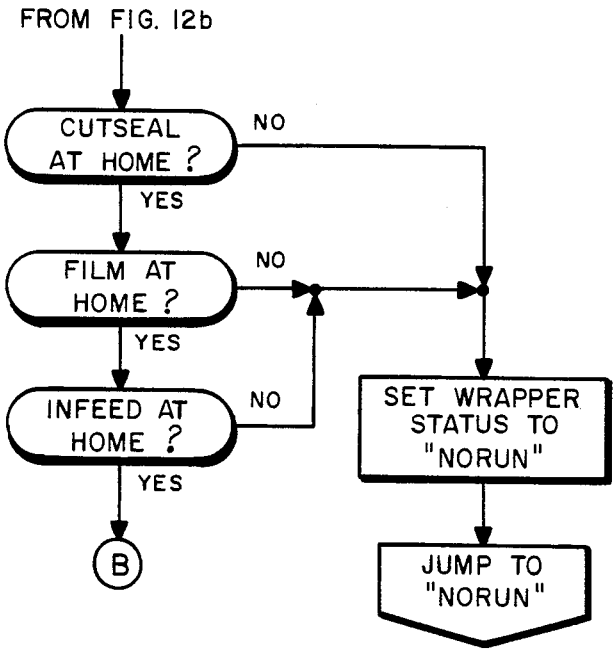

The flow chart for the "SYNCNORUN" is depicted on FIGS. 13(*a*)-(*c*) of the drawings. The high-speed wrapping machine of the present invention includes two control panels, one of which is referred to as the local control panel and it is permanently attached to the wrapping machine. The other control panel includes its own CPU and associated electronics and is detachable from the machine itself. Each of these control panels includes its own Start switch. Because of good safety practices, a machine of the type described herein is only allowed to have one operational Start switch. Hence, a test is made to determine whether the detachable control panel is coupled into the system. If it is not, the Start switch on the local control panel is controlling. Depression of that Start switch causes the message "NORMRUN" to be displayed and causes the "SYNCSTART" subroutine to be executed. Following that, a jump is made to the "NORMRUN" routine.

If, at the time of the test, the Start switch on the local control panel has been off, a test is made to determine whether the emergency relay had been energized. The emergency relay is a device which receives control signals from a number of points in the system. For example, various protective guards must be in place for operator-safety and, if any one is not in place, a signal goes to the emergency relay to energize it. Had this relay been energized, the "EMERGENCY" message would be presented on the display panel and an exit is made to the "EMERGENCY" routine.

When the detachable control panel is attached to the wrapper, via its pluggable connection, the Start switch on the local control panel is disabled. The microprocessor in the detachable control panel can present command codes at an apparatus IO port. The "SYNCNORUN" routine examines this port to detect the presence of command codes and, depending upon which, if any, is detected, any one of several subroutines illustrated on FIGS. 13(*a*) and 13(*b*) may be executed.

When the flow diagram for the "SYNCNORUN" routine is compared to that for the "NORUN" routine, it will be noted that the two are quite similar. However, in the "SYNCNORUN" routine, the steps necessary to perform "HOMING" are missing. This is because the system can only enter the "SYNCNORUN" routine following execution of the "SYNCSTOP" subroutine. It will be recalled that during the "SYNCSTOP" subroutine, the "HOMING" function takes place. Notwithstanding these facts and with reference to FIG. 13(*c*), it will be noted that the position of the cut/seal head, the film and the infeed conveyor are tested to determine whether they are at their "HOME" position. These test are necessitated by the fact that it is possible that one of these three devices could have been moved by hand by the operator while the machine had been shut down and if so moved, it might not be possible to restart the system without having the "HOME" condition prevailing. Rather than merely being able to restart under the "SYNCSTART" subroutine, if any one of the cut/seal head, the finwheel or the infeed conveyor had been moved by hand, the result would be a return to the "NORUN" routine where "HOMING" would take place in advance of start-up.

Because of the significant similarities between the "SYNCNORUN" and "NORUN" routines and the fact that the "NORUN" routine has already been described and the unique particularities of the "SYNCNORUN" routine have also been described, it is believed unnecessary to set out in any greater detail the functioning of the "SYNCNORUN" routine.

Figure 36:
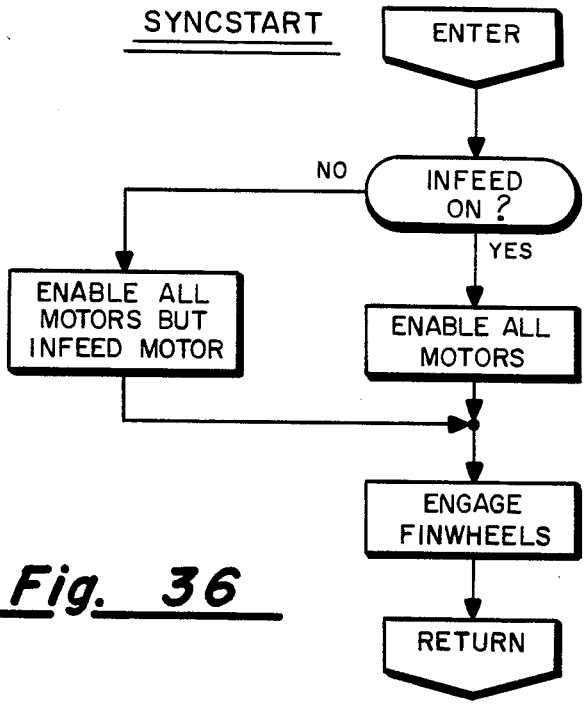
FIG. 36 is a flow chart of the subroutine referred to as "SYNCSTART"

The "SYNCSTART" subroutine of FIG. 36 merely tests the condition of the Infeed switch, and if that switch is on, all motors are energized and the finwheels are engaged, allowing the wrapper to begin moving film past the former and past the cut/seal head in a synchronized fashion. However, if the Infeed switch had not been on, only the cut/seal head motor and the finwheel motors would be engaged and no product would be introduced via the infeed conveyor. This latter mode of operation is generally used during start-up alignment and maintenance.

Figure 14A:
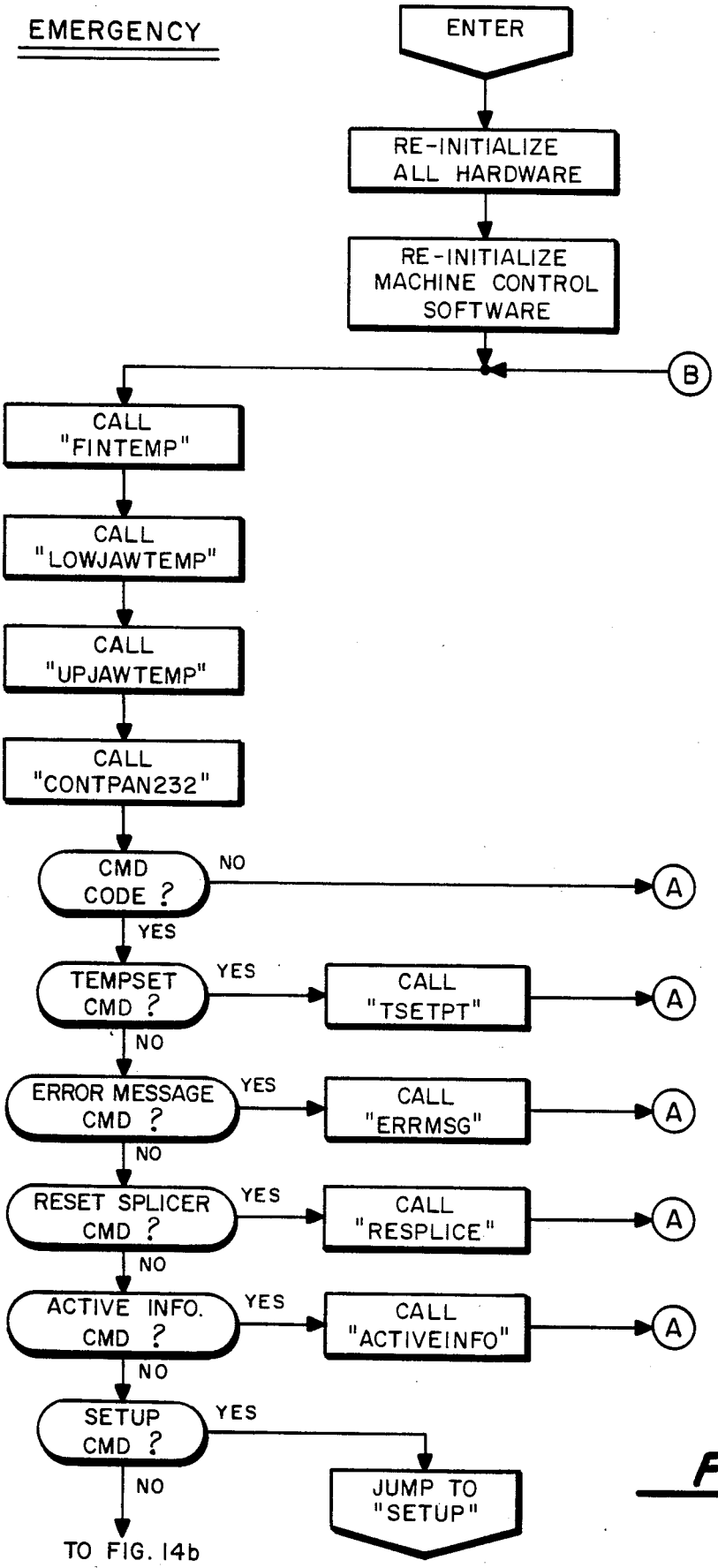
FIGS. 14(*a*) and 14(*b*) together comprise the software chart for the main routine called "EMERGENCY"
Figure 14B:
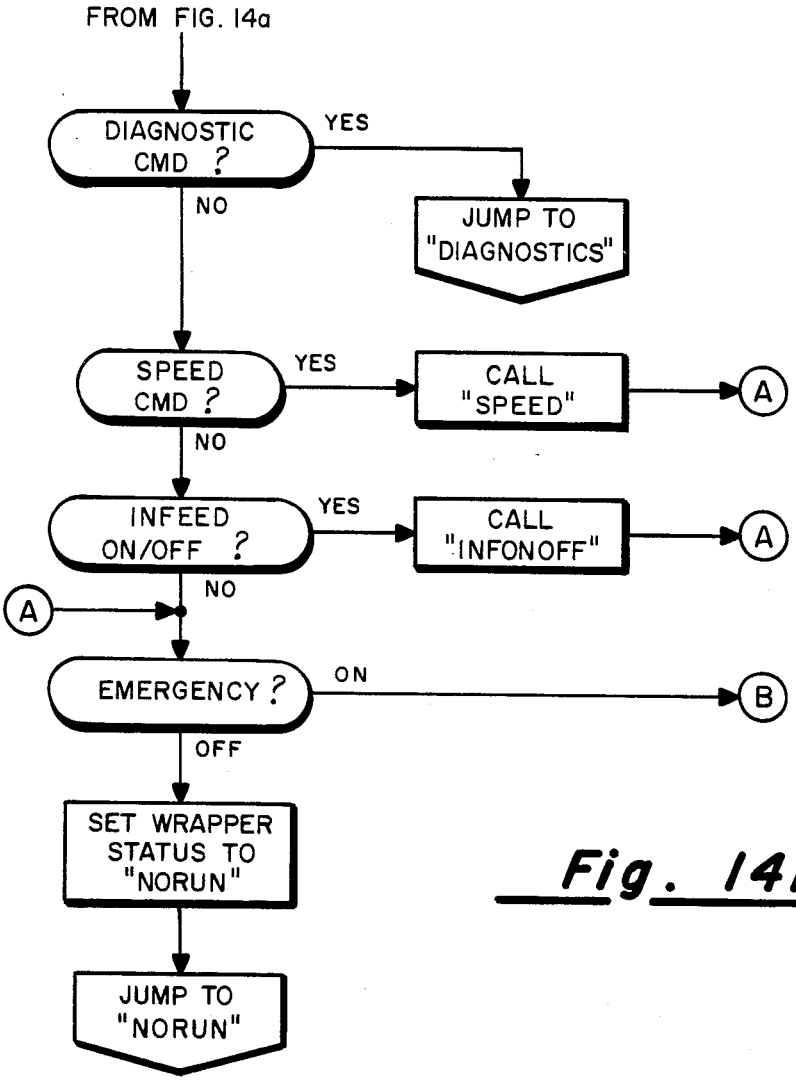

The final main routine to be explained is referred to "EMERGENCY", the flow charts of which are shown in FIGS. 14(*a*) and 14(*b*) of the drawings.

In the event a system malfunction is detected or should certain protective guards or the like be interferred with, an emergency relay will be activated causing the wrapper and its infeed conveyor to immediately shut-down in an unsynchronized manner. When the emergency shut-down condition clears, the MBS causes the instructions comprising the "EMERGENCY" routine to be executed to bring the system back into operation. As indicated in FIGS. 14(*a*) and 14(*b*), because the system had been deactivated in an uncontrolled fashion, it is now necessary to reinitialize the hardware and machine control software. Following the reinitialization steps, including the clearing of various registers and flags, etc., the finwheels and the cut/seal head will again have their temperature controls activated until their desired operating points are reached. Following that, the RS 232 port on the control panel is examined for the presence of a command code. If no such command code is present, control continues to loop through the various temperature controlling software already described until such time as a comand code is presented. That command code is examined to determine its nature, i.e., whether it is a "TSETPUT" command, an "ERRMSG" command, etc. Depending upon the type of command, a different subroutine will be called and executed in response thereto. After the command has been honored, and if the emergency condition has been cleared, the display on the control panel will be made to present the designation "NORUN" and control will exit to the "NORUN" routine previously described.

It will be recalled that the "NORUN" routine includes a series of software operations which, when executed by the computer, causes the functional parts of the wrapper to assume their "HOME" position prior to beginning the normal run condition and, in this fashion, resynchronization is achieved following an emergency shutdown.

For the sake of completeness, it is to be mentioned that, in addition to the above-described main routines and the various subroutines executable thereunder, the MBS of the present invention also responds to five types of interrupts, namely, the Eyespot Interrupt, the Missed Eyespot Interrupt, the Pusher Interrupt, The Splicer, Interrupt and the Timeout Interrupt.

It will be recalled from the foregoing description that throughout certain of the routines and subroutines, information concerning the positional relationship between the infeed conveyor and the film is necessary. A dedicated counter known as the eyespot counter accumulates pulses from the film encoder and, as such, its contents at any time provide an indication of the distance that the film has moved since a preceding eyespot was sensed. The contents of that counter accumulated from eyespot-to-eyespot naturally dictates how long the pattern is on the film in question.

Those skilled in the art will also recognize that the eyespot-to-eyespot distance may vary over the length of the film as it is played off of its supply roll. This is due to the fact in the original printing operation on the film during its manufacture when the eyespots are formed, changes in diameter of the feed rolls through the printing apparatus result in a lack of consistency in the eyespot-to-eyespot distance.

The EYESPOT interrupt routine effectively takes a "snapshot" of the eyespot counter as it counts pulses from the film encoder. A check is made to determine whether the value observed is within a so-called eyespot window, and if it is, that value is saved as the applicable pattern length. The eyespot window is arbitrarily defined as being a minimum acceptable distance on either side of an expected eyespot which, if such an eyespot is detected within the range, is recognized by the software as being within tolerance. If an EYESPOT interrupt occurs within the window of the next-expected eyespot, a new window is computed and, as such, figuratively speaking, a sliding window is created in which eyespot testing is to occur.

Thus, slight variations in the eyespot-to-eyespot distance, such as occurs during the printing of the film, can be accommodated. However, if the contents of the eyespot counter indicate than an interrupt should occur, but none does within the window, it could be a result of inferior printing of the eyespot on the film or because of a Splice condition. A Splice usually will result in the next-succeeding eyespot not falling within the expected distance range defined by the window.

Figure 37:
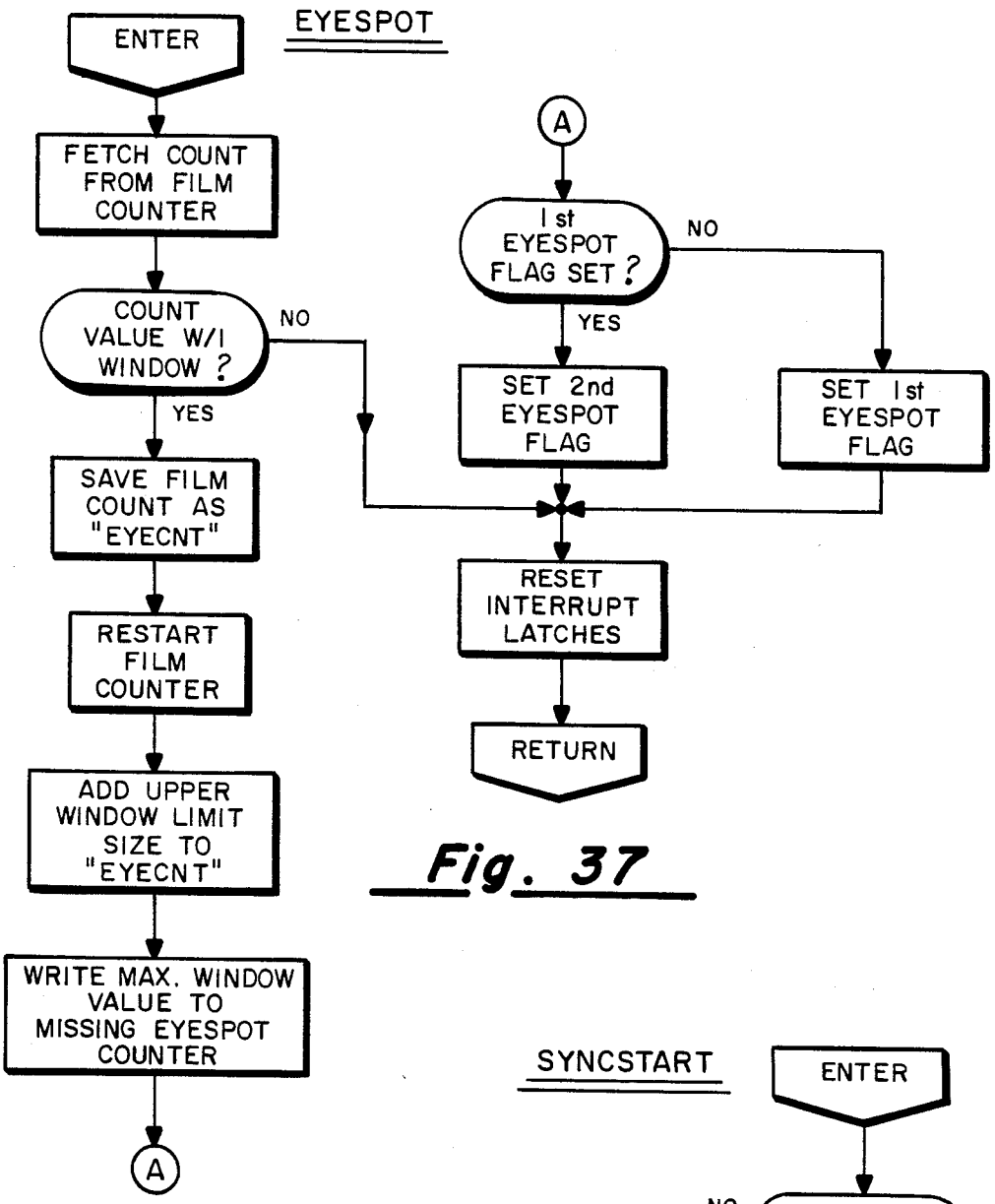
FIGS. 37, 38, 39, 40 and 41 comprise software flow charts of various interrupt routines executed by the MBS of the present invention.

With this information in mind and with reference to FIG. 37, upon the detection of an eyespot, the contents of the eyespot counter are fetched and a determination is made as to whether that count value is within or outside of the established window. If it is within the window, that film count value is saved as the "EYECNT" value. The film counter is restarted and then the arbitrarily assigned upper window limit size is added to the "EYECNT" value. Next, the value so computed is sent to the "missing eyespot" counter, the function of which will be discussed when the flow diagram of FIG. 38 is considered.

Next, a test is made to determine whether a first Eyespot flag has been set. This is a flag which, it may be recalled, is utilized by the "HOME" subroutine. If it is not found to be set, the next operation is to set that Eyespot flag followed by a resetting of the interrupt latches. Had the test revealed that the first Eyespot flag had been set, then a second Eyespot flag is also set, that, too, being used during the "HOME" subroutine.

Figure 38:
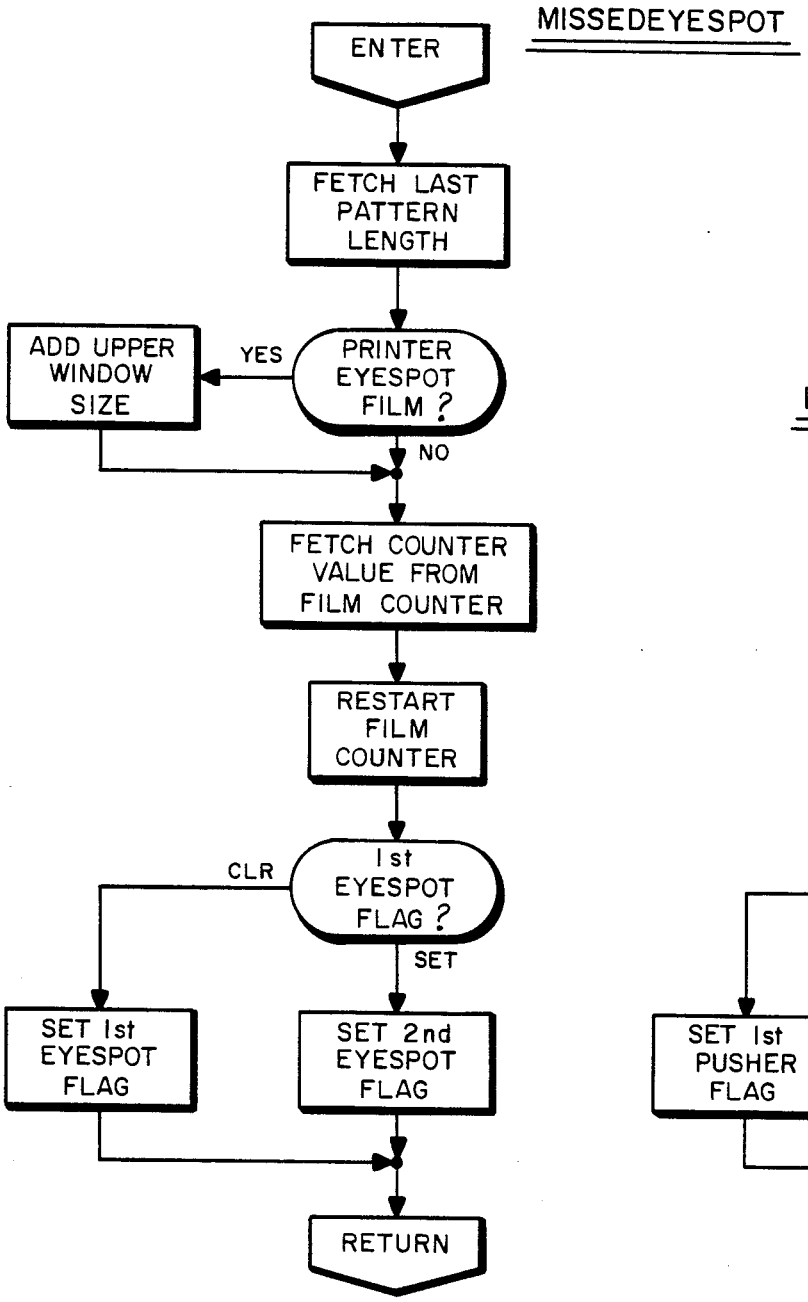

The MISSEDEYESPOT interrupt routine of FIG. 38 brings into play the above-mentioned "missing eyespot" counter which has its contents established during the EYESPOT interrupt routine already described. This counter is decremented by one upon the occurrence of each film encoder pulse. Each time an eyespot is found, the "missing eyespot" counter gets reloaded with the upper window value. If the counter should reach zero, then it is known that the expected eyespot either went by undetected or, alternatively, a Splice condition may have resulted in that expected eyespot falling outside of the window zone. When this happens, the MISSEDEYESPOT interrupt occurs. The action resulting from the occurrence of that interrupt is substantially the same as that which results when an EYESPOT interrupt takes place. That is, the counter value from the film counter is fetched and the various Eyespot flags are appropriately set. Thus, the MISSEDEYESPOT interrupt functions to determine the cut length when unprinted film is used and, also, allows the machine to run until a real eyespot is detected in the window following the occurrence of a Splice.

Figure 39:
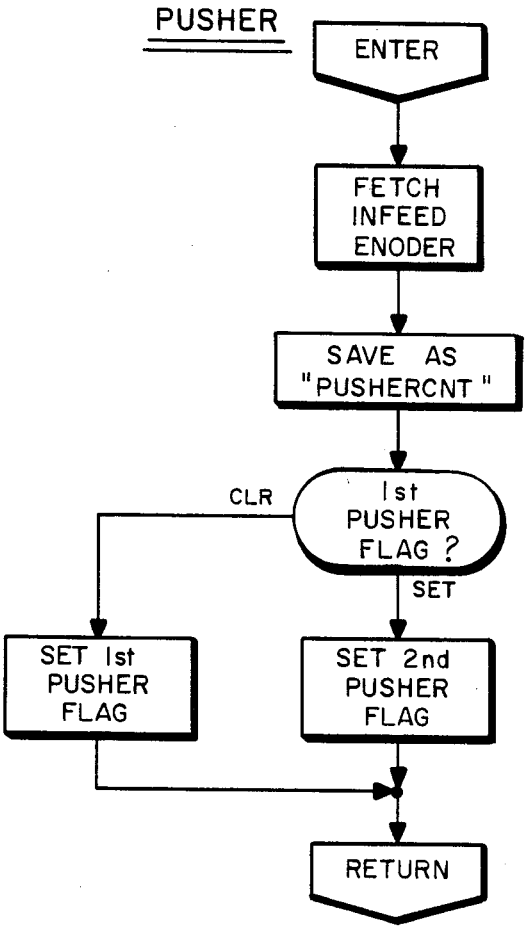

The PUSHER interrupt illustrated in FIG. 39 merely captures the contents of the counter which is used to accumulate pulses from the infeed conveyor encoder. This value is saved as the "PUSHERCNT" used by certain of the above-described routines. The value in question constitutes the actual infeed flight length.

Figure 40:
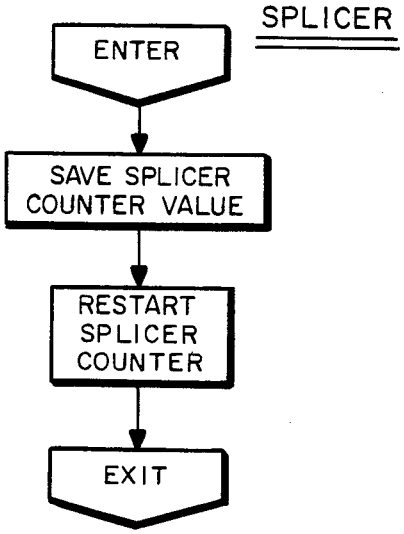

The SPLICEREYESPOT interrupt represented by the flow chart of FIG. 40 is used to periodically capture the contents of a counter which has been accumulating film encoder pulses and which then acts to reset or restart that counter. The signal initiating the SPLICER interrupt is generated by the interaction of an eyespot of the film with the splicer eye 115, which is positioned proximate the splicer station of the wrapper. In executing the splice function itself, an end-of-film sensor is tripped when the film on a roll is exhausted. Following the occurrence of that trip signal, a splicer is energized at a predetermined counter value, which is loaded at the time of the original Setup operation. More specifically, once the trip signal occurs, the count value at which the splice is to occur is compared to a current count value and when the equality is reached, the splicer solenoid is activated, causing two rubber rollers to come together so as to press a strip of double-backed adhesive tape to join the tail-end of the exhausted roll to the leading-end of a new roll.

Figure 41:
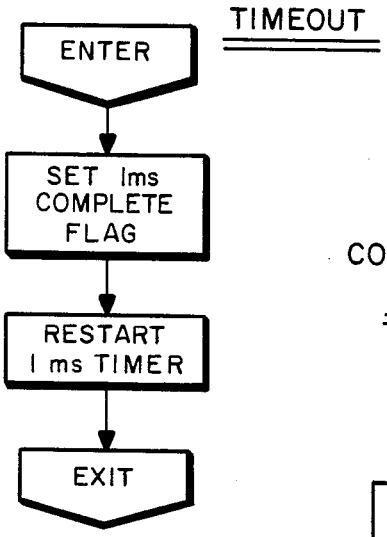

Referring to the TIMEOUT interrupt routine of FIG. 41, it is to be recalled that all of the routines that are used to control wrapper functions, e.g., NORUN, NORMRUN, etc., have a loop-time of one millisecond. That is, each time a pass is made through a software loop, a delay/phase in entered to ensure that each such pass through a loop requires exactly one millisecond. Thus, all of the operating routines have the same exact execution time. The TIMEOUT interrupt illustrated by FIG. 41 in the drawings simply sets a flag indicating that the one millisecond timeout period has occurred and it then restarts the one millisecond timer for the next subsequent loop or sequence.

Figure 42:
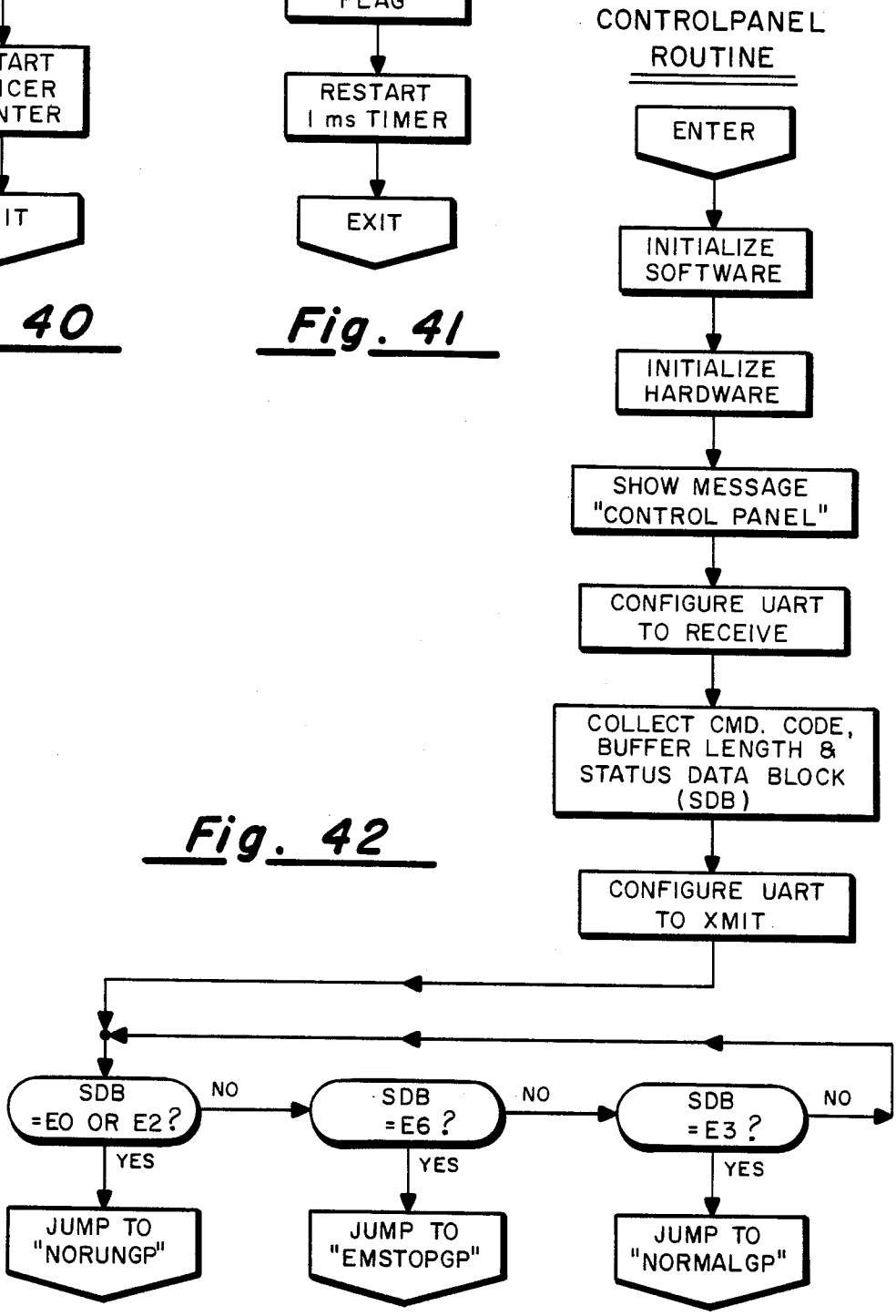
FIG. 42 comprises the main routine called CONTROLPANEL.
Figure 43A:
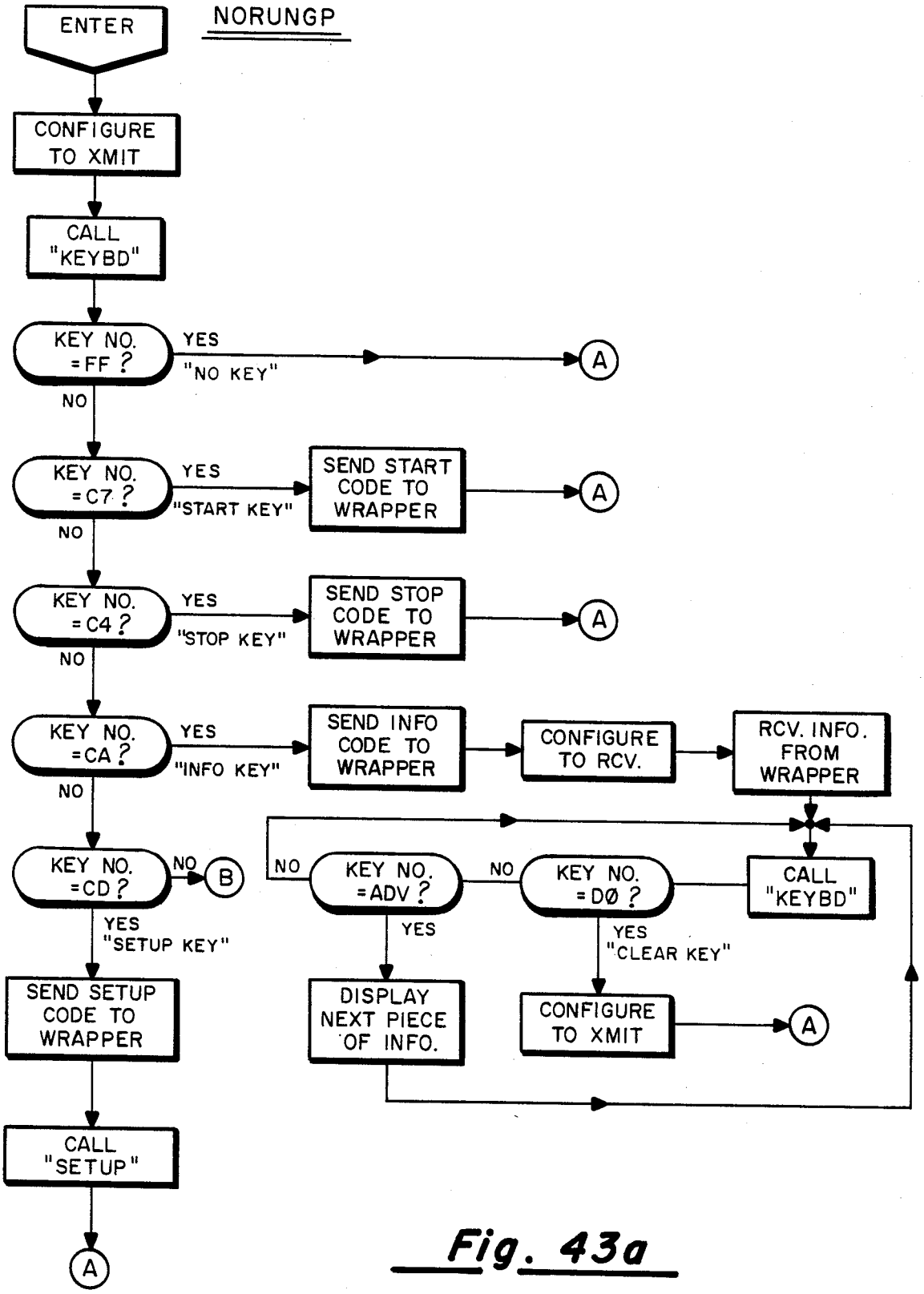
FIGS. 43(*a*) through 43(*d*) comprise the NORUNGP subroutine used in the main routine of FIG. 42.
Figure 43B:
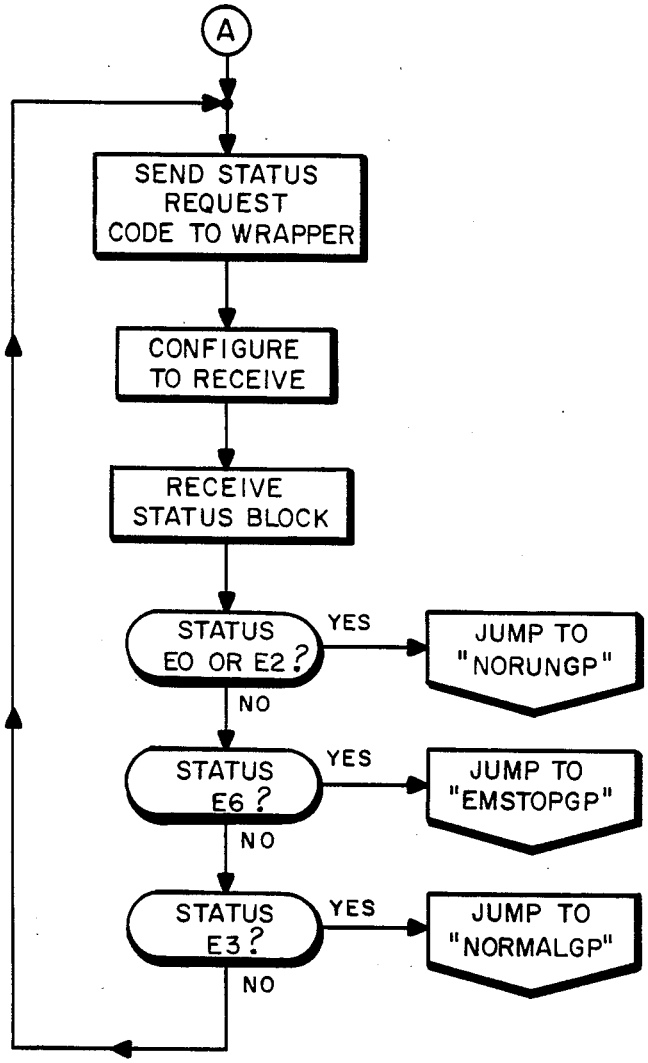
Figure 43D:
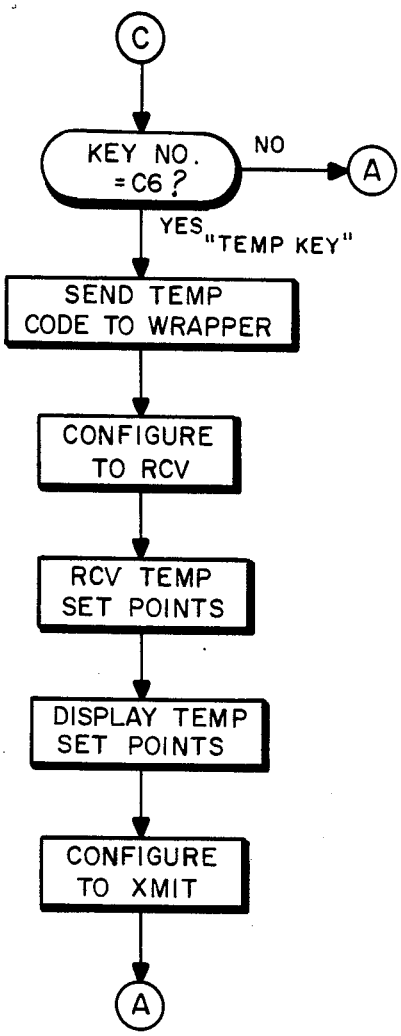
Figure 43C:
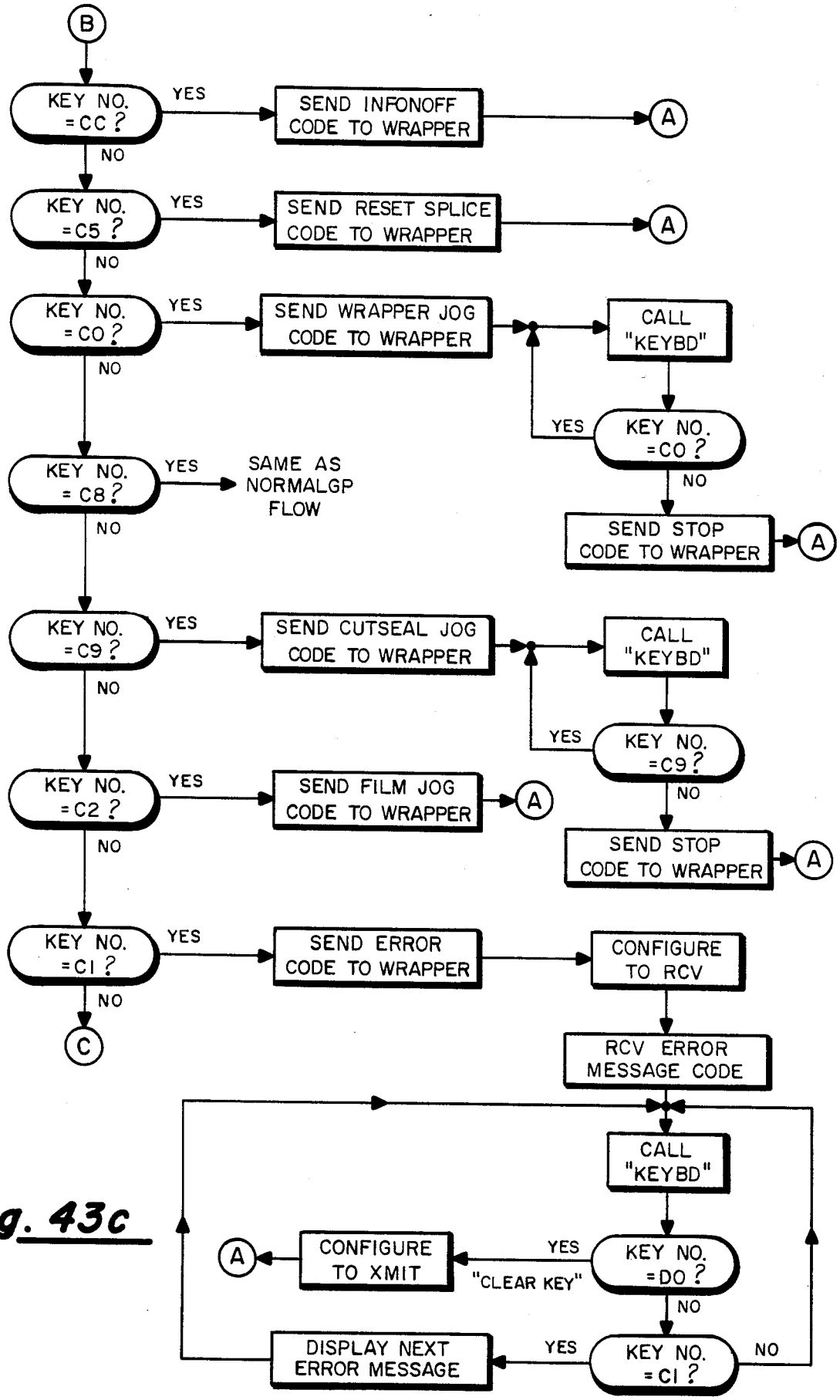

The main program comprising the CONTROLPANEL routine is illustrated by the flow diagram of FIG. 42. It will be recalled that the remote control panel is structured to comprise a separate, free-standing unit which is adapted to be plugged into a variety of different machines so as to exercise over those machines. With reference to FIG. 8, the remote control panel 54 includes its own microprocessor controller 59, which is separate and distinct from the microprocessor 51 associated with the wrapper itself. The microprocessor in the remote control panel may communicate with the microprocessor of the wrapper via a bi-directional communications link. When the power is applied to the remote control panel, its display/keyboard controller 59 is made to execute the program defined by the flow chart of FIG. 42. Specifically, certain hardware and software initialization paths are executed followed by the display of the message "Control Panel", which indicates to an operator that the remote control panel is tied into the system and in a position to be utilized. With the remote control panel properly connected, certain control lines going to the microprocessor 51 associated with the wrapper and the wrapper microprocessor 51 reacts by transmitting to the remote control panel pertinent information concerning the mode of operation which the wrapper is then in as well as particulars concerning the types of products that are being wrapped. Stated simply, the microprocessor in the remote control panel is capable of sampling and retrieving the contents of the memory of the wrapper microprocessor 51.

Once this pertinent information has been retrieved from the microprocessor 51 for the wrapper, depending upon the bit permutations of the so-called status data blocks (SDB), the microprocessor 59 associated with the control panel will jump to one of several subroutines to be described. These subroutines are referred to as "NORUNGP", "NORMALGP" and "EMSTOPGP".

In the NORUNGP subroutine, when entered, the keyboard/display controller 59 is conditioned to place it in a mode wherein it is able to transmit data over appropriate lines to the common bus leading to the microprocessor 51 in the wrapper. Next, a series of tests are conducted to determine which, if any, switches on the keyboard have been actuated and, depending upon the particular key number identified, various codes are sent to the wrapper from the remote control panel. For example, if key number C7 (hexidecimal) had been depressed, the so-called "Start" code would be transmitted. Following that, control transfers to the subroutine loop shown in FIG. 43(*b*) wherein a status request code is transmitted to the microprocessor contained in the wrapper and, depending upon which status code is transmitted, a variety of actions takes place, via jump instructions to the other control panel subroutines previously mentioned. If the call to the keyboard establishes that neither the START key nor the STOP key has been actuated but that the "INFO" key (key number CA) had been, a code is sent to the wrapper, and the microprocessor in the control panel is configured to receive data from the wrapper. The keyboard on the remote control panel is again tested and, if the advance (ADV) key is set, the information received from the wrapper is displayed on the appropriate viewing area on the remote control panel.

If none of the keys identified by the hexidecimal numbers SF, C7, C4, CA or CD have been found to have been actuated when the keyboard was called, then control passes to the operation and decision sequences reflected in FIG. 43(*c*) by way of the connection point B. As can be seen from the diagram of FIG. 43(*c*), various other keys on the keyboard associated with the remote control panel are sampled during iterative cycles of the system software and, depending upon the particular key which is found to be actuated, a serious of machine-control operations take place. Thus, for example, if key number CC (hexidecimal) is found to have been actuated, the INFONOFF code is sent to the wrapper causing that routine to be executed. That software has already been explained in connection with a discussion of the flow diagram of FIG. 22 and, accordingly, will not be repeated here. It is believed apparent that, depending upon which of the numerous keys are actuated, control exits to other routines and subroutines which serve to cause the high-speed microprocessor-based wrapper to operate various ways.

By way of summary, then, the NORUNGP software when executed by the microprocessor in the remote control panel establishes two-way communication between itself and the microprocessor of the wrapper whereby the wrapper can be controlled from a remote point and whereby information orginating at the wrapper can be transmitted to that remote point for display to an operator.

Figure 44B:
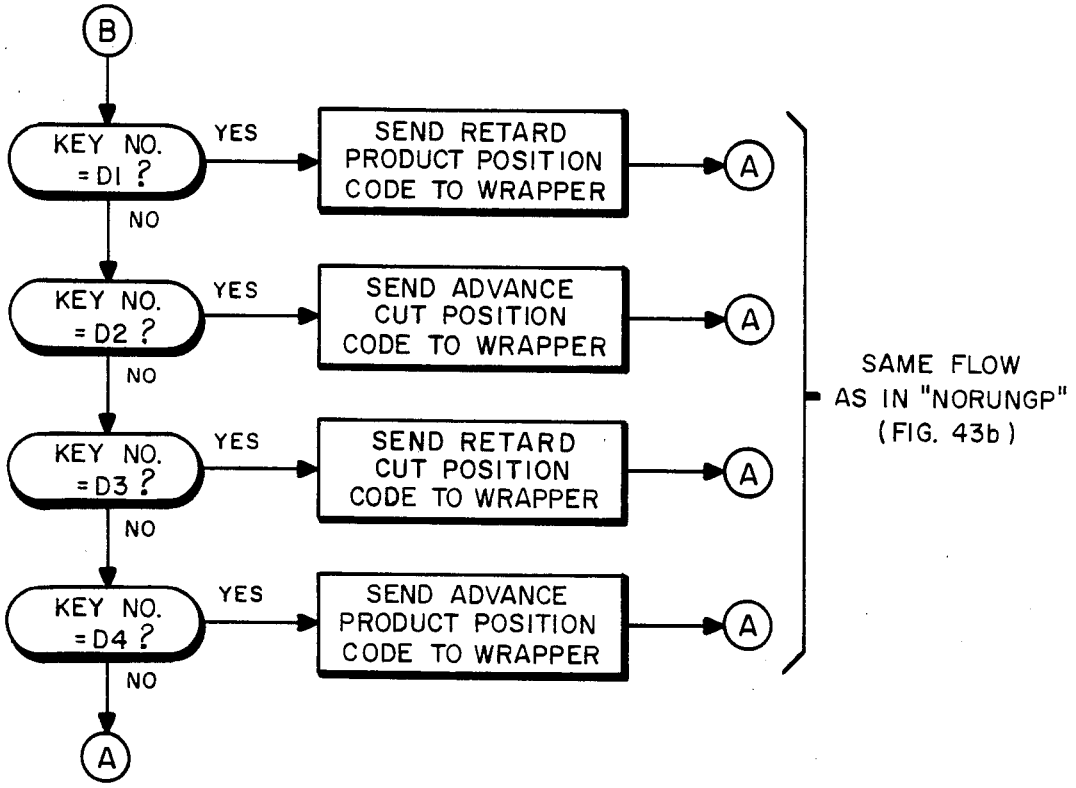

The subroutine NORMALGP illustrated in FIG. 44(*a*) and FIG. 44(*b*) allows the system to be made to operate in the fashion dictated by the NORMRUN routine of FIGS. 12(*a*)–12(*c*) but with the necessary data entries being made at the site of the remote control panel rather than at the local control panel which is a part of the high-speed wrapper itself. Because at this point the reader is familiar with the flow charts presented hereinabove, the diagrams of FIGS. 44(*a*) and 44(*b*) have been simplified by merely indicating that if various ones of the keyboard keys are actuated at the time of sampling, a series of machine operations are executed in accordance with previously described routines and subroutines.

The subroutine EMSTOPGP also results in calls made to the keyboard 57 to test which keys, if any, have been actuated. Depending upon which key has been actuated, various functions are carried out, all as previously described in connection with the explanation of the NORUNGP subroutine. Because of that previous explanation, no further description of the EMSTOPGP is felt to be necessary.

The final set of software flow diagrams to be considered are those relating to the SETUP operation which is a function called for during execution of the NORUNGP as shown in FIG. 43(*a*) of the drawings. The SETUP subroutine itself is shown in FIGS. 46(*a*) through 46(*h*) of the drawings. As can be observed, the SETUP routine presents a series of prompts which help to define the parameters which are necessary to execute the SETUP operation. Thus, for exemplary purposes only, upon entry of the SETUP routine, the message:

"Select mode of setup value generations"

1=select values 2=modify values"

The operator then makes his selection (either key number 1 or key number 2) and if key number 1 had been the one selected, the existing display message is cleared and a new prompt reading:

"Select product# "

is presented on the bottom line. Again, a call is made to the keyboard and if a key number under 10 had been actuated, the number of the key so selected would be entered into the blank previously created. Once a test is shown that a key number under 10 had been entered, the software causes the message:

"Setup completed"

to be displayed on the top line, while the message:

"Press clear to exit"

is presented on the bottom line of the display. Once the "clear" key is depressed, the message:

"CONTROL PANEL"

is presented, indicating that it is the remote control panel now in control of the high-speed wrapper. An exit is then made to the NORUN routine.

If earlier in the cycle it had been determined that it was key number 2 that had been depressed rather than key number 1, the existing display message would be cleared and a new prompt reading:

"Enter product ID number (0–9)"

is displayed and a test made to determine whether a key number in the range of 0–9 has been depressed. If so, the value is saved as the "product number". Then, the display is cleared and the message:

"The ID number for this product is "

"Does this prod use cold seal film"

is displayed and then the operations called for in the flow diagram of FIG. 46(*c*) are next displayed. That is, the message is displayed and the answer which was prevailing prior to this Setup operation is presented. Then, the Cold Seal flag is cleared. As those skilled in the art will recognize, if a cold seal film is employed, it is not necessary to energize the heaters associated with the cut/seal heads and with the finwheels. Then, if a test of the keyboard indicates that key number CE (hexidecimal) has been set, the display message is changed to indicate that it is, in fact, a cold seal-type film that is to be used and the Cold Seal flag is set. Thus, upon the next pass through the loop, the flag being set will result in an exit to the flow diagram of FIG. 46(*d*) and still further prompts and operator actions in response to the prompts are called.

It is believed that the explanation thus far of the Setup software is sufficient to allow persons skilled in the art to comprehend and follow the remaining flow diagrams relating to the SETUP subroutine and, for that reason, it is deemed to be unnecessary to describe each and every flow path pertaining to the Setup operation.

The invention has been described herein in considerable detail in order to comply with the Patent Statutes and to provide those skilled in the art with the information needed to apply the novel principles, and to construct and use such specialized components as are required. However, it is to be understood that the invention can be carried out by specifically different equipment and devices, and that various modifications, both as to equipment details and operating procedures, can be accomplished without departing from the scope of the invention itself.

What is claimed is:

1. A horizontal wrapping machine for wrapping products in packages formed from a continuous film of packaging material, comprising:

a former for shaping a continuous film of packaging material drawn past the former into a continuous tube;

film drive means for drawing the continuous film of packaging material past the former and past a cutting and sealing station;

product infeed means, responsive to a product infeed rate control signal, for feeding products to be packaged into the former and the continuous tube of packaging material at a velocity dependent upon the product infeed velocity control signal;

means for cutting and sealing the continuous tube of packaging material as each product moves past the cutting and sealing station;

means for measuring the film velocity; and microprocessor means coupled to receive signals proportional to film velocity from said means for measuring the film velocity, said microprocessor means being programmed to compute the product infeed rate control signal from said received signals proportional to film velocity and coupled to provide said product rate control signal to said product infeed means.

2. A horizontal wrapping machine for wrapping products in packages formed from a continuous film of packaging material wherein each package contains a cut length of film, comprising:

a former for shaping a continuous film of packaging material drawn past the former into a continuous tube, said film having a pattern of fiducial marks spaced longitudinally therealong;

film drive means, responsive to a film velocity control signal, for drawing the continuous film of packaging material past the former and past a cutting and sealing station at a velocity dependent upon the film velocity control signal;

product infeed means, responsive to a product infeed rate control signal, for feeding products to be packaged into the former and the continuous tube of packaging material at a rate dependent upon the product infeed rate control signal;

means for cutting and sealing the continuous tube of packaging material as each product moves past the cutting and sealing station;

means, coupled to a film drive means and the product infeed means, for producing said film velocity control signal and said product infeed rate control signal to maintain the film velocity and the product infeed rate such that a product is fed into the former by the product infeed means for each cut length of film drawn past the former by the film drive means;

said means for producing said film velocity control signal having (a) means for sensing the passage of said fiducial marks contained on the film, (b) microprocessor means including counting means for accumulating a count of the number of said fiducial marks sensed during prescribed time intervals, and (c) memory means associated with said microprocessor means for storing speed controlling signals at addressable locations therein, the contents of said counting means defining addresses for reading said speed controlling signals from said memory means; and means for determining the relative orientation between each product and its associated cut length of film moving past the film former.

3. A horizontal wrapping machine for wrapping products in packages formed from rolls of a continuous film of packaging material wherein each package contains a predetermined cut length of film, comprising:

a former for shaping a continuous film of packaging material drawn past the former into a continuous tube;

film drive means, responsive to a film velocity control signal, for drawing the continuous film of packaging material past the former and past a cutting and sealing station at a velocity dependent upon the film velocity control signal;

product infeed means, responsive to a product infeed rate control signal, for feeding products to be packaged into the former and the continuous tube of packaging material at a rate dependent upon the product infeed rate control signal;

means for cutting and sealing the continuous tube of packaging material as each product moves past the cutting and sealing station;

means, coupled to the film drive means and to the product infeed means, for producing said film velocity control signal and said product infeed rate control signal to maintain the film velocity and the product infeed rate such that a product is fed into the former by the product infeed means for each cut length of film drawn past the former by the film drive means;

a film splicer located upstream from the former for splicing the trailing end of a used roll of said continuous film to the leading end of a new roll of said continuous film in response to the generation of a splice command;

means for signaling the end of a used roll of said continuous film;

means for storing a count value corresponding to a predetermined length of film; and means responsive to said signaling means for generating a splicer actuating signal when said count value corresponds to the passage of said predetermined length of film following operation of said signaling means.

4. A horizontal wrapping machine for wrapping products in packages formed from a continuous film of packaging material wherein each package contains a cut length of film, comprising:

a former for shaping a continuous film of packaging material drawn past the former into a continuous tube;

film drive means, responsive to a film velocity control signal, for drawing the continuous film of packaging material past the former and past a cutting and sealing station at a velocity dependent upon the film velocity control signal;

product infeed means, responsive to a product infeed rate control signal, for feeding products to be packaged into the former and the continuous tube of packaging material at a rate dependent upon the product infeed rate control signal;

means for cutting and sealing the continuous tube of packaging material as each product moves past the cutting and sealing station;

programmable microprocessor means, including addressable memory means, coupled in controlling relation to said film drive means and said product infeed means for developing a product infeed rate control signal in relation to said film velocity control signals;

film position sensing means for developing a first digital quantity indicative of the instantaneous position of the film relative to a predetermined reference;

product position sensing means for developing a second digital quantity indicative of the instantaneous position of the product infeed means;

means including said programmable microprocessor means for computing the difference between said first and second digital quantities, said difference constituting an address for said addressable memory means for reading a product infeed rate ratio from said memory means; and means responsive to said ratio and said film velocity control signal for adjusting the speed of said product infeed means.

5. A horizontal wrapping machine for wrapping products in packages formed from a continuous film of packaging material wherein each package contains a cut length of film, comprising:

a former for shaping a continuous film of packaging material drawn past the former into a continuous tube;

film drive means, responsive to a film velocity control signal, for drawing the continuous film of packaging material past the former and past a cutting and sealing station at a velocity dependent upon the film velocity control signal;

product infeed means, responsive to a product infeed rate control signal, for feeding products to be packaged into the former and the continuous tube of packaging material at a rate dependent upon the product infeed rate control signal;

means for cutting and sealing the continuous tube of packaging material, as each product moves past the cutting and sealing station, including at least one heated cut-head;

means, coupled to the film drive means and the product infeed means, for producing said film velocity control signal and said product infeed rate control signal to maintain the film velocity and the product infeed rate such that a product is fed into the former by the product infeed means for each cut length of film drawn past the former by the film drive means;

means for heating said cut-head in response to a heater activation signal;

microprocessor means for comparing the measured temperature of said cut-head to a predetermined set-point and for producing a cut-head temperature control signal indicative of the difference between the measured cut-head temperature and said set-point temperature; and control means coupled to receive said cut-head temperature signal from said microprocessor means, for producing said heater activation signal when the measured cut-head temperature falls below said temperature set-point.

6. A horizontal wrapping machine for wrapping products in packages formed from a continuous film of packaging material wherein each package contains a cut length of film, comprising:

a former for shaping a continuous film of packaging material drawn past the former into a continuous tube;

film drive means, responsive to a film velocity control signal, including at least one pair of finwheels, at least one of which is heated, for drawing the continuous film of packaging material past the former and past a cutting and sealing station at a velocity dependent upon the film velocity control signal;

product infeed means, responsive to a product infeed rate control signal, for feeding products to be packaged into the former and the continuous tube of packaging material at a rate dependent upon the product infeed rate control signal;

means for cutting and sealing the continuous tube of packaging material as each product moves past the cutting and sealing station;

means, coupled to the film drive means and the product infeed means, for producing said film velocity control signal and said product infeed rate control signal to maintain the film velocity and the product infeed rate such that a product is fed into the former by the product infeed means for each cut length of film drawn past the former by the film drive means;

means for heating said finwheel in response to a heater activation signal;

microprocessor means for comparing the measured temperature of said finwheel to a predetermined temperature set-point and for producing a finwheel temperature control signal indicative of the difference between the measured finwheel temperature and said temperature set-point; and control means coupled to receive said finwheel temperature signal from said microprocessor means for producing said heater activation signal when the measured finwheel temperature falls below said temperature set-point.

7. A horizontal wrapping machine for wrapping products in packages formed from a continuous film of packaging material containing eyespots at spaced apart intervals therealong corresponding to a succession of cut lengths of film, wherein each package contains a single cut length of film, comprising:

a former for shaping a continuous film of packaging material drawn past the former into a continuous tube;

film drive means for drawing the continuous film of packaging material past the former and past a cutting and sealing station;

a product infeed conveyor positioned upstream of said former for feeding products to be packaged into said former and the continuous tube of packaging material;

product infeed conveyor drive means, responsive to a product infeed velocity control signal, for driving the product infeed conveyor at a velocity dependent upon the product infeed velocity control signal;

a pair of opposed cut-heads at a cutting and sealing station downstream from the former operable to be driven in unison to cut and seal the continuous tube of packaging material as each product moves past the cutting and sealing station;

cut-head drive means for driving the cut-heads to cut and seal the continuous tube of packaging material as each product moves past the cutting and sealing station;

film position monitoring means for producing at an output a signal indicative of film position relative to a reference;

product infeed monitoring means for producing at an output a signal indicative of product infeed conveyor position relative to a reference;

programmable microprocessor means, coupled to the film position monitoring means and to the product infeed conveyor drive means, for calculating the positional difference between said film position and said product infeed position;

a memory coupled to said programmable processor means for storing motor ratio values at a addressable locations therein;

means responsive to said positional difference for addressing said memory to obtain a motor ratio value; and means for multiplying said motor ratio by a factor proportional to the speed of said film drive means to yield an infeed velocity control signal, the derived infeed velocity control signal being such that the product infeed conveyor is driven to feed a product into the former for each cut length of film drawn past the former by the film drive means.

8. A horizontal wrapping machine for wrapping products in packages formed from a continuous film of packaging material wherein each package contains a cut length of film, comprising:

a former for shaping a continuous film of packaging material drawn past the former into a continuous tube;

film drive means, responsive to a film velocity control signal, for drawing the continuous film of packaging material past the former and past a cutting and sealing station at a velocity dependent upon the film velocity control signal;

product infeed means, responsive to a product infeed rate control signal, for feeding products to be packaged into the former and the continuous tube of packaging material at a rate dependent upon the product infeed rate control signal means for cutting and sealing the continuous tube of packaging material as each product moves past the cutting and sealing station;

microprocessor based controller means, coupled to the film drive means and the product infeed means, for producing said film velocity control signal and said product infeed rate control signal to maintain the film velocity and the product infeed rate such that a product is fed into the former by the product infeed means for each cut length of film drawn past the former by the film drive means; and means including said microprocessor based controller for adjusting the actual relative orientation between each product and its associated cut length of film moving past the film former.

9. A method of wrapping products in packages formed from a continuous film of packaging material, with each package containing a cut length of film, comprising the steps of:

shaping a continuous film of packaging material with a former by drawing the film past the former into the shape of a continuous tube;

drawing the continuous film of packaging material past the former and past a cutting and sealing station at a velocity dependent upon the film velocity control signal;

feeding products to be packaged into the former and the continuous tube of packaging material at a rate dependent upon a product infeed rate control signal;

cutting and sealing the continuous tube of packaging material as each product moves past the cutting and sealing station;

computing a product infeed rate control signal;

applying said infeed rate control signal to an infeed conveyor motor to maintain the film velocity and the product infeed rate such that a product is fed into the former for each cut length of film drawn past the former; and determining the relative orientation between each product and its associated cut length of film moving past the former.

10. A method of wrapping products in packages formed from a continuous film of packaging material comprising the steps of:

shaping a continuous film of packaging material in a former by drawing the film past the former into the shape of a continuous tube;

drawing the continuous film of packaging material past the former and past a cutting and sealing station;

feeding products to be packaged into the former and the continuous tube of packaging material at a velocity dependent upon a product infeed velocity control signal;

cutting and sealing the continuous tube of packaging material as each product moves past the cutting and sealing station;

developing a first count value proportional to film position relative to a fixed reference;

developing a second count value proportional to product position relative to a fixed reference;

computing the difference between the first and second count values to develop a positional error value;

reading from a memory table a motor ratio value using said positional error value as an address; and computing said infeed rate control signal from said motor rate ratio read from the memory table.

11. A horizontal wrapping machine for wrapping products in packages formed from a continuous film of packaging material, comprising:

a former for shaping a continuous film of packaging material drawn past the former into a continuous tube;

film drive means for drawing the continuous film of packaging material past the former and past a cutting and sealing station;

product infeed means, responsive to a product infeed rate control signal, for feeding products to be packaged into the former and the continous tube of packaging material at a velocity dependent upon the product infeed velocity control signal;

means for cutting and sealing the continuous tube of packaging material as each product moves past the cutting and sealing station, said means for cutting and sealing including an opposed pair of rotatable cut/seal heads, each including at least one blade on one of said pair of heads and at least one anvil on the other of said pair of heads, said heads being driven by cut/seal head motor means;

microprocessor means including memory means for storing in addressable tables therein motor ratio value relating the cut/seal head speed to the speed of said film drive means;

means for monitoring the angular position of said blade and anvil and developing memory addresses which are dependent upon said angular position;

means for applying said memory addresses to said memory means for reading from said tables of motor ratio values corresponding to the instantaneous angular position of said blade and anvil;

means for multiplying said motor ratio by a factor proportional to the actual speed of said film drive means for developing a cut/seal head motor control signal; and means for applying said cut/seal head motor control signal to said cut/seal head motor means.

12. The horizontal wrapping machine as in claim 11 wherein a full rotation of said rotary cut/seal heads is divided into a plurality of discrete angular zones and wherein there is one addressable table for each of said discrete zones.

13. A horizontal wrapping machine for wrapping products in packages formed from a continuous film of packaging material, comprising:

a former for shaping a continuous film of packaging material drawn past the former into a continuous tube;

film drive means for drawing the continuous film of packaging material past the former and past a cutting and sealing station;

product infeed means, responsive to a product infeed rate control signal for feeding products to be packaged into the former and the continuous tube of packaging material at a velocity dependent upon the product infeed velocity control signal;

means for cutting and sealing the continuous tube of packaging material as each product moves past the cutting and sealing station, said means for cutting and sealing including an opposed pair of rotatable cut/seal heads, each including at least one blade on one of said pair of heads and at least one anvil on the other of said pair of heads, said heads being driven by cut/seal head motor means;

microprocessor means including memory means for storing in a first addressable table therein film position values relating to the cut/seal head blade and anvil position and in a second addressable table therein motor ratio values;

means for monitoring the angular position of said blade and anvil and developing memory addresses for said memory means which are dependent upon said angular position of said blade and anvil for reading out from said first table said film position values;

means for generating a value indicative of actual film position relative to a fixed reference;

means in said microprocessor means for computing the algebraic difference between said film position values obtained from said first table and said value indicative of actual film position;

means responsive to said algebraic difference for reading out from said second addressable table said motor ratio values;

means for multiplying said motor ratio values by a factor proportional to the actual speed of said film drive means for developing a cut/seal head motor control signal; and means for applying said cut/seal head motor control signal to said cut/seal head motor means.

14. A horizontal wrapping machine for wrapping products and packages formed from a continuous film of packaging material, comprising:

a former for shaping a continuous film of packaging material drawn past the former into a continuous tube;

film drive means for drawing the continuous film of packaging material past the former and past a cutting and sealing station;

product infeed means, responsive to a product infeed rate control signal, for feeding products to be packaged into the former and the continuous tube of packaging material at a velocity dependent upon the product infeed velocity control signal;

means for cutting and sealing the continuous tube of packaging material as each product moves past the cutting and sealing station;

means for monitoring the product position relative to fiducial marks on said film;

a first dedicated control panel mechanically attached to said wrapping machine and including a first programmed microprocessor means, said microprocessor means programmed to determine the difference between the position of product in said product infeed means and the location of said fiducial marks on said film for developing said infeed velocity control signal; and a second control panel electrically connected to said wrapping machine but locatable at a position remote from said wrapping machine and including a second programmed microprocessor means connected in communication with said first microprocessor means for effecting the transmission of data and control signals therebetween.

15. A horizontal wrapping machine for wrapping products in packages formed from a continuous film of packaging material wherein each package contains a cut length of film defined by spaced printed marks on said film, comprising:

a former for shaping a continuous film of packaging material drawn past the former into a continuous tube;

film drive means, responsive to a film velocity control signal, for drawing the continuous film of packaging material past the former and past a cutting and sealing station at a velocity dependent upon the film velocity control signal;

product infeed means, responsive to a product infeed rate control signal, for feeding products to be packaged into the former and the continuous tube of packaging material at a rate dependent upon the product infeed rate control signal;

means for cutting and sealing the continuous tube of packaging material as each product moves past the cutting and sealing station at locations determined by said printed marks, including programmable microprocessor means coupled to the film drive means and the product infeed means, for producing said film velocity control signal and said product infeed rate control signal to maintain the film velocity and the product infeed rate such that a product is fed into the former by the product infeed means for each cut length of film drawn past the former by the film drive means; and means for detecting the absence of a printed mark within a predetermined distance from a preceding printed mark and for generating an interrupt signal for said programmable microprocessor means upon the passage of said film through said predetermined distance.

16. The horizontal wrapping machine as in claim 1 and further including:

motor driven discharge conveyor means disposed downstream of said cutting and sealing means for receiving the sealed product thereon; and control means for said motor for causing said discharge conveyor to travel at a speed which is greater than that of said product infeed means.

17. The horizontal wrapping machine as in claim 8 and further including:

discharge conveyor means disposed downstream of said cutting and sealing means for receiving the sealed product thereon; and control means including said microprocessor-based controller for causing said discharge conveyor means to travel at a speed which is greater than that of said product infeed means.

18. The horizontal wrapping machine as in claim 14 and further including:

alphanumeric display means on said second control panel and operatively connected to said second programmed microprocessor means for visually displaying prompt message; and manually-operated keyboard means on said second control panel and operatively connected to said second programmable microprocessor means for entering data into said second programmed microprocessor means in response to said prompt messages displayed on said alphanumeric display means.

* * * * *